US005578409A

United States Patent [19]

Kotaki et al.

[11] Patent Number: 5,578,409

[45] Date of Patent: Nov. 26, 1996

[54] TONER FOR DEVELOPING ELECTROSTATIC IMAGE, ONE COMPONENT-TYPE DEVELOPER AND TWO-COMPONENT TYPE DEVELOPER

[75] Inventors: Takaaki Kotaki, Yokohama; Masaaki Taya, Kawasaki; Makoto Unno, Tokyo; Yushi Mikuriya, Kawasaki; Tadashi Dojyo, Ebina, all of Japan

[73] Assignee: Canon Kabushiki Kaisha, Tokyo, Japan

[21] Appl. No.: 543,871

[22] Filed: Nov. 15, 1995

Related U.S. Application Data

[63] Continuation of Ser. No. 176,229, Jan. 3, 1994, abandoned.

[30] Foreign Application Priority Data

| | | | |
|---|---|---|---|
| Jan. 11, 1993 | [JP] | Japan | 5-017886 |
| Oct. 15, 1993 | [JP] | Japan | 5-280639 |
| Nov. 1, 1993 | [JP] | Japan | 5-293837 |
| Nov. 1, 1993 | [JP] | Japan | 5-293838 |

[51] Int. Cl.[6] ..... G03G 9/087

[52] U.S. Cl. ..... 430/109; 430/110; 430/903

[58] Field of Search ..... 430/109, 903

[56] References Cited

U.S. PATENT DOCUMENTS

| | | | |
|---|---|---|---|
| 2,221,776 | 11/1940 | Carlson . | |
| 2,297,691 | 10/1942 | Carlson . | |
| 2,618,552 | 11/1952 | Wise . | |
| 2,874,063 | 2/1959 | Greig . | |
| 3,666,363 | 5/1972 | Tanaka et al. . | |
| 4,071,361 | 1/1978 | Marushima . | |
| 4,863,825 | 9/1989 | Yoshimoto et al. | 430/109 |
| 4,883,736 | 11/1989 | Hoffend et al. | 430/110 |
| 5,080,995 | 1/1992 | Fox et al. | 430/137 |
| 5,143,809 | 9/1992 | Kaneko et al. | 430/105 |
| 5,169,738 | 12/1992 | Tanikawa et al. | 430/106.6 |
| 5,294,682 | 3/1994 | Fukuda et al. | 430/109 X |

FOREIGN PATENT DOCUMENTS

| | | | |
|---|---|---|---|
| 3132619 | 6/1982 | Germany . | |
| 42-23910 | 11/1967 | Japan . | |
| 43-24748 | 10/1968 | Japan . | |
| 56-87051 | 7/1981 | Japan . | |
| 58-11953 | 1/1982 | Japan . | |
| 2161 | 11/1985 | Japan | 430/109 |
| 254149 | 12/1985 | Japan | 430/109 |
| 62-78569 | 4/1987 | Japan . | |
| 62-127749 | 6/1987 | Japan . | |
| 62-127748 | 6/1987 | Japan . | |
| 2-129653 | 5/1990 | Japan . | |
| 2-173038 | 7/1990 | Japan . | |
| 3-4668 | 2/1991 | Japan . | |
| 41467 | 2/1991 | Japan | 430/109 |
| 122660 | 5/1991 | Japan | 430/109 |
| 267946 | 11/1991 | Japan | 430/109 |

OTHER PUBLICATIONS

Patent Abstracts, Japan, vol. 14, No. 27 (P–992) (3970) Jan. 19, 1990.

*Primary Examiner*—Roland Martin

*Attorney, Agent, or Firm*—Fitzpatrick, Cella, Harper & Scinto

[57] ABSTRACT

A toner for developing an electrostatic image has a binder resin and a colorant.

The binder resin contains a polyester resin at least part of which has a long-chain alkyl group having 22 to carbon atoms and has a hydroxyl group or a carboxyl group at its terminal.

167 Claims, No Drawings

TONER FOR DEVELOPING ELECTROSTATIC IMAGE, ONE COMPONENT-TYPE DEVELOPER AND TWO-COMPONENT TYPE DEVELOPER

This application is a continuation of application Ser. No. 08/176,229 filed Jan. 3, 1994, now abandoned.

BACKGROUND OF THE INVENTION

1. Field of the Invention

The present invention relates to a toner for developing an electrostatic image, used in image forming processes such as electrophotography, electrostatic recording and electrostatic printing. It also relates to a one-component type developer having the toner, and a two-component type developer having the toner and a carrier.

2. Related Background Art

A large number of methods have been hitherto known as electrophotography, as disclosed in U.S. Pat. No. 2,297,691, Japanese Patent Publication No. 42-23910 (U.S. Pat. No. 3,666,363) and Japanese Patent Publication No. 43-24748 (U.S. Pat. No. 4,071,361) and so forth. In general, copies are obtained by forming an electrostatic latent image on a photosensitive member by utilizing a photoconductive material and according to various means, subsequently developing the latent image by the use of a toner, and transferring the toner image to a transfer medium such as paper if necessary, followed by fixing by the action of heat or pressure.

Developing methods by which the electrostatic latent image is formed into a visible image are also known in variety. A large number of such developing methods are known, as exemplified by the magnetic brush development as disclosed in U.S. Pat. No. 2,874,063, the cascade development as disclosed in U.S. Pat. No. 2,618,552, the powder cloud development as disclosed in U.S. Pat. No. 2,221,776, the fur brush development and the liquid development.

Of these developing methods, the magnetic brush development, the cascade development and the liquid development, making use of a two-component developer mainly composed of a toner and a carrier, are widely put into practical use. There is also a method in which a developer container holding a toner and magnetic particles used for applying the toner, a toner carrying member from which the toner is transported to a latent image bearing member and a magnet that forms a magnetic brush by the aid of the magnetic particles used for applying the toner, coming into contact with the toner carrying member at an upstream side of a toner outlet of the developer container are provided so that a thin layer of the toner is formed on the toner carrying member, where a gap between the toner carrying member and the latent image bearing member are set larger than the thickness of the toner layer and the electrostatic latent image is developed at a developing zone defined by the gap.

These methods require keeping the toner in a state such that it is uniformly mixed with the carried at the developing zone or in a state where it is uniformly thinly applied to the the toner carrying member. As a force to achieve such a state, it is predominantly an electrostatic attraction force and a physical adhesion force. That is, it becomes necessary to precisely control electrostatic charges and triboelectric chargeability possessed by the toner.

However, it is difficult to uniformly control the electrostatic charges possessed by the toner and also make the electrostatic charges stable after repeated copying over a long period time or in a special environment of high temperature and high humidity or low temperature and low humidity.

Various proposals are made for a developing method making use of a one-component developer comprised of only the toner, which can avoid the problems involved in the developing method making use of the two-component developer. In particular, there are many advantages in methods employing a developer comprising toner particles having magnetic properties.

As toners used in these developing methods, fine powders comprising a dye or pigment dispersed in a natural or synthetic resin were previously used. It is also known to use a developing fine powder to which a third material has been added for various purposes.

The toner image having been developed is fixed to a transfer medium such as paper if necessary. In relation to this step of fixing the toner image to a transfer medium, various methods or techniques have been advanced. A method most commonly available at present is the pressure heating system making use of a heating roller. The pressure heating system making use of a heating roller is a method of carrying out fixing by causing a transfer medium to pass over a heating roller whose surface is formed of a material with a releasability to toner while a toner image surface of the former is brought into contact with the surface of the latter under application of a pressure. Since in this method the surface of the heating roller comes into contact with the toner image of the transfer medium under application of a pressure, a very good thermal efficiency can be achieved when the toner image is melt-adhered onto the transfer medium, so that fixing can be carried out rapidly. In this method, however, since the surface of the heating roller comes into contact with the toner image under application of a pressure in the latter's molten state, part of the toner image may adhere and transfer to the surface of the fixing roller, which may re-transfer to the subsequent transfer medium to cause an offset phenomenon, resulting in a contamination of the transfer medium. Thus, it is sought to make an advancement in resins for toners having much higher low-temperature fixing performance and high-temperature anti-offset properties.

Moreover, since copying machines hereafter are to be made higher in speed, toners must now provide more highly enhanced fixing performance to paper, a high resolution and high-speed development and a high running performance.

Under such circumstances, a developer comprised of a toner using a cross-linked polyester as a binder resin and a resin-coated carrier is proposed in Japanese Patent Applications Laid-open No. 62-127748 and No. 62-127749. This developer, however, has a problem that, in its evaluation made on image reproduction in an environment of low humidity, the charge performance of the toner becomes unstable when the developer is mechanically agitated in a developer assembly.

Japanese Patent Application Laid-open No. 58-11953 discloses a toner for developing electrostatic latent images that is characterized by a binder resin comprising a polyester resin containing not less than 5% by weight of chloroform-insoluble component and containing an anti-offset agent comprised of a non-polar substance and a polar substance.

Japanese Patent Application Laid-open No. 62-78569 discloses a toner making use of a polyester having on its side chain a saturated or unsaturated aliphatic hydrocarbon group having 3 to 22 carbon atoms.

In these toners, however, because of a poor compatibility of the polyester resin with a polyolefin wax, poor dispersion of the polyolefin wax tends to occur when the toners are prepared, often resulting in generation of free polyolefins during pulverization. Taking into account the future progress toward high-speed copying machines, this raises the problem that occurrence of faulty cleaning or deterioration of anti-offset properties may result. With regard to fixing performance in an environment of low temperature and developing performance in an environment of low humidity, it is hard to say that they are satisfactory in high-speed copying machines.

Japanese Patent Applications Laid-open No. 2-129653 and No. 3-46668 disclose toners using as a binder resin a polyester obtained by treating a polyester resin with an acid or an alcohol.

These toners are certainly effective for improving fixing performance or making triboelectric charges stable. However, because of the use of a monoalcohol having a carbon atom number as small as 10, poor dispersion of polyolefin wax tends to occur, so that, taking into account the future progress toward high-speed copying machines, the occurrence of faulty cleaning or deterioration of anti-offset properties may come into question. Also with regard to the fixing performance in an environment of low temperature and the developing performance in an environment of low humidity, it is hard to say that they are satisfactory.

In the prior art discussed above, the fixing and the anti-offset properties can be balanced with difficulty because of the poor compatibility of a polyester with a polyolefin wax, so that, when a developer carrying member has a high process speed as in the case of high-speed copying machines, the charges on the toner can be controlled only with difficulty. Thus, in future progress toward high-speed copying machines, none of them have still reached a satisfactory level for improved fixing performance, anti-offset properties and developing performance.

In addition, in recent years, it is sought to make copied images have higher image quality by making copying machines digital and making toner particles finer. However, even if the resolution or sharpness of images can be increased by making toner particles finer, various problems may occur. In the first place, making toner particles finer results in a poor fixing performance at halftone areas. The reason therefor is that it is hard for a fixing pressure to be applied to the toner transferred to concavities on the surface of a transfer medium and the amount of heat imparted thereto is smaller, and also that the toner transferred to convexities on the surface of the transfer medium has a smaller toner layer thickness and hence a shear force applied thereto per each toner particle is larger which tends to cause an offset phenomenon.

Moreover, such a toner which has fine particles with a small particle diameter, when used in high-speed copying machines, may acquire excessive charges especially in an environment of low humidity and often causes fog or a decrease in density.

In multi-functional copying machines having functions such that multiple multicolor copies are taken by, e.g., previously erasing part of an image by exposure or the like and then inserting another image to that part or where the margin of a copy sheet is framed out, the part to be left white on the image may be fogged.

In other words, there may occur a problem that when a potential with a polarity reverse to that of a latent image is applied to the development standard potential by the use of strong light such as light of an LED or a fuse lamp to erase the image, the part thus erased strongly tends to be fogged.

In addition, even if the resolution or sharpness of images can be improved by making copying machines digital or making toner particles smaller in diameter, various problems may arise.

In the first place, there is the problem of fogging as stated above. As toner particles are made smaller in diameter, the surface areas of the toner increases, therefore resulting in a large breadth of charge distribution which tends to cause fogging. The increase in the surface area of the toner may also make charging performance of the toner more likely to be affected by environment. When toner particles have a smaller diameter, it is clear that the state of dispersion of a magnetic material or colorant or a release agent has a great influence on the charging performance of the toner.

As for digital copying machines recently available, in a photographic image with letters or characters, it is required for the letters or characters of its copied image to be sharp and for the photographic image to be reproduced in a density gradation faithful to the original. In general, in the copying of an image with letters or characters, not only the density gradation of the photographic image may be impaired as the density of letter or character lines is made higher in order to obtain sharp letters or characters, but also a very coarse image may result at its halftone portion. Moreover, since the toner is applied in a larger quantity as the density of letter or character lines is made higher, what are called blank areas caused by poor transfer may instead occur, which is a phenomenon in which the toner on a line or lines has come off, resulting in a copied image with a low image quality. On the other hand, an attempt to improve the density gradation of the photographic image may cause a decrease in the density of letter or character lines, resulting in poor sharpness.

In recent years, the density gradation has been improved to a certain extent by reading image density and converting it into digital signals. Under the existing conditions, however, its improvement can not be said to be satisfactory.

SUMMARY OF THE INVENTION

The present invention intends to provide a toner for developing an electrostatic image, a one-component type developer having the toner and a two-component type developer having the toner and a carrier, that have solved the problems discussed above.

An object of the present invention is to provide a toner for developing an electrostatic image, a one-component type developer having the toner and a two-component type developer having the toner and a carrier, that have superior low-temperature fixing performance and high-temperature anti-offset properties.

Another object of the present invention is to provide a toner for developing an electrostatic image, a one-component type developer having the toner and a two-component type developer having the toner and a carrier, that can provide copied images with a high image quality, without causing any damage of fixing performance and without causing any fogging.

Still another object of the present invention is to provide a toner for developing an electrostatic image, a one-component type developer having the toner and a two-component type developer having the toner and a carrier, that can provide good images even in an environment of low humidity and an environment of high humidity, without being affected by any environmental variations.

A further object of the present invention is to provide a toner for developing an electrostatic image, a one-component type developer having the toner and a two-component type developer having the toner and a carrier, that can stably provide good images even in high-speed copying machines and can be applied in a wide range of machine types.

A still further object of the present invention is to provide a toner for developing an electrostatic image, a one-component type developer having the toner and a two-component type developer having the toner and a carrier, that can promise a superior running performance and can provide copied images with a high image density and free from white-ground fog even in their continuous use over a long period of time.

A still further object of the present invention is to provide a toner for developing an electrostatic image, a one-component type developer having the toner and a two-component type developer having the toner and a carrier, that can attain, in a photographic image with letters or characters, a sharpness in the letters or characters of its copied image and a photographic image reproduced in a density gradation faithful to the original.

A still further object of the present invention is to provide a toner for developing an electrostatic image, a one-component type developer having the toner and a two-component type developer having the toner and a carrier, that can achieve a high density of letter or character lines and do not tend to cause blank areas caused by poor transfer.

A still further object of the present invention is to provide a toner for developing an electrostatic image, a one-component type developer having the toner and a two-component type developer having the toner and a carrier, that may cause no melt-adhesion of toner to photosensitive members and no faulty cleaning.

A still further object of the present invention is to provide a toner for developing an electrostatic image, a one-component type developer having the toner and a two-component type developer having the toner and a carrier, that can achieve stable triboelectric charges between toner particles and between the toner and a toner carrying member such as a sleeve, and can control the charges to those suited for a developing system to be used.

A still further object of the present invention is to provide a toner for developing an electrostatic image, a one-component type developer having the toner and a two-component type developer having the toner and a carrier, that enable faithful development even in the case of digital latent images, can enlarge density difference between dots and can sharply reproduce the edges of the dots.

A still further object of the present invention is to provide a toner for developing an electrostatic image, a one-component type developer having the toner and a two-component type developer having the toner and a carrier, that may cause less fog or reversal fog even in an image forming process comprising post-charging.

A still further object of the present invention is to provide a toner for developing an electrostatic image, a one-component type developer having the toner and a two-component type developer having the toner and a carrier, that have superior storage stability high enough to maintain the initial performances even after storage over a long period of time.

A still further object of the present invention is to provide a toner for developing an electrostatic image, a one-component type developer having the toner and a two-component type developer having the toner and a carrier, that can prevent the toner from undergoing charge-up which is a difficulty occurring when toner particles have a smaller diameter, and can impart a good image density.

To achieve the above objects, the present invention provides a toner for developing an electrostatic image, comprising a binder resin and a colorant, wherein said binder resin contains a polyester resin at least part of which has been modified with a compound which has a long-chain alkyl group having 22 to 102 carbon atoms and has a hydroxyl group or a carboxyl group at its terminal.

The present invention also provides a one-component developer comprising a toner, wherein said toner comprises a binder resin and a colorant, and the binder resin contains a polyester resin at least part of which has been modified with a compound which has a long-chain alkyl group having 22 to 102 carbon atoms and has a hydroxyl group or a carboxyl group at its terminal.

The present invention still also provides a two-component developer comprising a toner and a carrier, wherein said toner comprises a binder resin and a colorant, and the binder resin contains a polyester resin at least part of which has been modified with a compound which has a long-chain alkyl group having 22 to 102 carbon atoms and has a hydroxyl group or a carboxyl group at its terminal.

DESCRIPTION OF THE PREFERRED EMBODIMENTS

In the present invention, the toner comprises a binder resin containing a polyester resin at least part of which has been modified with a compound which has a long-chain alkyl group having 22 to 102 carbon atoms and has a hydroxyl group or a carboxyl group at its terminal (hereinafter "modifying compound"). This modification refers to a state in which the long-chain alkyl group having 22 to 102 carbon atoms of the modifying compound has been introduced into the structure of the polyester resin by ester bonding or urethane bonding between a carboxyl group and/or hydroxyl group in the main chain of the polyester resin or a carboxyl group and/or hydroxyl group at a terminal of the main chain and a hydroxyl group or carboxyl group the modifying compound has at its terminal thereof.

U.S. Pat. Nos. 4,883,736 and 5,080,995 disclose methods in which an alcohol polymer wax is used in its mixture with a developer. In these methods, use of the alcohol polymer wax in a large quantity makes it possible to lower the fixing temperature, but may result in a poor storage stability, a poor developing performance, a poor fluidity and so forth.

In the present invention, the compound capable of modifying the polyester resin may include an alkyl alcohol represented by the following formula (1):

$$CH_3(CH_2)_xCH_2OH \quad (1)$$

wherein x represents a number of from 20 to 100.

The alkyl alcohol represented by formula (1) has a melting point of as low as 80° to 120° C., and also is effective for lowering the fixing temperature since the alkyl alcohol represented by formula (1) branches through unreacted carboxyl groups or hydroxyl groups or attaches to a terminal of the polyester main chain.

It also brings about an improvement in compatibility of the binder resin with a polyolefin wax, and makes it hard to cause poor dispersion of the polyolefin wax in the binder resin. It also brings about an improvement in anti-offset properties since a satisfactory releasability to fixing rollers can be obtained even without use of the polyolefin wax so long as it has a long-chain alkyl group.

Conventional polyester resins tend to cause charge excess especially in an environment of low humidity when toner particles have a smaller diameter. In the present invention, however, the modification of the polyester resin with the alkyl alcohol represented by formula (1) makes it possible to control its properties that tend to cause charge excess, so that a stable charging performance can be obtained.

In the above formula (1), x represents a number of from 20 to 100, and may preferably be a number of from 23 to 100, and more preferably from 25 to 70. If x is smaller than 20, the compound is less effective for lowering the fixing temperature because of its chain shortness when made up into a toner. Thus, its use in a large quantity in order to make the lowering of fixing temperature effective may result in a poor storage stability and also may result in a small capability of imparting a lubricity to photosensitive members, tending to cause the problems of the phenomenon of blank areas caused by poor transfer, the melt-adhesion to photosensitive members and the faulty cleaning. If x is larger than 100, the compound has a high melting point to become similarly less effective for lowering the fixing temperature.

Japanese Patent Application Laid-open No. 3-466681 discloses a method in which a polyester resin is masked with a $C_1$ to $C_{10}$ monoalcohol. This method can certainly bring about improvements in environmental stability and fixing performance, but can not be satisfactory on the above problems of the phenomenon of blank areas caused by poor transfer, the melt-adhesion to photosensitive members and the faulty cleaning.

The alcohol used in the present invention can be prepared by, for example, the methods disclosed in U.S. Pat. Nos. 2,892,858, 2,781,419, 2,787,626, 2,835,689, and British Patent No. 808,055.

The alkyl alcohol represented by formula (1) may preferably have a molecular weight distribution (weight average molecular weight: Mw)/(number average molecular weight: Mn) in a value of from 1.0 to 4.0, and more preferably from 1.0 to 3.0, in its molecular weight as measured by GPC. If it has a molecular weight distribution larger than 4.0, the above problems of the phenomenon of blank areas caused by poor transfer, the melt-adhesion to photosensitive members and the faulty cleaning tend to occur and also the charging performance and fluidity may become low.

The compound used to modify the polyester resin used in the present invention may also include alkyl alcohols having 25 or more carbon atoms, in the case when the polyester resin is a non-linear polyester resin described later.

In the present invention, an embodiment in which part of carboxyl groups or hydroxyl groups of the non-linear polyester resin has been modified with the long-chain alkyl alcohol having 25 or more carbon atoms so that long-chain alkyl groups can be imparted to the binder resin brings about the following advantages (1) to (3).

(1) The melt viscosity of the binder resin can be readily controlled and the fixing performance to paper can be improved.

(2) The compatibility of the binder resin with the polyolefin wax can be improved, the dispersibility of the polyolefin wax in the binder resin can be improved, the anti-offset properties can be satisfactory even when the toner is applied in high-speed copying machines, and also no faulty cleaning may occur during the running. Moreover, when long-chain alkyl groups having 30 or more carbon atoms are imparted to the binder resin, a sufficient releasability to fixing rollers can be obtained without use of the polyolefin wax, and the anti-offset properties can be improved.

(3) An acid value having an influence on the charging performance of the toner can be controlled, and hence no excessive increase in charges may occur even in an environment of low humidity, so that a more stable charging performance can be obtained and a good developing performance can be achieved.

The compound capable of modifying the polyester resin used in the present invention may also include a substance obtained by reacting an alkyl alcohol represented by the following formula (2):

$$CH_3(CH_2)_nOH \qquad (2)$$

wherein n represents a number of from 21 to 101;

with a compound having one epoxy group in its molecule, represented by the following formula (3):

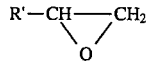

$$R'-\underset{\diagdown\ \diagup}{\underset{O}{CH}}-CH_2 \qquad (3)$$

wherein R' represents a hydrogen atom, a hydrocarbon group having 1 to 20 carbon atoms or a group represented by $R_1$—$CH_2$—, wherein $R_1$ represents an ether group or an ester group;

(hereinafter "substance α").

The substance α obtained by reacting the alkyl alcohol represented by formula (2) with the compound represented by formula (3) has a structure represented by formula (4) shown below.

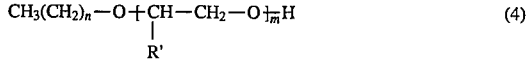

$$CH_3(CH_2)_n-O+\underset{R'}{\underset{|}{CH}}-CH_2-O\underset{m}{]}H \qquad (4)$$

wherein n represents a number of from 21 to 101, m represents a number of from 1 to 10, R' represents a hydrogen atom, a hydrocarbon group having 1 to 20 carbon atoms or a group represented by $R_1$—$CH_2$—, wherein $R_1$ represents an ether group or an ester group.

In the present invention, with regard to the substance α obtained by reacting the alkyl alcohol of formula (2) with the compound of formula (3), having one epoxy group in its molecule, its viscosity and plasticity can be controlled in accordance with the alkyl chain length of the alkyl alcohol of formula (2) and the quantity in which the compound of formula (3), having one epoxy group in its molecule, is reacted.

In the above formula (2), if the number of n is less than 21, the viscosity control tends to become insufficient even when the alkyl alcohol is reacted with the compound represented by formula (3).

In the present invention, an embodiment in which, for example, part of carboxyl groups of the polyester resin in its main chain or at its terminal has been modified with the substance α so that substance α can be imparted to the binder resin brings about the following advantages (4) to (6).

(4) The melt viscosity of the binder resin can be readily controlled and the fixing performance to paper can be improved.

(5) The compatibility of the binder resin with the polyolefin wax can be improved, and any poor dispersion of the polyolefin wax in the binder resin occurs only with difficulty. Moreover, so long as the long-chain alkyl group is present, a sufficient releasability to fixing rollers can be obtained without use of the polyolefin wax, so that the anti-offset properties can be improved.

(6) An acid value having an influence on the charging performance of the toner can be controlled, and hence any charge-up of the toner can be prevented in an environment of low humidity, so that a stable charging performance can be obtained.

In particular, the substance α is preferred in view of the fact that it has a higher reactivity to the polyester resin than in the case of the sole use of the alkyl alcohol represented by formula (1) and hence can surely react on the polyester resin.

In the present invention, there are no particular limitations on the manner by which the alkyl alcohol of formula (2) is reacted with the compound of formula (3). It can be exemplified by a method in which the reaction is carried out under pressure at a temperature of from 50° to 300° C. in the presence of a basic catalyst such as sodium hydroxide, sodium ethoxide, potassium t-butoxide, metallic sodium or metallic potassium.

There are no particular limitations on the alkyl alcohol of formula (2) so long as it is an alkyl alcohol with the number of n of from 21 to 101. It may preferably be those in which n is a number of from 23 to 101, and more preferably from 26 to 71.

As the compound of formula (3), those described below can be used.

An example of the compound of formula (3) in which R' is hydrogen is shown below.

Ethylene oxide:

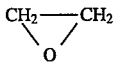

Examples of the compound of formula (3) in which R' is a hydrocarbon group having 1 to 20 carbon atoms are shown below.

Propylene oxide:

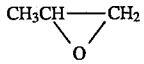

Styrene oxide:

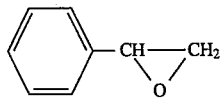

Examples of the compound of formula (3) in which R' is a group represented by $R_1$—$CH_2$—, wherein $R_1$ represents an ether group or an ester group, are shown below.

Allylglycidyl ether:

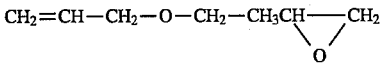

Phenylglycidyl ether:

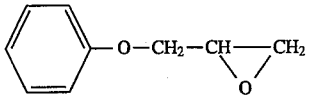

n-Butylglycidyl ether:

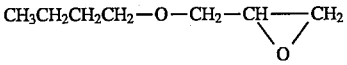

glycidyl ether as mentioned below:

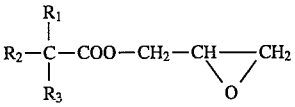

wherein $R_1$, $R_2$ and $R_3$ each represent a hydrogen atom or a hydrocarbon group.

In the present invention, the compound capable of modifying the polyester resin may still also include an alkylmonocarboxylic acid represented by the following formula (5):

$$CH_3(CH_2)_yCH_2COOH \quad (5)$$

wherein y represents a number of from 20 to 100.

The alkylmonocarboxylic acid represented by formula (5) has a melting point of as low as 70° to 140° C., and also is effective for lowering the fixing temperature since the alkylmonocarboxylic acid represented by formula (5) branches through unreacted carboxyl groups or hydroxyl groups or attaches to a hydroxyl group at a terminal of the polyester main chain.

The alkylmonocarboxylic acid represented by formula (5) also has a superior releasability and hence can bring about good high-temperature anti-offset properties.

The alkylmonocarboxylic acid represented by formula (5) reacts with part of unreacted hydroxyl groups at the terminal or in the main chain of the polyester resin, and hence it can also bring about a good environmental stability.

Japanese Patent Application Laid-open No. 56-85051 discloses a method in which polymerization reaction is carried out in the presence of a higher fatty acid or a higher alcohol. This method only provides a state in which the fatty acid or alcohol is merely dispersed in a binder resin. If the fatty acid or alcohol is used in a large amount, the fixing performance may be improved but the storage stability and the environmental stability become poor.

In the above formula (5), y represents a number of from 20 to 100, and may preferably be a number of from 23 to 100, more preferably from 25 to 85, and still more preferably from 30 to 70. If y is smaller than 20, the compound is less effective for lowering the fixing temperature because of its chain shortness when made up into a toner. Thus, its use in a large quantity in order to make the lowering of fixing temperature effective may result in a poor storage stability and also may result in a small capability of imparting a lubricity to photosensitive members, tending to cause the problems of the phenomenon of blank areas caused by poor transfer, the melt-adhesion to photosensitive members and the faulty cleaning. If y is larger than 100, the compound has a high melting point to become similarly less effective for lowering the fixing temperature.

Japanese Patent Application Laid-open No. 2-173038 and No. 3-46668 disclose a method in which a polyester resin is reacted with a monocarboxylic acid. However, the monocarboxylic acid used therein is one in which y is smaller than 20, and hence the method can not be satisfactory on the above problems of the phenomenon of blank areas caused by poor transfer, the melt-adhesion to photosensitive members and the faulty cleaning.

The alkylmonocarboxylic acid represented by formula (5) may preferably have a molecular weight distribution (weight average molecular weight: Mw)/(number average molecular weight: Mn) in a value of from 1.0 to 5.0, and more preferably from 1.0 to 3.0, in its molecular weight as measured by GPC. If it has a molecular weight distribution larger than 5.0, the above problems of the phenomenon of blank areas caused by poor transfer, the melt-adhesion to photosensitive members and the faulty cleaning tend to occur and also the charging performance and fluidity may become low.

The polyester resin used in the present invention has the composition as shown below.

The polyester resin used in the present invention is composed of 45 to 55 mol % of an alcohol component and 55 to 45 mol % of an acid component in the whole component.

As the alcohol component, it may include diols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following formula (I).

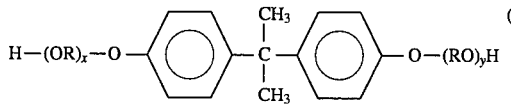

(I)

wherein R represents an ethylene group or a propylene group, x and y are each an integer of 1 or more, and an average value of x+y is 2 to 10; and a diol represented by the following formula (II).

Formula (B)

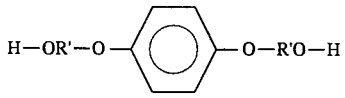

(II)

wherein R' represents $-CH_2CH_2-$,

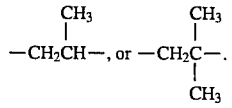

As a dibasic carboxylic acid comprising 50 mol % or more in the whole acid component, it may include benzene dicarboxylic acids or anhydrides thereof such as phthalic acid, terephthalic acid, isophthalic acid, phthalic anhydride, diphenyl-p.p'-dicarboxylic acid, naphthalene-2,7-dicarboxylic acid, naphthalene-2,6-dicarboxylic acid, diphenylmethane-p.p'-dicarboxylic acid, benzophenone-4,4'-dicarboxylic acid and 1,2-diphenoxyethane-p.p'-dicarboxylic acid; alkyldicarboxylic acids such as succinic acid, adipic acid, sebacic acid, azelaic acid, glutaric acid, cyclohexanedicarboxylic acid, triethylenedicarboxylic acid and malonic acid, or anhydrides thereof; succinic acids substituted with an alkyl group having 6 to 18 carbon atoms, or anhydrides thereof; unsaturated dicarboxylic acids such as fumaric acid, maleic acid, citraconic acid and iraconic acid, or anhydrides thereof.

The alcohol component of the polyester resin that is particularly preferred in the working of the present invention includes the bisphenol derivative represented by formula (I), and the acid component includes dicarboxylic acids such as phthalic acid, terephthalic acid and isophthalic acid, or anhydrides thereof; succinic acid and n-dodecenylsuccinic acid, or anhydrides thereof; and fumaric acid, maleic acid and maleic anhydride.

The polyester resin obtained here may have a glass transition point of preferably from 40° to 90° C., and more preferably from 45° to 85° C., a number average molecular weight (Mn) of preferably form 1,500 to 50,000, and more preferably from 2,000 to 20,000, and a weight average molecular weight of preferably from 3,000 to 100,000, and more preferably from 4,000 to 90,000.

In the present invention, a non-linear polyester resin may also be used in the polyester resin.

In the present invention, the non-linear polyester refers to a polyester having what is called the cross-linked structure or branched structure.

The non-linear polyester can be obtained by synthesis using a tribasic or higher polycarboxylic acid or trihydric or higher polyol together with the above dibasic polycarboxylic acid and dihydric polyol.

The tribasic or higher polycarboxylic acid may include, for example, trimetlitic acid, pyromellitic acid, cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methylenecarboxypropane, 1,3-dicarboxyl-2-methyl-2-methylenecarboxypropane, tetra(methylenecarboxyl) methane, 1,2,7,8-octanetetracarboxylic acid, and anhydrides of these.

The trihydric or higher polyol may include, for example, sorbitol, 1,2,3,6-hexanetetrol, 1,4-sorbitan, pentaerythritol, dipentaerythritol, tripentaerythritol, sucrose, 1,2,4-methanetriol, glycerol, 2-methylpropanetriol, 2-methyl-1,2,4-butanetriol, trimethylolethane, trimethylolpropane and 1,3,5-trihydroxymethylbenzene.

The non-linear polyester resin may have a glass transition point of preferably from 40° to 90° C., and more preferably from 45° to 85° C., a number average molecular weight (Mn) of preferably form 1,500 to 100,000, and more preferably from 2,000 to 40,000, and a weight average molecular weight of preferably from 3,000 to 200,000, and more preferably from 4,000 to 180,000.

In the case when only carboxyl groups of the polyester resin are modified with the alkyl alcohol represented by formula (1) or the substance α represented by formula (4), the polyester resin may have an acid value of preferably not less than 2 to not more than 100, and more preferably not less than 5 to not more than 80, and an OH value of preferably not more than 50, and more preferably not more than 30.

The reasons therefor are that, if the acid value is less than 2, the degree of modification may be so low that the modification intended in the present invention can be less or hardly effective and, if the acid value is larger than 100 or the OH value is larger than 50, the charging performance may have a great environmental dependence when made up into a toner.

For the same reasons as the foregoing, in the case when both carboxyl groups and hydroxyl groups of the polyester resin are modified with the alkyl alcohol represented by formula (1) or the substance α represented by formula (4), both the acid value and the OH value may preferably be not less than 2 to not more than 100, and more preferably not less than 5 to not more than 80.

Also for the same reasons as the foregoing, in the case when only hydroxyl groups of the polyester resin are modified with the alkyl alcohol represented by formula (1), the substance α represented by formula (4) or the alkylmonocarboxylic acid represented by formula (5), the polyester resin may have an OH value of preferably not less than 2 to not more than 100, and more preferably not less than 5 to not more than 80, and an acid value of preferably not more than 50, and more preferably not more than 30.

In the present invention, the polyester resin can be modified with the compound having a long-chain alkyl group having 22 to 102 carbon atoms and having a hydroxyl group or a carboxyl group at its terminal (the modifying compound) such as the alkyl alcohol represented by formula (1), the substance α represented by formula (4) or the alkylmonocarboxylic acid represented by formula (5), by a method including the following methods.

(i) A method in which, at the time of the synthesis of the polyester resin, the above modifying compound is charged together with the polybasic acid and the polyhydric alcohol to carry out reaction in the presence of a catalyst such as calcium phosphate, ferric chloride, zinc chloride, an organic metal salt of tin or titanium or tin oxide at a temperature of from 160° to 270° C., under reduced pressure, or under azeotropic distillation with use of a solvent, while removing the water produced. Thus, a modified polyester resin is obtained.

(ii) As a method for reacting unreacted carboxyl groups and/or unreacted hydroxyl groups with the above modifying compound after the polyester resin has been synthesized, a method in which the polyester resin is reacted with the above modifying compound to carry out modification in the presence of the same catalyst as in the foregoing at a temperature of from 160° to 270° C., under reduced pressure, or under azeotropic distillation with use of a solvent, while removing the water produced.

(iii) As a method for reacting unreacted hydroxyl groups in the polyester resin, a method in which the polyester resin is reacted with the above modifying compound to carry out modification at 60° to 200° C. using a solvent and a diisocyanate.

As the method for modifying the polyester resin with the modifying compound, methods in which unreacted carboxyl groups or unreacted hydroxyl groups in the polyester resin are reacted with it are exemplified in the foregoing. Of these methods, it is most preferable to use the method in which the modification is carried out at the same time when the polyester resin is synthesized. This is because the modification carried out at the same time when the polyester resin is synthesized makes it possible to rapidly carry out modification reaction, makes it easy to control molecular weight and makes it possible to enhance the degree of modification. As another reason, the modified polyester resin obtained by this method can have a matrix-domain structure wherein the polyester moiety forms a matrix (or a domain) and the alkyl chain moiety of the modifying compound forms a domain (or a matrix) and the domain can be very small and uniformly dispersed. In the method making use of a diisocyanate, alcohols may react with each other, and hence the modification may preferably be carried out by the former method.

In the present invention, the amount of modification of the polyester resin with the modifying compound described above may preferably be in the range of from 0.1 to 100% by weight, more preferably from 5 to 50% by weight, and still more preferably from 10 to 30% by weight, based on the weight of the modified polyester resin.

In the present invention, the amount of modification of the polyester resin can be determined in the following way: The modified polyester resin is dissolved in tetrahydrofuran or chloroform. Thereafter, insoluble matter is removed by filtration, and soluble matter is dried. The resin obtained at this state is designated as resin A.

This resin A is subjected to DSC (e.g, using DSC-7, manufactured by Perking Elmer Co.) to measure endothermic peaks of the modifying component such as the modifying alkyl alcohol. The measurement is made according to ASTM D3418-82. The DSC curve used in the present invention is measured by raising temperature once to take a temperature history and thereafter droping and raising the temperature at a rate of 10° C./min within a temperature range of 0° to 200° C. The height of the endothermic peak of the modifying component is divided by the weight of the sample measured, to determine a value ΔH (J/g).

Next, the unmodified polyester resin and the modifying component are each weighed, and then uniformly mixed while kept unreacted. Five or more samples with different mixing ratios are made ready, and their ΔH (J/g) are determined to prepare a calibration curve that represents the relationship between the ΔH and the modifying component. From this calibration curve, the amount of modification with the modifying component in the modified polyester resin is determined. The amount of modification with the modifying component in the toner can be similarly measured by this method.

If the modification of the polyester resin with the modifying compound is in an amount smaller than the above range, what is intended by the modification can be less effective, tending to cause stained images or a lowering of anti-offset properties and fixing performance caused by, e.g., contamination of a cleaning web. If it is in an amount more than the above range, a lowering of charging performance ascribable to the alcohol moiety or a lowering of environmental stability ascribable to the acid moiety tends to occur.

In the present invention, at the time of the modification of the polyester resin with the above modifying compound by any of the methods (i) to (iii), the entire modifying compound mixed can not participate in the modification of the polyester resin. Hence, in order to modify the polyester resin in the amount of modification described above, the polyester resin may preferably be modified by mixing the modifying compound in the amount shown below.

In the case of method (i), where the modifying compound is charged together with the polybasic acid and the polyhydric alcohol to simultaneously carry out the modification at the time of the synthesis of the polyester resin, the modifying compound may preferably be used in an amount of from 0.1 to 150 parts by weight, more preferably from 5 to 100 parts by weight, and still more preferably from 10 to 60 parts by weight, based on 100 parts by weight of the total weight of the polybasic acid and the polyhydric alcohol.

In the case of method (ii) or (iii), where unreacted carboxyl groups or unreacted hydroxyl groups are reacted with the modifying compound after the polyester resin has been synthesized, the modifying compound may preferably be used in an amount of from 0.1 to 150 parts by weight, more preferably from 5 to 100 parts by weight, and still more preferably from 10 to 60 parts by weight, based on 100 parts by weight of the polyester resin.

In the present invention, at least part of the polyester resin has been modified with the modifying compound, and hence only an alcohol-modified polyester may be used or a blend thereof with a polyester resin having different composition may be used as the binder resin. Here, in the case when it is used as a blend, the modifying compound may preferably be contained in the binder resin in an amount of from 0.1 to 100% by weight, more preferably from 1 to 50% by weight, still more preferably from 5 to 30% by weight, and much more preferably from 10 to 30, based on the weight of the binder resin.

In the present invention, the modified polyester resin may preferably have a Tg of from 25° to 75° C., and more preferably from 30° to 70° C.

In the case of the linear polyester resin, the modified polyester resin may have a number average molecular weight (Mn) of preferably from 2,000 to 51,000, and more preferably from 2,500 to 25,000, and a weight average molecular weight (Mw) of preferably from 3,500 to 105,000, and more preferably from 4,000 to 90,000; and, in the case of the non-linear polyester resin, a number average molecular weight (Mn) of preferably form 2,000 to 102,000, and more preferably from 2,500 to 50,000, and a weight average molecular weight (Mw) of preferably from 3,500 to 210,000, and more preferably from 4,000 to 180,000.

The modified polyester resin may also have an acid value of preferably from 1 to 60, and more preferably from 5 to 45, and an OH value of preferably from 1 to 60, and more preferably from 11 to 40, since what is intended in the present invention can be more effective.

The toner of the present invention may preferably have a weight average particle diameter (D4) of from 3 to 20 μm, and more preferably from 4 to 10 μm, in view of the advantage that images with a high resolution can be obtained.

In the toner for developing an electrostatic latent image according to the present invention, a positive or negative charge control agent may be optionally used in order to make its charging performance more stable. The charge control agent may preferably be used in an amount of from 0.1 to 10 parts by weight, and more preferably from 0.1 to 5 parts by weight, based on 100 parts by weight of the binder resin.

Charge control agents nowadays known in the present technical field may include the following.

As those capable of controlling the toner to be negatively chargeable, for example, organic metal complexes or chelate compounds are effective, which can be exemplified by monoazo metal complexes, acetylacetone metal complexes, and metal complexes of an aromatic hydroxycarboxylic acid type or aromatic dicarboxylic acid type. Besides, they can also be exemplified by aromatic mono- or polycarboxylic acids and metal salts, anhydrides or esters thereof, and phenol derivatives such as bisphenol.

An agent capable of controlling the toner to be positively chargeable may include, for example, Nigrosine and products modified with a fatty acid metal salt; quaternary ammonium salts such as tributylbenzylammonium 1-hydroxy-4-naphthosulfonate and tetrabutylammonium tetrafluoroborate, and analogs of these, including onium salts such as phosphonium salts and lake pigments of these; triphenyl methane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate; any of which may be used alone or in combination of two or more kinds. Of these, charge control agents such as Nigrosine types and quaternary ammonium salts may particularly preferably be used.

The toner for developing an electrostatic latent image according to the present invention may be either a magnetic toner or a non-magnetic toner. When it is used as the magnetic toner, any of magnetic materials shown below may preferably be used on account of charging performance, fluidity, uniform copy density and so forth.

In the case when the toner of the present invention is used as the magnetic toner, a magnetic material used as the colorant may include iron oxides such as magnetite, maghemite and ferrite, as well as iron oxides containing other metal oxide; metals such as Fe, Co and Ni, or alloys of any of these metals with a metal such as Al, Co, Cu, Pb, Mg, Ni, Sn, Zn, Sb, Be, Bi, Cd, Ca, Mn, Se, Ti, W or V, and mixtures of these.

The magnetic material is conventionally known to include triiron tetraoxide ($Fe_3O_4$), triiron sesquioxide ($\gamma$—$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), zinc iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). According to the present invention, any of the above magnetic materials may be selected and used alone or in combination of two or more kinds. A magnetic material particularly preferable for the objects of the present invention is triiron tetraoxide or $\gamma$-triiron sesquioxide powder.

These ferromagnetic materials may be those having an average particle diameter of preferably from 0.1 to 2 μm, and more preferably from 0.1 to 0.5 μm, and those having a coercive force (Hc) of preferably from 20 to 200 oersted, and more preferably from 20 to 150 oersted, a saturation magnetization ($\sigma s$) of preferably from 50 to 200 emu/g, and more preferably from 50 to 100 emu/g, and a residual magnetization ($\sigma r$) of preferably from 2 to 25 emu/g, and more preferably from 2 to 20 emu/g, as magnetic characteristics under application of 10K oersted.

Any of these materials should be used in an amount of from 10 to 200 parts by weight, and preferably from 20 to 150 parts by weight, based on 100 parts by weight of the binder resin.

In the case when the toner of the present invention is used as the non-magnetic material, a suitable pigment or dye can be used as the colorant.

For example, the pigment may include carbon black, aniline black, acetylene black, Naphthol Yellow, Hansa Yellow, Rhodamine Lake, Alizarine Lake, red iron oxide, Phthalocyanine Blue and Indanthrene Blue. Any of these may preferably be used in an amount of from 0.1 to 20 parts by weight, and more preferably from 1 to 10 parts by weight, based on 100 parts by weight of the resin. For the same purpose, a dye may also be used. For example, it may include azo dyes, anthraquinone dyes, xanthene dyes and methine dyes, and may preferably be used in an amount of from 0.1 to 20 parts by weight, and more preferably from 0.3 to 10 parts by weight, based on 100 parts by weight of the resin.

In the present invention, one kind of or two or more kinds of release agent may be optionally incorporated into the toner.

The release agent usable in the present invention may include the following. It may include aliphatic hydrocarbon waxes such as low-molecular weight polyethylene, low-molecular weight polypropylene, microcrystalline wax and paraffin wax, oxides of aliphatic hydrocarbon waxes such as polyethylene wax oxide, and block copolymers thereof; waxes mainly composed as a fatty acid ester, such as carnauba wax and montanic acid ester wax; and those obtained by deoxidizing part or the whole of a fatty acid ester, such as deoxidized carnauba wax. It may also include saturated straight-chain fatty acids such as palmitic acid, stearic acid and montanic acid; unsaturated fatty acids such as brassidic acid, eleostearic acid and patinatic acid; saturated alcohols such as stearyl alcohol, aralkyl alcohol, behenyl alcohol, carnaubyl alcohol, ceryl alcohol and melissyl alcohol; polyhydric alcohol such as sorbitol; fatty acid amides such as linoleic acid amide, oleic acid amide and lauric acid amide; saturated fatty acid bisamides such as methylenebisstearic acid amide, ethylenebiscapric acid amide, ethylenebislauric acid amide and hexamethylenebisstearic acid amide; unsaturated fatty acid amides such as ethylenebisoleic acid amide, hexamethylenebisoleic acid amide, N,N'-dioleyladipic acid amide and N,N'-dioleylsebacic acid amide; aromatic bisamides such as m-xylenebisstearic acid amide and N,N'-distearylisophthalic acid amide; fatty acid metal salts (what is commonly called metal soaps) such as calcium stearate, calcium laurate, zinc stearate and magnesium stearate; waxes obtained by grafting vinyl monomers such as styrene or acrylic acid into fatty acid hydrocarbon waxes; partially esterified products of fatty acids such as behenic acid monoglyceride with polyhydric alcohols; and monomethyl ester compounds having a hydroxyl group, obtained by hydrogenation of vegetable fats and oils.

The release agent, particularly preferably usable in the present invention, may include aliphatic hydrocarbon waxes, as exemplified by those comprised of i) a low-molecular-weight alkylene polymer obtained by radical polymerization of an alkylene under a high pressure or by polymerization thereof under a low pressure in the presence of a Ziegler catalyst, ii) an alkylene polymer obtained by thermal decomposition of a high-molecular-weight alkylene polymer or iii) a synthetic hydrocarbon obtained from, or by hydrogenating, the distillation residue of hydrocarbons prepared by the Arge process from a synthesis gas comprised of carbon monoxide and hydrogen. Those obtained through fractionation of hydrocarbon waxes by a fractional crystallization system utilizing press-sweating, solvent dewaxing or vacuum distillation are more preferably used. The hydrocarbon, serving as a matrix, may include hydrocarbons synthesized by reacting carbon monoxide with hydrogen in the presence of a metal oxide type catalyst (usually formed of two or more kinds of catalysts), as exemplified by hydrocarbons having about several hundred carbon atoms obtained by the Synthol method, the Hydrocol process (making use of a fluidized catalyst bed) or the Arge process (making use of a fixed catalyst bed), which latter provides waxy hydrocarbons in a large quantity; and hydrocarbons obtained by polymerizing alkylenes such as ethylene in the presence of a Ziegler catalyst; all of which are preferable as having less branches and being saturated long straight chain hydrocarbons. In particular, hydrocarbon waxes synthesized by the method not relying on the polymerization of alkylenes are preferred in view of their molecular weight distribution.

In the molecular weight distribution of the above release agent, a peak may preferably be present in the region of a molecular weight of from 400 to 2,400, preferably in the region of a molecular weight of from 450 to 2,000, and particularly preferably from 500 to 1,600. Making the release agent have such a molecular weight distribution makes it possible to impart preferable thermal properties to the toner.

The release agent used in the present invention may preferably be in an amount of from 0.1 part to 20 parts by weight, and more preferably from 0.5 part to 10 parts by weight, based on 100 parts by weight of the binder resin.

The release agent can usually be incorporated into the binder resin by a method in which the resin is dissolved in a solvent and then the temperature of the resulting resin solution is raised, where the release agent is added and mixed therein with stirring.

The toner of the present invention may contain a fluidizing agent. As the fluidizing agent used in the present invention, any materials can be used so long as fluidity can increase after its addition compared with the fluidity before its addition when added to colorant-containing resin particles. For example, it may include fluorine type resin powders such as fine fluorinated vinylidene powder and fine polytetrafluoroethylene powder; fine silica powder such as wet process silica and dry process silicas and treated silicas comprising any of these silicas whose particle surfaces have been treated with a surface treating agent such as a silane coupling agent, a silane coupling agent having a functional group, a titanium coupling agent, silicone oil, modified silicone oil, silicone varnish or modified silicone varnish.

Preferred fluidizing agents are fine powders produced by the vapor phase oxidation of silicon halides, i.e., what is called dry-process silica or fumed silica, which can be produced by conventionally known techniques. For example, they are produced by a process that utilizes heat decomposition oxidation reaction of silicon tetrachloride gas in oxyhydrogen flame. The reaction basically proceeds as follows.

$$SiCl_4+2H_2+O_2 \rightarrow SiO_2+4HCl$$

In this production step, it is also possible to use other metal halide such as aluminum chloride or titanium chloride together with the silicon halide to give a composite fine powder of silica with other metal oxide. The fine silica powder of the present invention includes these, too. With regard to its particle diameter, it is preferable to use a fine silica powder having an average primary particle diameter in the range of from 0.001 to 2 μm, and particularly preferably in the range of from 0.002 to 0.2 μm.

Commercially available fine silica powders usable in the present invention, produced by the vapor phase oxidation of the silicon halide, include, for example, those which are on the market under the following trade names.

Aerosil 130, 200, 300, 380, TT600, MOX80, MOX170, COK84 (Aerosil Japan, Ltd.);

Ca-O-SiL M-5, MS-7, MS-75, HS-5, EH-5 (CABOT CO.);

Wacker HDK N20, V15, N20E, T30, T40 (WACKER-CHEMIE GMBH);

D-C Fine Silica (Dow-Corning Corp.); and

Fransol (Fransil Co.).

It is more preferable to use a treated fine silica powder obtained by subjecting to hydrophobic treatment the fine silica powder produced by the vapor phase oxidation of the silicon halide. In such treated fine silica powder, it is particularly preferred to use those obtained by treating the fine silica powder so as to have a degree of hydrophobicity in a value ranging from 30 to 80 as measured by methanol titration.

The fine silica powder can be made hydrophobic by chemically treating it with an organic silicon compound capable of reacting with, or being physically adsorbed on, the fine silica powder. As a preferred method, the fine silica powder produced by the vapor phase oxidation of the silicon halide may be treated with an organic silicon compound.

Such an organic silicon compound can be exemplified by hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, trimethylsilyl mercaptan, trimethylsilyl mercaptan, trimethylsilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units in its molecule and containing a hydroxyl group bonded to each Si in its units positioned at the terminals. Any of these may be used alone or in the form of a mixture of two or more kinds.

The fluidizing agent used in the present invention may preferably have a specific surface area, as measured by the BET method using nitrogen absorption, of not less than 30 $m^2/g$, and more preferably not less than 50 $m^2/g$, which can give good results. The fluidizing agent may preferably be used in an amount of from 0.01 part to 8 parts by weight, and more preferably from 0.1 part to 4 parts by weight, based on 100 parts by weight of the toner.

The toner of the present invention may be used as a one-component type developer comprised of the toner, or may be used in a two-component type developer comprised of the toner and a carrier.

In the case when the toner of the present invention is used in the two-component type developer, a carrier so used as to be well effective plays an important role. The carrier used in the present invention may include, for example, metals such as surface-oxidized or -unoxidized iron, nickel, copper, zinc, cobalt, manganese, chromium or rare earth elements, alloys or oxides of these, powders having magnetism such as ferrite, and glass beads. There are no particular limitations on a method for producing the carrier.

A system in which the particle surfaces of the carrier are covered with an adherent material such as resin is particularly preferable in the J/B development. As methods therefor, any conventional method can be applied, as exemplified by a method in which the adherent material such as resin is dissolved or suspended in a solvent and the resulting solution or suspension is coated on the carrier to make the adherent material adhere to its particle surfaces, and a method in which the adherent material in the form of powder is merely mixed.

The adherent material applied to the carrier particle surfaces may differ depending on toner materials. It is suitable to use, for example, polytetrafluoroethylene, a monochlorotrifluoroethylene polymer, polyvinylidene fluoride, silicone resin, polyester resin, di-tert-butylsalicylic acid metal complexes, styrene resins, acrylic resins, polyamide, polyvinylbutyral, Nigrosine, aminoacrylate resins, basic dyes and lakes thereof, fine silica powder, fine alumina powder, which may be used alone or in combination. Examples are not necessarily limited to these.

The above compound may be applied in an amount appropriately so determined that the carrier can satisfy the foregoing conditions, and usually in an amount of preferably from 0.1 to 30% by weight, and more preferably from 0.5 to 20% by weight, in total weight based on the weight of the carrier. The carrier exemplified by these may preferably have an average particle diameter of from 10 to 100 μm, and more preferably from 20 to 70 μm.

As particularly preferred embodiments, the carrier may include coated ferrite carriers comprising a Cu-Zn-Fe three-component ferrite whose particle surfaces are coated with a combination of a fluorine resin with a resin such as a styrene resin, as exemplified by a mixture comprised of polyvinylidene fluoride and styrene/methyl methacrylate resin, polytetrafluoroethylene and styrene/methyl methacrylate resin, or a fluorine copolymer and a styrene copolymer in a proportion of 90:10 to 20:80, and preferably 70:30 to 30:70, in a coating weight of from 0.01 to 5% by weight, and preferably from 0.1 to 1% by weight, containing 70% by weight or more of 250 mesh-pass and 400 mesh-on carrier particles and having the average particle diameter described above. The fluorine copolymer can be exemplified by a vinylidene fluoride/tetrafluoroethylene copolymer (10:90 to 90:10). The styrene copolymer can be exemplified by a styrene/2-ethylhexyl acrylate (20:80 to 80:20) and a styrene/2-ethylhexyl acrylate/methyl methacrylate (20 to 60:5 to 30:10 to 50). The coated ferrite carriers described above have a sharp particle size distribution, can obtain a triboelectric charging performance preferable for the toner of the present invention, and also can be effective for improving electrophotographic performance.

In the case when the two-component type developer is prepared by blending the toner according to the present invention, the toner may preferably be in a mixing proportion of from 2 to 15% by weight, and more preferably from 4 to 13% by weight, as a toner concentration in the developer. Thus, good results can usually be obtained. A toner concentration smaller than 2% by weight may result in a low image density, and that more than 15% by weight may cause an increase in fog or in-machine toner scatter, resulting in a shorter lifetime of the developer.

The toner for developing an electrostatic image according to the present invention can be produced in the following way: The binder resin, the magnetic material, the release agent, the colorant, the charge control agent and other additives are thoroughly mixed using a mixing machine such as a Henschel mixer or a ball mill, and then the mixture is melt-kneaded using a heat kneading machine such as a heating roll, a kneader or an extruder to make the resin and so on melt one another. The melt-kneaded product is cooled for solidification, the solidified product is pulverized and the pulverized product is classified. In this way, the toner according to the present invention can be obtained.

If necessary, the fluidizing agent and the toner may be further thoroughly mixed using a mixing machine such as a Henschel mixer so that the additive can be imparted to the toner particle surfaces. Thus, the toner for developing an electrostatic image can be obtained.

Properties of the binder resin according to the present invention are measured in the manner as shown below. In Examples described later, corresponding values are in accordance with these methods.

(1) Measurement of Acid Value and OH Value

In a 200 to 300 ml Erlenmeyer flask, 2 to 10 g of a sample is weighed and put, followed by addition of about 50 ml of a 30:70 mixed solvent of methanol and toluene to dissolve the sample. If it can not be well dissolved, acetone may be added in a small amount. Using a 0.1% mixed reagent of Bromothymol Blue and Phenol Red, titration is made in N/10 potassium hydroxide-alcohol solution previously standardized, and the acid value is calculated from the consumption of the alcohol potassium hydroxide solution according the following expression (1).

Acid value=

$$\text{KOH (ml number)} \times N \times 56.1/\text{sample weight} \quad (1)$$

wherein N represents a factor of N/10 KOH.

The sample is heated together with an excess acetylating agent as exemplified by acetic anhydride to effect acetylation. The saponification value of the acetylated product thus formed is measured, and thereafter the hydroxyl value is calculated according to the following expression (2).

$$\text{Hydroxyl value} = \frac{A}{1 - 0.00075A} - B \quad (2)$$

wherein A represents a saponification value after acetylation, and B represents a saponification value before acetylation.

(2) Glass Transition Temperature Tg

The glass transition point is measured using a differential scanning calorimeter (DSC measuring device), DSC-7 (manufactured by Perkin-Elmer Inc.).

A sample to be measured is precisely weighed in a quantity of 5 to 20 mg, and preferably 10 mg.

This sample is put in an aluminum pan. Using an empty aluminum pan as a reference, the measurement is carried out in an environment of normal temperature and normal humidity at a measuring temperature range between 30° C. and 200° C., raised at a rate of 10° C./min.

During this temperature rise, an endothermic peak of the main peak in the range of temperatures 40° C. to 100° C. is obtained. The point at which the line at a middle point of the base lines before and after appearance of the endothermic peak and the differential thermal curve intersect is regarded as the glass transition point Tg.

(3) Measurement of Molecular Weight (Polyester Resin)

The molecular weight on a chromatogram obtained by GPC (gel permeation chromatography) are measured under the following conditions.

Columns are stabilized in a heat chamber of 40° C. To the columns kept at this temperature, THF (tetrahydrofuran) as a solvent is flowed at a flow rate of 1 ml per minute, and 50 to 200 μl of a THF sample solution of a resin prepared to have a sample concentration of from 0.05 to 0.6% by weight is injected thereinto to make measurement.

In measuring the molecular weight of the sample, the molecular weight distribution ascribed to the sample is calculated from the relationship between the logarithmic value and count number of a calibration curve prepared using several kinds of monodisperse polystyrene standard samples. As the standard polystyrene samples used for the preparation of the calibration curve, it is suitable to use, for example, samples with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, which are available from Pressure Chemical Co. or Toyo Soda Manufacturing Co., Ltd., and to use at least about 10 standard polystyrene samples. An RI (refractive index) detector is used as a detector.

Columns should be used in combination of a plurality of commercially available polystyrene gel columns so that the regions of molecular weights of from $10^3$ to $2\times10^6$ can be accurately measured. For example, they may preferably comprise a combination of μ-Styragel 500, $10^3$, $10^4$ and $10^5$, available from Waters Co.; a combination of Shodex KF-80M, KF-801, 803, 804 and 805, or a combination of KA-802, 803, 804 and 805, available from Showa Denko K.K.; or a combination of TSKgel G1000H, G2000H, G2500H, G3000H, G4000H, G5000H, G6000H, G7000H and GMH, available from Toyo Soda Manufacturing Co., Ltd.

(4) Measurement of Molecular Weight Distribution (Modifying Compound)

GPC Measurement Conditions

Apparatus: GPC-150C (Waters Co.)
Columns: GMH-HT 30 cm, two series (available from Toso Co., Ltd.)
Temperature: 135° C.
Solvent: o-Dichlorobenzene (0.1% ionol-added)
Flow rate: 1.0 ml/min
Sample: 0.4 ml of 0.15% sample is injected.

Measured under conditions described above. Molecular weight of the sample is calculated using a molecular weight calibration curve prepared from a monodisperse polystyrene standard sample. It is calculated by further converting the value in terms of polyethylene according to a conversion formula derived from the Mark-Houwink viscosity formula.

(5) Measurement of Particle Size Distribution

A Coulter counter Multisizer II (manufactured by Coulter Electronics, Inc.) is used as a measuring device. An interface (manufactured by Nikkaki k.k.) that outputs number distribution and volume distribution and a personal computer PC9801 (manufactured by NEC) are connected. As an electrolytic solution, an aqueous 1% NaCl solution is prepared using first-grade sodium chloride. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The particle size distribution of particles of 2 to 40 μm is measured by means of the above Coulter counter Multisizer II, using an aperture of 100 μm as its aperture to calculate the volume distribution and number distribution of the particles of 2 to 40 μm, and then weight average particle diameter (D4: a center value of each channel is regarded as a representative value of channels) obtained from the volume distribution is determined.

In the toner for developing an electrostatic image according to the present invention, at least part of the polyester resin used in the binder resin has been modified with the compound which has a long-chain alkyl group having 22 to 102 carbon atoms and has a hydroxyl group or a carboxyl group at its terminal, so that the long-chain alkyl group having 22 to 102 carbon atoms can be introduced into the structure of the polyester resin. This makes it possible to achieve a superior low-temperature fixing performance, superior anti-offset properties and superior environmental stability, and in particular to prevent the charge-up of the toner in an environment of low temperature and low humidity.

EXAMPLES

The present invention will be described in greater detail by giving preparation examples and working examples. In the following, "part(s)" refers to "part(s) by weight".

| Preparation of modified polyester resin (1) | |
|---|---|
| Bisphenol derivatives represented by formula (I) | |
| (R is propylene) | 360 parts |
| Terephthalic acid | 100 parts |
| Decenylsuccinic acid | 75 parts |
| Alkyl alcohol represented by formula (1) | |
| (x = 48; Mw/Mn = 1.2) | 135 parts |
| Stannous oxide | 0.5 part |

The above materials were charged into a 5 liter four-necked flask, to which a reflux condenser, a water separator, a nitrogen gas feed pipe, a thermometer and a stirrer were provided. While nitrogen is fed into the flask, modification reaction was carried out at 220° C. simultaneously with condensation polymerization reaction to obtain modified polyester resin (1) with Mn of 6,000, Mw of 12,000, Tg of 57° C., an acid value of 20 and an OH value of 18.

In this modified polyester resin (1), the amount of modification with the alkyl alcohol was 17% by weight based on the weight of the modified polyester resin.

Physical properties of the modified polyester resin (1) thus obtained are shown in Table 1.

Preparation of Modified Polyester Resins (2) to (10)

Modified polyester resins (2) to (10) having the physical properties as shown in Table 1 were obtained by replacing the composition and molecular weights of the alkyl alcohol and polyester resin with those as shown in Table 1.

TABLE 1

| Modified polyester resin | Alcohol-modified Polyester Resin | | | | | | | |
|---|---|---|---|---|---|---|---|---|
| | Alkyl alcohol | | Alcohol-modified polyester resin | | | | | |
| No. | x | Mw/Mn | Mn | Mw | Tg | Acid val. | OH val. | (*) |
| (1) | 48 | 1.2 | 6,000 | 12,000 | 57° C. | 20 | 18 | 17 |
| (2) | 28 | 1.1 | 6,500 | 12,000 | 53° C. | 15 | 15 | 17 |
| (3) | 22 | 2.5 | 5,500 | 13,000 | 55° C. | 10 | 13 | 17 |
| (4) | 95 | 3.0 | 6,500 | 15,000 | 67° C. | 12 | 12 | 17 |
| (5) | 50 | 3.5 | 5,500 | 16,000 | 60° C. | 20 | 17 | 17 |
| (6) | 50 | 1.2 | 5,000 | 9,500 | 40° C. | 17 | 15 | 17 |
| (7) | 30 | 1.1 | 4,500 | 9,300 | 30° C. | 15 | 18 | 17 |
| (8) | 18 | 1.2 | 4,000 | 7,000 | 20° C. | 10 | 13 | 17 |
| (9) | 120 | 3.5 | 6,500 | 13,000 | 65° C. | 28 | 20 | 17 |
| (10) | 50 | 6.0 | 3,000 | 11,000 | 35° C. | 30 | 25 | 17 |

(*): Amount of modification with alkyl alcohol (wt. %)

| Preparation of polyester resin (A) | |
|---|---|
| Bisphenol derivative represented by formula (I) | |
| (R is ethylene; x + y = 2.2) | 17 mol % |
| (R is propylene; x + y = 2.2) | 34 mol % |
| Terephthalic acid | 17 mol % |
| Succinic acid | 20 mol % |
| Trimellitic acid | 12 mol % |

100 parts of the above materials and 0.1 part of stannous oxide were charged into a 5 liter four-necked flask, to which a reflux condenser, a water separator, a nitrogen gas feed pipe, a thermometer and a stirrer were provided. While nitrogen is fed into the flask, condensation polymerization reaction was carried out at 220° C. to obtain polyester resin (A) with Mn of 3,800, Mw of 9,200, Tg of 62° C., an acid value of 10 and an OH value of 20.

| Preparation of polyester resin (B) | |
|---|---|
| Bisphenol derivative represented by formula (I) | |
| (R is propylene) | 360 parts |
| Terephthalic acid | 100 parts |
| Decenylsuccinic acid | 75 parts |
| Stannous oxide | 0.5 part |

The above materials were charged into a 5 liter four-necked flask, to which a reflux condenser, a water separator, a nitrogen gas feed pipe, a thermometer and a stirrer were provided. While nitrogen is fed into the flask, condensation polymerization reaction was carried out at 220° C. to obtain polyester resin (B) with Mn of 5,000, Mw of 12,000, Tg of 70° C., an acid value of 35 and an OH value of 25.

EXAMPLE 1

| | |
|---|---|
| Modified polyester resin (1) | 100 parts |
| Magnetic iron oxide (average particle diameter: 0.15 μm; Hc: 115 oersted: σs: 80 emu/g; σr: 11 emu/g) | 80 parts |
| Monoazo complex (negatively chargeable charge control agent) | 2 parts |

The above materials were thoroughly premixed using a Henschel mixer, and then melt-kneaded using a twin-screw extruder at 130° C. The kneaded product thus obtained was cooled, and then crushed with a cutter mill. Thereafter the crushed product was finely pulverized by means of a fine grinding mill making use of a jet stream. Subsequently, the finely pulverized powder thus obtained was classified using an air classifier to obtain a black fine powder (a magnetic toner) with a weight average particle diameter of 8.0 μm.

To 100 parts of the black fine powder thus obtained, 0.6 part of hydrophobic dry-process silica (BET specific surface area: 150 $m^2/g$) was added, followed by mixing using a Henschel mixer to give a magnetic toner, which was used as a one-component developer.

Using the one-component developer thus obtained, unfixed images were obtained using a copying machine NP-6060, manufactured by Canon Inc., and were then fixed using a fixing assembly having the same construction as that of NP-6060 to carry out a fixing test.

As a result, the fixing was possible in a fixing temperature range of from 130° to 240° C.

Using also the one-component developer, images were reproduced using a modified machine of a laser copying machine-NP-9330, manufactured by Canon Inc., to make evaluation, which was so modified as to have a system in which its photosensitive drum was changed to an OPC photosensitive drum, latent images were formed by a laser after it was electrostatically charged by means of a negative corona assembly, and reversal development was carried out.

As a result, none of white-ground fog and blank areas caused by poor transfer occurred, a maximum image density was 1.45, and good density gradation was obtained even in copies of photographic images with lettering. In the relationship between development potential and image density, substantially satisfactory linearity was obtained.

A 20,000 sheet copying test was also carried out. As a result, copied images showed good image quality almost not different from the above initial images, and good results were also obtained on the fixing performance. Moreover, neither adhesion of toner to the photosensitive drum nor faulty cleaning occurred at all.

The copying test was also carried out in environments of low temperature and low humidity (5° C., 10% RH) and high temperature and high humidity (30° C., 80% RH). As a result, the same good results as those at the initial stage were obtained throughout the test. In the environment of high temperature and high humidity, the test was carried out after the developer was left to stand for a long term (left for a week), but no decrease in density occurred and good results were obtained.

The developer was also left to stand at 50° C. for a week to examine its storage stability to find that no blocking occurred to retain a good fluidity.

In the developing assembly of the above copying machine, its charge corona assembly was replaced with a contact charging roller to electrostatically charge the photosensitive drum and also its transfer corona assembly was replaced with a contact transfer roller to transfer the toner images to recording mediums, where any contamination of the contact transfer roller and blank areas caused by poor transfer were examined to make evaluation.

Results of evaluation are shown in Table 3.

EXAMPLES 2 TO 8

One-component developers were prepared in the same manner as in Example 1 except that the magnetic toner was prepared according to the formulation changed as shown in Table 2. Images were reproduced and evaluation was made similarly.

Results of evaluation are shown in Table 3.

TABLE 2

| Formulation of Magnetic Toner | | | | |
|---|---|---|---|---|
| Binder resin | | | | |
| Modified polyester resin (Amount) | Other polyester resin (Amount) | Magnetic material (Amount) | Charge control agent (Amount) | Release agent (Amount) |
| Example 1: | | | | |
| MPER-(1) (100 pbw) | — | MIO (80 pbw) | MAC (2 pbw) | — |
| Example 2: | | | | |
| MPER-(2) (100 pbw) | — | MIO (80 pbw) | MAC (2 pbw) | — |
| Example 3: | | | | |
| MPER-(3) (100 pbw) | — | MIO (80 pbw) | MAC (2 pbw) | — |
| Example 4: | | | | |
| MPER-(4) (50 pbw) | PER-(A) (50 pbw) | MIO (80 pbw) | MAC (2 pbw) | Arge W.* (4 pbw) |
| Example 5: | | | | |
| MPER-(5) (100 pbw) | — | MIO (80 pbw) | MAC (2 pbw) | Arge W.* (4 pbw) |
| Example 6: | | | | |
| MPER-(6) (50 pbw) | PER-(A) (50 pbw) | MIO (80 pbw) | MAC (2 pbw) | — |
| Example 7: | | | | |
| MPER-(7) (30 pbw) | PER-(A) (70 pbw) | MIO (80 pbw) | MAC (2 pbw) | Arge W.* (2 pbw) |
| Example 8: | | | | |
| MPER-(10) (50 pbw) | PER-(A) (50 pbw) | MIO (80 pbw) | MAC (2 pbw) | — |

MPER: Modified polyester resin
MIO: Magnetic iron oxide
MAC: Monoazo complex
PER: Polyester resin
Arge W.: Hydrocarbon wax synthesized by Arge process,
*molecular weight peak value: 600.

TABLE 3

| Results of Evaluation on One-component Developers in Examples | | | | | | | | | | | | | | | | |
|---|---|---|---|---|---|---|---|---|---|---|---|---|---|---|---|---|
| | Initial-stage images | | | | After 20,000 sheet running | | | | | | | | | | | |
| Fixing temperature range | Max. image density | (1) | (2) | (3) | Max. image density | (1) | (2) | (4) | (5) | (6) | (3) | (7) | (8) | (9) | (10) | (11) |
| Example: | | | | | | | | | | | | | | | | |
| 1 130–240° C. | 1.45 | A | A | A | 1.45 | A | A | A | A | A | A | A | A | A | AB | AB |
| 2 130–230° C. | 1.43 | A | A | A | 1.43 | A | A | A | A | A | A | A | A | A | AB | AB |
| 3 135–200° C. | 1.38 | A | A | A | 1.39 | A | A | A | A | A | A | A | A | A | AB | AB |
| 4 135–240° C. | 1.42 | A | A | A | 1.42 | A | A | A | A | A | A | A | A | A | A | A |
| 5 130–235° C. | 1.45 | A | A | A | 1.45 | A | A | A | A | A | A | A | A | A | A | A |
| 6 130–240° C. | 1.40 | A | A | A | 1.42 | A | A | A | A | A | A | A | A | A | AB | AB |
| 7 130–230° C. | 1.43 | A | A | A | 1.43 | A | A | A | A | A | A | A | A | A | A | A |
| 8 130–220° C. | 1.40 | A | A | A | 1.38 | B | A | A | B | B | A | B | B | B | AB | AB |

(1): Fog
(2): Density gradation
(3): Blank areas caused by poor transfer
(4): Fixing performance
(5): Melt-adhesion of toner photosensitive member
(6): Cleaning performance
(7): Environmental stability
(8): Evaluation after long-term leaving
(9): Storage stability
(10): Contamination of contact-charging roller
(11): Blank areas caused by poor transfer in use of contact transfer means
Evaluation was made acc. to five rank system of "Good" to "Poor" corr. to A, AB, B, BC, C

COMPARATIVE EXAMPLES 1 TO 4

One-component developers were prepared in the same manner as in Example 1 except that the magnetic toner was prepared according to the formulation changed as shown in Table 4. Images were reproduced and evaluation was made similarly.

Results of evaluation are shown in Table 5.

TABLE 4

| | Formulation of Magnetic Toner | | | |
|---|---|---|---|---|
| | Binder resin (Amount) | Magnetic material (Amount) | Charge control agent (Amount) | Release agent (Amount) |
| Comparative Example 1: | PER-(B) (100 pbw) | MIO (80 pbw) | MAC (2 pbw) | None |
| Comparative Example 2: | MPER-(8) (100 pbw) | MIO (80 pbw) | MAC (2 pbw) | None |
| Comparative Example 3: | MPER-(9) (100 pbw) | MIO (80 pbw) | MAC (2 pbw) | None |
| Comparative Example 4: | PER-(B) (100 pbw) | MIO (80 pbw) | MAC (2 pbw) | Alcohol of formula (1); $C_{30}$ (25 pbw) |

MPER: Modified polyester resin
MIO: Magnetic iron oxide
MAC: Monoazo complex
PER: Polyester resin

TABLE 5

| | Results of Evaluation on One-component Developers in Comparative Examples | | | | | | | | | | | | | | | |
|---|---|---|---|---|---|---|---|---|---|---|---|---|---|---|---|---|
| | Initial-stage images | | | | After 20,000 sheet running | | | | | | | | | | | |
| Fixing temperature range | Max. image density | (1) | (2) | (3) | Max. image density | (1) | (2) | (4) | (5) | (6) | (3) | (7) | (8) | (9) | (10) | (11) |
| Comparative Example: | | | | | | | | | | | | | | | | |
| 1 190–230° C. | 1.30 | C | C | C | 1.20 | C | C | C | A | B | C | C | C | A | C | C |
| 2 140–160° C. | 1.35 | B | B | C | 1.22 | BC | C | BC | C | C | C | C | C | C | AB | AB |
| 3 180–230° C. | 1.30 | B | B | C | 1.25 | BC | C | C | A | A | C | B | B | A | AB | AB |
| 4 140–160° C. | 1.25 | C | C | C | ←------*1----------→ | | | | | | | | | C | ←*1→ | |

(1): Fog
(2): Density gradation
(3): Blank areas caused by poor transfer
(4): Fixing performance
(5): Melt-adhesion of toner to photosensitive member
(6): Cleaning performance
(7): Environmental stability
(8): Evaluation after long-term leaving
(9): Storage stability
(10): Contamination on contact-charging roller
(11): Blank areas caused by poor transfer in use of contact transfer means
*1: Infeasible for evaluation because of occurence of blocking.
Evaluation was made acc. to five rank system of "Good" to "Poor" corr. to A, AB, B, BC, C

| Preparation of modified polyester resin (11) | |
|---|---|
| Bisphenol-A ethylene oxide adduct | 632 parts |
| Bisphenol-A propylene oxide adduct | 1,032 parts |
| Terephthalic acid | 581 parts |
| Trimellitic acid | 315 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 5 hours. At this time, the reaction mixture had an acid value of 21.5 mg KOH/g.

Thereafter, 520 parts of a straight-chain alkyl alcohol $C_{40}H_{81}OH$ was added to further carry out reaction for 2 hours. After it cooled to room temperature, the reaction product was taken out to obtain modified polyester resin (11).

The modified polyester resin (11) had an acid value of 10.3 mg KOH/g, a hydroxyl value of 20.7 mg KOH/g and a glass transition point (Tg) of 59.3° C.

In this modified polyester resin (11), the amount of modification with the alkyl alcohol was 14% by weight based on the weight of the modified polyester resin.

| Preparation of modified polyester resin (12) | |
|---|---|
| Bisphenol-A ethylene oxide adduct | 632 parts |
| Bisphenol-A propylene oxide adduct | 1,032 parts |
| Dodecenylsuccinic anhydride | 399 parts |
| Terephthalic acid | 464.8 parts |
| Trimellitic acid | 147 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 5 hours. At this time, the reaction mixture had an acid value of 23.5 mg KOH/g.

Thereafter, 1,068 parts of a straight-chain alkyl alcohol $C_{75}H_{151}OH$ was added to further carry out reaction for 3 hours. After it cooled to room temperature, the reaction product was taken out to obtain modified polyester resin (12).

The modified polyester resin (12) had an acid value of 12.5 mg KOH/g, a hydroxyl value of 15.7 mg KOH/g and a glass transition point (Tg) of 58.6° C.

In this modified polyester resin (12), the amount of modification with the alkyl alcohol was 18% by weight based on the weight of the modified polyester resin.

| Preparation of modified polyester resin (13) | |
|---|---|
| Bisphenol-A ethylene oxide adduct | 632 parts |
| Bisphenol-A propylene oxide adduct | 860 parts |
| Neopentyl glycol | 52.5 parts |
| Terephthalic acid | 581 parts |
| Trimellitic acid | 315 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 5 hours. At this time, the reaction mixture had an acid value of 19.7 mg KOH/g.

Thereafter, 390 parts of a straight-chain alkyl alcohol $C_{35}H_{71}OH$ was added to further carry out reaction for 2 hours. After it cooled to room temperature, the reaction product was taken out to obtain modified polyester resin (13).

The modified polyester resin (13) had an acid value of 11.5 mg KOH/g, a hydroxyl value of 20.7 mg KOH/g and a glass transition point (Tg) of 60.2° C.

In this modified polyester resin (13), the amount of modification with the alkyl alcohol was 11% by weight based on the weight of the modified polyester resin.

| Preparation of modified polyester resin (14) | |
|---|---|
| Bisphenol-A ethylene oxide adduct | 632 parts |
| Bisphenol-A propylene oxide adduct | 1,032 parts |
| Adipic acid | 73 parts |
| Terephthalic acid | 581 parts |
| Trimellitic acid | 210 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 5 hours. At this time, the reaction mixture had an acid value of 18.9 mg KOH/g.

Thereafter, 770 parts of a straight-chain alkyl alcohol $C_{70}H_{141}OH$ was added to further carry out reaction for 3 hours. After cooled to room temperature, the reaction product was taken out to obtain modified polyester resin (14).

The modified polyester resin (14) had an acid value of 10.7 mg KOH/g, a hydroxyl value of 13.2 mg KOH/g and a glass transition point (Tg) of 58.7° C.

In this modified polyester resin (14), the amount of modification with the alkyl alcohol was 20% by weight based on the weight of the modified polyester resin.

| Preparation of modified polyester resin (15) | |
|---|---|
| Bisphenol-A ethylene oxide adduct | 632 parts |
| Bisphenol-A propylene oxide adduct | 1,032 parts |
| Terephthalic acid | 581 parts |

-continued

| Preparation of modified polyester resin (15) | |
|---|---|
| Trimellitic acid | 315 parts |
| Straight-chain alkyl alcohol $C_{40}H_{81}OH$ | 460 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 7 hours. After it cooled to room temperature, the reaction product was taken out to obtain modified polyester resin (15).

The modified polyester resin (15) had an acid value of 12.7 mg KOH/g, a hydroxyl value of 19.3 mg KOH/g and a glass transition point (Tg) of 58.8° C.

In this modified polyester resin (15), the amount of modification with the alkyl alcohol was 12% by weight based on the weight of the modified polyester resin.

| Preparation of modified polyester resin (16) | |
|---|---|
| Bisphenol-A ethylene oxide adduct | 632 parts |
| Bisphenol-A propylene oxide adduct | 1,032 parts |
| Terephthalic acid | 581 parts |
| Trimellitic acid | 315 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 5 hours. At this time, the reaction mixture had an acid value of 19.8 mg KOH/g.

Thereafter, 180 parts of a straight-chain alkyl alcohol $C_{15}H_{31}OH$ was added to further carry out reaction for 2 hours. After it cooled to room temperature, the reaction product was taken out to obtain modified polyester resin (16).

The modified polyester resin (16) had an acid value of 10.9 mg KOH/g, a hydroxyl value of 17.8 mg KOH/g and a glass transition point (Tg) of 59.7° C.

In this modified polyester resin (16), the amount of modification with the alkyl alcohol was 6.0% by weight based on the weight of the modified polyester resin.

| Preparation of modified polyester resin (17) | |
|---|---|
| Bisphenol-A ethylene oxide adduct | 632 parts |
| Bisphenol-A propylene oxide adduct | 1,032 parts |
| Terephthalic acid | 581 parts |
| Trimellitic acid | 315 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 5 hours. At this time, the reaction mixture had an acid value of 21.7 mg KOH/g.

Thereafter, 140 parts of a straight-chain alkyl alcohol $C_{10}H_{21}OH$ was added to further carry out reaction for 2 hours. After it cooled to room temperature, the reaction product was taken out to obtain modified polyester resin (17).

The modified polyester resin (17) had an acid value of 12.7 mg KOH/g, a hydroxyl value of 18.1 mg KOH/g and a glass transition point (Tg) of 58.5° C.

In this modified polyester resin (17), the amount of modification with the alkyl alcohol was 5.0% by weight based on the weight of the modified polyester resin.

| Preparation of modified polyester resin (18) | |
|---|---|
| Bisphenol-A ethylene oxide adduct | 632 parts |
| Bisphenol-A propylene oxide adduct | 1,032 parts |
| Terephthalic acid | 581 parts |
| Trimellitic acid | 315 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 5 hours. At this time, the reaction mixture had an acid value of 21.5 mg KOH/g.

| Preparation of polyester resin (C) | |
|---|---|
| Bisphenol-A ethylene oxide adduct | 632 parts |
| Bisphenol-A propylene oxide adduct | 1,032 parts |
| Dodecenylsuccinic anhydride | 399 parts |
| Terephthalic acid | 464.8 parts |
| Trimellitic acid | 147 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 210° C. to carry out reaction for 7 hours. After cooled to room temperature, the reaction product was taken out to obtain polyester resin (C).

The polyester resin (C) had an acid value of 16.7 mg KOH/g, a hydroxyl value of 15.2 mg KOH/g and glass transition point (Tg) of 59.3° C.

Formulation and physical properties of the above modified polyester resins (11) to (18) and polyester resin (C) are summarized in Table 6.

TABLE 6

Formulation and Physical Properties of Polyester Resins

| | Modified polyester resin | | | | | | | | PER |
|---|---|---|---|---|---|---|---|---|---|
| | (11) | (12) | (13) | (14) | (15)* | (16) | (17) | (18) | (C) |
| BPA-EO Adduct (pbw): | 632 | 632 | 632 | 632 | 632 | 632 | 632 | 632 | 632 |
| BPA-PPO Adduct (pbw): | 1,032 | 1,032 | 860 | 1,032 | 1,032 | 1,032 | 1,032 | 1,032 | 1,032 |
| Neopentyl glycol (pbw): | — | — | 52.5 | — | — | — | — | — | — |
| Terephthalic acid (pbw): | 581 | 464.8 | 581 | 581 | 581 | 581 | 581 | 581 | 464.8 |
| Adipic acid (pbw): | — | — | — | 73 | — | — | — | — | — |
| Dodecenyl succinic anhydride (pbw): | — | 399 | — | — | — | — | — | — | 399 |
| Trimellitic acid (pbw): | 315 | 147 | 315 | 210 | 315 | 315 | 315 | 315 | 147 |
| Acid value of PE before modf. (mgKOH/g): | 21.5 | 23.5 | 19.7 | 18.9 | — | 19.8 | 21.7 | 21.5 | — |
| Straight-chain alkyl alcohol: | $C_{40}H_{81}OH$ | $C_{75}H_{151}OH$ | $C_{35}H_{71}OH$ | $C_{70}H_{141}OH$ | $C_{40}H_{81}OH$ | $C_{15}H_{31}OH$ | $C_{10}H_{21}OH$ | $C_{40}H_{81}OH$ | — |
| pbw: | 520 | 1,068 | 390 | 770 | 460 | 180 | 140 | 230 | — |
| Acid value of resin (mgKOH/g): | 10.3 | 12.5 | 11.5 | 10.7 | 12.7 | 10.9 | 12.7 | 14.0 | 16.7 |
| Hydroxyl value of resin (mgKOH/g): | 20.7 | 15.7 | 20.7 | 13.2 | 19.3 | 17.8 | 18.1 | 20.7 | 15.2 |
| Tg of resin (°C.): | 59.3 | 58.6 | 60.2 | 58.7 | 58.8 | 59.7 | 58.5 | 62.0 | 59.3 |
| Amount of modification: | 14 | 18 | 11 | 20 | 12 | 6.0 | 5.0 | 8.0 | — |

*Linear alkyl alcohol was simultaneously added with the preparation of polyester resin.
PER: Polyester resin; BPA: Bisphenol-A; EO: Ethylene oxide; PPO: Propylene oxide Thereafter, 230 parts of a straight-chain alkyl alcohol $C_{40}H_{81}OH$ was added to further carry out reaction for 2 hours. After it cooled to room temperature, the reaction product was taken out to obtain modified polyester resin (18).

The modified polyester resin (18) had an acid value of 14.0 mg KOH/g, a hydroxyl value of 20.7 mg KOH/g and a glass transition point (Tg) of 62.0° C.

In this modified polyester resin (18), the amount of modification with the alkyl alcohol was 8.0% by weight based on the weight of the modified polyester resin.

EXAMPLE 9

| | |
|---|---|
| Modified polyester resin | 100 parts |
| Magnetic iron oxide | 90 parts |
| Negatively chargeable charge control agent | 2 parts |
| Low-molecular weight polypropylene | 3 parts |

The above materials were thoroughly mixed using a blender, and then melt-kneaded using a twin-screw extruder set at 120° C. The kneaded product thus obtained was cooled, and then crushed with a cutter mill. Thereafter the crushed product was finely pulverized by means of a fine grinding mill making use of a jet stream. Subsequently, the finely pulverized powder thus obtained was classified to obtain a black fine powder (a magnetic toner) with a volume average particle diameter of 8.26 μm.

To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a magnetic toner, which was used as a one-component developer.

The one-component developer thus obtained was applied to a commercially available copying machine NP-9800, manufactured by Canon Inc., and images were reproduced in an environment of room temperature and low humidity (23.5° C., 5% RH). Test results of the image reproduction are shown in Table 7. As is seen from Table 5, both the images at the initial stage and the images after running on 100,000 sheets showed a high image density, were sharp and had a high image quality, and neither faulty cleaning nor adhesion of toner to the drum occurred. Charges on the sleeve and the amount of toner coat on the sleeve were also stable both at the initial stage and after running on 100,000 sheets.

Charges (quantity of electricity) of the toner layer per unit area on the sleeve were determined by what is called the vacuum Faraday cage method. This vacuum Faraday cage method is a method in which an outer cylinder of a cage is pressed against the toner carrying member and all the toner in a given area on the toner carrying member is vacuum up, where the charges accumulated in an inner cylinder electrically shielded from the outside are simultaneously measured to thereby determine the charges of the toner layer on the toner carrying member.

Fixing performance and anti-offset properties were evaluated in the following way:

With regard to the fixing performance, the machine for evaluation was left to stand overnight in an environment of low temperature and low humidity (15° C., 10% RH) until the machine and its inside fixing assembly completely adapted themselves to the environment of low temperature and low humidity. Under this condition, image reproduction was started to continuously take copies on 200 sheets, and a copied image on the 200th sheet was used as a standard for the evaluation of fixing performance. To evaluate the fixing performance, images were rubbed 10 times using Silbon papas under a load of about 100 g to examine any separation of the images, which was evaluated as the rate (%) of decrease in reflection density.

Thus, the larger value the rate of decrease in reflection density (or the rate of decrease in image density) shows immediately after an image was rubbed, the more the percentage of separation of the image is, showing a poor fixing performance of the toner.

Anti-offset properties were evaluated on the basis of the number of copies taken until images were stained or rollers were contaminated, in the state the cleaning mechanism of fixing rollers was detached.

Since these was a possibility that the toner once wiped off with a cleaning web was transferred to the upper roller to contaminate copied images because of a contamination of the cleaning web occurring when copies were continuously taken, the cleaning mechanism of the fixing rollers was restored to a usual state in order to examine any occurrence of such a contamination, where the temperature set for the fixing assembly was raised by 5° C. and copies were continuously further taken on 200 sheets. Thereafter, copies were taken sheet by sheet for up to 3 minutes at intervals of 30 seconds to examine whether or not the images were stained and also to evaluate the state of any contamination of the cleaning web of the fixing rollers.

EXAMPLE 10

A black fine powder (a magnetic toner) with a volume average particle diameter of 8.34 μm was obtained in the same manner as in Example 9 except that the modified polyester resin (11) used therein was replaced with the modified polyester resin (12). To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a magnetic toner, which was used as a one-component developer.

The one-component developer thus obtained was applied to a commercially available copying machine NP-6060, manufactured by Canon Inc., and evaluation was made in the same manner as in Example 9. As a result, as is seen from Table 7, both the images at the initial stage and the images after running on 100,000 sheets showed a high image density, were sharp and had a high image quality, and neither faulty cleaning nor adhesion of toner to the drum occurred. Charges on the sleeve and the amount of toner coat on the sleeve were also stable both at the initial stage and after running on 100,000 sheets.

EXAMPLE 11

| | |
|---|---|
| Modified polyester resin (13) | 100 parts |
| Magnetic iron oxide | 90 parts |
| Negatively chargeable charge control agent | 2 parts |
| Low-molecular weight polypropylene | 3 parts |

Using the above materials, a black fine powder (a magnetic toner) with a volume average particle diameter of 8.42 μm was obtained in the same manner as in Example 9. To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a magnetic toner, which was used as a one-component developer.

The one-component developer thus obtained was applied to a commercially available copying machine NP-6060, manufactured by Canon Inc., and images were reproduced in an environment of room temperature and low humidity (23.5° C., 5% RH). Test results of the image reproduction are shown in Table 7. As is seen from Table 7, both the images at the initial stage and the images after running on 100,000 sheets showed a high image density, were sharp and had a high image quality, and neither faulty cleaning nor adhesion of toner to the drum occurred. Charges on the sleeve and the amount of toner coat on the sleeve were also stable both at the initial stage and after running on 100,000 sheets.

EXAMPLE 12

| | |
|---|---|
| Modified polyester resin (14) | 100 parts |
| Magnetic iron oxide | 90 parts |
| Negatively chargeable charge control agent | 2 parts |
| Low-molecular weight polypropylene | 3 parts |

Using the above materials, a black fine powder (a magnetic toner) with a volume average particle diameter of 8.27 μm was obtained in the same manner as in Example 9. To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a magnetic toner, which was used as a one-component developer.

The one-component developer thus obtained was applied to a commercially available copying machine NP-6060, manufactured by Canon Inc., and images were reproduced in an environment of room temperature and low humidity (23.5° C., 5% RH). Test results of the image reproduction are shown in Table 7. As is seen from Table 7, both the images at the initial stage and the images after running on 100,000 sheets showed a high image density, were sharp and had a high image quality, and neither faulty cleaning nor adhesion of toner to the drum occurred. Charges on the sleeve and the amount of toner coat on the sleeve were also stable both at the initial stage and after running on 100,000 sheets.

EXAMPLE 13

| | |
|---|---|
| Modified polyester resin (12) | 100 parts |
| Magnetic iron oxide | 90 parts |
| Negatively chargeable charge control agent | 2 parts |

Using the above materials, a black fine powder (a magnetic toner) with a volume average particle diameter of 7.97 μm was obtained in the same manner as in Example 9. To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a magnetic toner, which was used as a one-component developer.

The one-component developer thus obtained was applied to a commercially available copying machine NP-6060, manufactured by Canon Inc., and images were reproduced in an environment of room temperature and low humidity (23.5° C., 5% RH). Test results of the image reproduction are shown in Table 7. As is seen from Table 7, both the images at the initial stage and the images after running on 100,000 sheets showed a high image density, were sharp and had a high image quality. Charges on the sleeve and the amount of toner coat on the sleeve were also stable both at the initial stage and after running on 100,000 sheets.

EXAMPLE 14

| | |
|---|---|
| Modified polyester resin (14) | 100 parts |
| Magnetic iron oxide | 90 parts |
| Negatively chargeable charge control agent | 2 parts |

Using the above materials, a black fine powder (a magnetic toner) with a volume average particle diameter of 8.31 μm was obtained in the same manner as in Example 9. To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a magnetic toner, which was used as a one-component developer.

The one-component developer thus obtained was applied to a commercially available copying machine NP-6060, manufactured by Canon Inc., and images were reproduced in an environment of room temperature and low humidity (23.5° C., 5% RH). Test results of the image reproduction are shown in Table 7. As is seen from Table 7, both the images at the initial stage and the images after running on 100,000 sheets showed a high image density, were sharp and had a high image quality. Charges on the sleeve and the amount of toner coat on the sleeve were also stable both at the initial stage and after running on 100,000 sheets.

EXAMPLE 15

A black fine powder (a magnetic toner) with a volume average particle diameter of 8.41 μm was obtained in the same manner as in Example 9 except that the modified polyester resin (11) used therein was replaced with the modified polyester resin (15). To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a magnetic toner, which was used as a one-component developer.

The one-component developer thus obtained was applied to a commercially available copying machine NP-6060, manufactured by Canon Inc., and evaluation was made in the same manner as in Example 9. As a result, as is seen from Table 7, both the images at the initial stage and the images after running on 100,000 sheets showed a high image density, were sharp and had a high image quality, and neither faulty cleaning nor adhesion of toner to the drum occurred. Charges on the sleeve and the amount of toner coat on the sleeve were also stable both at the initial stage and after running on 100,000 sheets.

EXAMPLE 16

A black fine powder (a magnetic toner) with a volume average particle diameter of 8.41 μm was obtained in the same manner as in Example 9 except that the modified polyester resin (11) used therein was replaced with the modified polyester resin (18). To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a magnetic toner, which was used as a one-component developer.

The one-component developer thus obtained was applied to a commercially available copying machine NP-6060, manufactured by Canon Inc., and evaluation was made in the same manner as in Example 9. As a result, as is seen from Table 7, the fixing performance, the number of sheet on which image stain began to occur and the anti-contamination of the cleaning web were slightly lowered, but were on the level not problematic in practical use.

COMPARATIVE EXAMPLE 5

A black fine powder (a magnetic toner) with a volume average particle diameter of 8.19 μm was obtained in the same manner as in Example 9 except that the modified polyester resin (11) used therein was replaced with the modified polyester resin (16). To 100 parts of the black fine powder thus obtained, 0.5 part of negatively chargeable hydrophobic dry-process colloidal silica (BET specific surface area: 300 $m^2/g$) was added, followed by mixing using a Henschel mixer. Thereafter, evaluation was made in the same manner as in Example 9.

Although good images were obtained at the initial stage, the image density began to decrease on around the 13,000th sheet and the following sheets during the running, and came to be 1.21 at the copying on the 15,000th sheet. The charges of the toner on the sleeve at the 15,000 sheet running were −18.9 μc/g. During the running, the faulty cleaning and the adhesion of toner to the drum occurred on around the 10,000th sheet and the following sheets.

Results of evaluation are shown in Table 7.

COMPARATIVE EXAMPLE 6

A black fine powder (a magnetic toner) with a volume average particle diameter of 8.31 μm was obtained in the same manner as in Example 9 except that the modified polyester resin (11) used therein was replaced with the modified polyester resin (17). To 100 parts of the black fine powder thus obtained, 0.5 part of negatively chargeable hydrophobic dry-process colloidal silica (BET specific surface area: 300 $m^2/g$) was added, followed by mixing using a Henschel mixer. Thereafter, evaluation was made in the same manner as in Example 9.

Although good images were obtained at the initial stage, the image density began to decrease on around the 8,000th sheet and the following sheets during the running, and came to be 1.16 at the copying on the 10,000th sheet. The charges of the toner on the sleeve at the 10,000 sheet running were −19.8 μc/g. During the running, the faulty cleaning and the adhesion of toner to the drum occurred after the 8,500th sheet and the following sheets.

Results of evaluation are shown in Table 7.

COMPARATIVE EXAMPLE 7

A black fine powder (a magnetic toner) with a volume average particle diameter of 8.27 μm was obtained in the same manner as in Example 9 except that the modified polyester resin (11) used therein was replaced with the polyester resin (C). To 100 parts of the black fine powder thus obtained, 0.5 part of negatively chargeable hydrophobic dry-process colloidal silica (BET specific surface area: 300 $m^2/g$) was added, followed by mixing using a Henschel mixer. Thereafter, evaluation was made in the same manner as in Example 9.

Although good images were obtained at the initial stage, the image density began to decrease on around the 3,000th sheet and the following sheets during the running, and came to be 1.11 at the copying on the 10,000th sheet. The charges of the toner on the sleeve at the 10,000 sheet running were −20.7 μc/g. During the running, the faulty cleaning and the adhesion of toner to the drum occurred on around the 5,000th sheet and the following sheets.

Results of evaluation are shown in Table 7.

TABLE 7

| | Test Results of Image Reproduction | | | | | | | | | | |
|---|---|---|---|---|---|---|---|---|---|---|---|
| | Example | | | | | | | | Comparative Example | | |
| | 9 | 10 | 11 | 12 | 13 | 14 | 15 | 16 | 5 | 6 | 7 |
| Initial image density: | 1.31 | 1.30 | 1.31 | 1.30 | 1.29 | 1.29 | 1.31 | 1.28 | 1.30 | 1.29 | 1.31 |
| Image density after 100,000 sh. running: | 1.33 | 1.34 | 1.33 | 1.31 | 1.34 | 1.32 | 1.32 | 1.30 | 1.21*1 | 1.16*2 | 1.11*2 |
| Initial toner charges on sleeve (μc/g): | −14.8 | −13.7 | −14.1 | −13.6 | −15.1 | −14.1 | −14.2 | −12.0 | −15.1 | −14.7 | −15.3 |
| Toner charges on sleeve after 100,000 sh. running: | −15.3 | −15.6 | −15.6 | −14.1 | −16.1 | −15.6 | −15.4 | −15.0 | −18.9*1 | −19.8*2 | −20.7*2 |
| Melt-adhesion of toner to drum: | None | None | None | None | None | None | None | None | Occur | Occur | Occur |
| Faulty cleaning: | None | None | None | None | None | None | None | None | Occur | Occur | Occur |
| Fixing performance (%): | 8.3 | 9.1 | 10.3 | 9.5 | 8.2 | 9.2 | 10.1 | 15.0 | 25.6 | 27.2 | 33.6 |
| Anti-offset properties (1): | 48 | 41 | 48 | 45 | 40 | 47 | 48 | 30 | 5 | 7 | 4 |
| Anti-offset properties (2): | None | None | None | None | None | None | None | None | Occur | Occur | Occur |
| Anit-offset properties (3): | A | AA | A | A | A | A | A | B | C | BC | C |

*1Results at 15,000 sheet running (Running was stopped on 15,000th sheet)
*2Results at 10,000 sheet running (Running was stopped on 10,000th sheet)
(1): The number of sheet on which image stain began to occur
(2): Image stain due to contamination of cleaning web
(3): Contamination of cleaning web

| Preparation of modified polyester resin (19) | |
|---|---|
| Bisphenol-A ethylene oxide adduct | 474 parts |
| Bisphenol-A propylene oxide adduct | 1,204 parts |
| Terephthalic acid | 581 parts |
| Trimellitic acid | 210 parts |
| Dodecenylsuccinic anhydride | 133 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 210° C. to carry out reaction for 5 hours. At this time, the reaction mixture had an acid value of 25.6 mg KOH/g.

Thereafter, 580 parts of a straight-chain alkyl alcohol $C_{40}H_{81}OH$ was added to further carry out reaction for 3 hours. After it cooled to room temperature, the reaction product was taken out to obtain modified polyester resin (19).

The modified polyester resin (19) had an acid value of 13.4 mg KOH/g, a hydroxyl value of 18.6 mg KOH/g and a glass transition point (Tg) of 65.1° C.

In this modified polyester resin (19), the amount of modification with the alkyl alcohol was 16% by weight based on the weight of the modified polyester resin.

| Preparation of modified polyester resin (20) | |
|---|---|
| Bisphenol-A ethylene oxide adduct | 474 parts |
| Bisphenol-A propylene oxide adduct | 1,204 parts |
| Dedecenylsuccinic anhydride | 266 parts |
| Terephthalic acid | 415 parts |
| Trimellitic acid | 294 parts |
| Adipic acid | 14.6 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 5 hours. At this time, the reaction mixture had an acid value of 21.4 mg KOH/g.

Thereafter, 960 parts of a straight-chain alkyl alcohol $C_{75}H_{151}OH$ was added to further carry out reaction for 3 hours. After it cooled to room temperature, the reaction product was taken out to obtain modified polyester resin (20).

The modified polyester resin (20) had an acid value of 11.4 mg KOH/g, a hydroxyl value of 14.6 mg KOH/g and a glass transition point (Tg) of 64.5° C.

In this modified polyester resin (20), the amount of modification with the alkyl alcohol was 23% by weight based on the weight of the modified polyester resin.

| Preparation of modified polyester resin (21) | |
|---|---|
| Bisphenol-A ethylene oxide adduct | 316 parts |
| Bisphenol-A propylene oxide adduct | 1,204 parts |
| Neopentyl glycol | 52.5 parts |
| Terephthalic acid | 664 parts |
| Trimellitic acid | 210 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 5 hours. At this time, the reaction mixture had an acid value of 23.4 mg KOH/g.

Thereafter, 460 parts of a straight-chain alkyl alcohol $C_{35}H_{71}OH$ was added to further carry out reaction for 2 hours. After it cooled to room temperature, the reaction product was taken out to obtain modified polyester resin (21).

The modified polyester resin (21) had an acid value of 10.3 mg KOH/g, a hydroxyl value of 15.2 mg KOH/g and a glass transition point (Tg) of 64.8° C.

In this modified polyester resin (21), the amount of modification with the alkyl alcohol was 14% by weight based on the weight of the modified polyester resin.

| Preparation of modified polyester resin (22) | |
|---|---|
| Bisphenol-A ethylene oxide adduct | 474 parts |
| Bisphenol-A propylene oxide adduct | 1,204 parts |
| Adipic glycol | 109.5 parts |

-continued

| Preparation of modified polyester resin (22) | |
|---|---|
| Terephthalic acid | 622.5 parts |
| Trimellitic acid | 105 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 210° C. to carry out reaction for 5 hours. At this time, the reaction mixture had an acid value of 19.4 mg KOH/g.

Thereafter, 800 parts of a straight-chain alkyl alcohol $C_{70}H_{141}OH$ was added to further carry out reaction for 3 hours. After it cooled to room temperature, the reaction product was taken out to obtain modified polyester resin (22).

The modified polyester resin (22) had an acid value of 11.4 mg KOH/g, a hydroxyl value of 12.6 mg KOH/g and a glass transition point (Tg) of 65.4° C.

In this modified polyester resin (22), the amount of modification with the alkyl alcohol was 20% by weight based on the weight of the modified polyester resin.

| Preparation of modified polyester resin (23) | |
|---|---|
| Bisphenol-A ethylene oxide adduct | 316 parts |
| Bisphenol-A propylene oxide adduct | 1,204 parts |
| Neopentyl glycol | 52.5 parts |
| Terephthalic acid | 664 parts |
| Trimellitic acid | 210 parts |
| Straight-chain alkyl alcohol $C_{35}H_{71}OH$ | 410 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 5 hours. After it cooled to room temperature, the reaction product was taken out to obtain modified polyester resin (23).

The modified polyester resin (23) had an acid value of 13.5 mg KOH/g, a hydroxyl value of 18.2 mg KOH/g and a glass transition point (Tg) of 63.8° C.

In this modified polyester resin (23), the amount of modification with the alkyl alcohol was 13% by weight based on the weight of the modified polyester resin.

| Preparation of modified polyester resin (24) | |
|---|---|
| Bisphenol-A ethylene oxide adduct | 474 parts |
| Bisphenol-A propylene oxide adduct | 1,204 parts |
| Terephthalic acid | 581 parts |
| Trimellitic acid | 210 parts |
| Dodecenylsuccinic anhydride | 133 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 210° C. to carry out reaction for 5 hours. At this time, the reaction mixture had an acid value of 25.6 mg KOH/g.

Thereafter, 235 parts of a straight-chain alkyl alcohol $C_{40}H_{81}OH$ was added to further carry out reaction for 3 hours. After it cooled to room temperature, the reaction product was taken out to obtain modified polyester resin (24).

The modified polyester resin (24) had an acid value of 17.0 mg KOH/g, a hydroxyl value of 18.6 mg KOH/g and a glass transition point (Tg) of 67° C.

In this modified polyester resin (24), the amount of modification with the alkyl alcohol was 8% by weight based on the weight of the modified polyester resin.

| Preparation of modified polyester resin (25) | |
|---|---|
| Bisphenol-A ethylene oxide adduct | 474 parts |
| Bisphenol-A propylene oxide adduct | 1,204 parts |
| Terephthalic acid | 581 parts |
| Trimellitic acid | 210 parts |
| Dodecenylsuccinic anhydride | 133 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 5 hours. At this time, the reaction mixture had an acid value of 24.6 mg KOH/g.

Thereafter, 230 parts of a straight-chain alkyl alcohol $C_{15}H_{31}OH$ was added to further carry out reaction for 2 hours. After it cooled to room temperature, the reaction product was taken out to obtain modified polyester resin (25).

The modified polyester resin (25) had an acid value of 13.1 mg KOH/g, a hydroxyl value of 15.4 mg KOH/g and a glass transition point (Tg) of 64.7° C.

In this modified polyester resin (25), the amount of modification with the alkyl alcohol was 8% by weight based on the weight of the modified polyester resin.

| Preparation of modified polyester resin (26) | |
|---|---|
| Bisphenol-A ethylene oxide adduct | 474 parts |
| Bisphenol-A propylene oxide adduct | 1,204 parts |
| Terephthalic acid | 581 parts |
| Trimellitic acid | 210 parts |
| Dodecenylsuccinic anhydride | 133 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 5 hours. At this time, the reaction mixture had an acid value of 25.1 mg KOH/g.

Thereafter, 160 parts of a straight-chain alkyl alcohol $C_{10}H_{21}OH$ was added to further carry out reaction for 2 hours. After it cooled to room temperature, the reaction product was taken out to obtain modified polyester resin (26).

The modified polyester resin (26) had an acid value of 12.3 mg KOH/g, a hydroxyl value of 13.7 mg KOH/g and a glass transition point (Tg) of 65.4° C.

In this modified polyester resin (26), the amount of modification with the alkyl alcohol was 5% by weight based on the weight of the modified polyester resin.

| Preparation of polyester resin (D) | |
|---|---|
| Bisphenol-A ethylene oxide adduct | 474 parts |
| Bisphenol-A propylene oxide addluct | 1,204 parts |
| Dodecenylsuccinic anhydride | 399 parts |
| Terephthaic acid | 464.8 parts |
| Trimellitic acid | 147 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 210° C. to carry out reaction for 6 hours. After it cooled to room temperature, the reaction product was taken out to obtain polyester resin (D).

The polyester resin (D) had an acid value of 19.2 mg KOH/g, a hydroxyl value of 17.6 mg KOH/g and a glass transition point (Tg) of 65.3° C.

Formulation and physical properties of the above modified polyester resins (19) to (26) and polyester resin (D) are summarized in Table 8.

TABLE 8

Formulation and Physical Properties of Polyester Resins

| | Modified polyester resin | | | | | | | | PER |
|---|---|---|---|---|---|---|---|---|---|
| | (19) | (20) | (21) | (22) | (23)* | (24) | (25) | (26) | (D) |
| BPA-EO Adduct (pbw): | 474 | 474 | 316 | 474 | 316 | 474 | 474 | 474 | 474 |
| BPA-PPO Adduct (pbw): | 1,204 | 1,204 | 1,204 | 1,204 | 1,204 | 1,204 | 1,204 | 1,204 | 1,204 |
| Neopentyl glycol (pbw): | — | — | 52.5 | — | 52.5 | — | — | — | — |
| Terephthalic acid (pbw): | 581 | 415 | 664 | 622.5 | 664 | 581 | 581 | 581 | 464.8 |
| Adipic acid (pbw): | — | 14.6 | — | 109.5 | — | — | — | — | — |
| Dodecenyl succinic anhydride (pbw): | 133 | 266 | — | — | — | 133 | 133 | 133 | 399 |
| Trimellitic acid (pbw): | 210 | 294 | 210 | 105 | 210 | 210 | 210 | 210 | 147 |
| Acid value of PE before modf. (mgKOH/g): | 25.6 | 21.4 | 23.4 | 19.4 | — | 24.6 | 25.1 | 25.6 | — |
| Straight-chain alkyl alcohol: | $C_{40}H_{81}OH$ | $C_{75}H_{151}OH$ | $C_{35}H_{71}OH$ | $C_{70}H_{141}OH$ | $C_{34}H_{71}OH$ | $C_{15}H_{31}OH$ | $C_{10}H_{21}OH$ | $C_{40}H_{81}OH$ | — |
| pbw: | 580 | 960 | 460 | 800 | 410 | 230 | 160 | 235 | — |
| Acid value of resin | 13.4 | 11.4 | 10.3 | 11.4 | 13.5 | 13.1 | 12.3 | 17.0 | 19.2 |

TABLE 8-continued

| | Formulation and Physical Properties of Polyester Resins | | | | | | | | |
|---|---|---|---|---|---|---|---|---|---|
| | Modified polyester resin | | | | | | | | PER |
| | (19) | (20) | (21) | (22) | (23)* | (24) | (25) | (26) | (D) |
| (mgKOH/g): | | | | | | | | | |
| Hydroxyl value of resin (mgKOH/g): | 18.6 | 14.6 | 15.2 | 12.6 | 18.2 | 15.4 | 13.7 | 18.6 | 17.6 |
| Tg of resin (°C.): | 65.1 | 64.5 | 64.8 | 65.4 | 63.8 | 64.7 | 65.4 | 67 | 65.3 |
| Amount of modification: | 16 | 23 | 14 | 20 | 13 | 8 | 8 | 5 | — |

*Linear alkyl alcohol was simultaneously added with the preparation of polyester resin.
PER: Polyester resin; BPA: Bisphenol-A; EO: Ethylene oxide; PPO: Propylene oxide

EXAMPLE 17

| | |
|---|---|
| Modified polyester resin (19) | 100 parts |
| Carbon black MOGUL-L (available from Cabot Corp.) | 5 parts |
| Negatively chargeable charge control agent | 2 parts |
| Low-molecular weight polypropylene | 3 parts |

The above materials were thoroughly mixed using a blender, and then melt-kneaded using a twin-screw extruder set at 120° C. The kneaded product thus obtained was cooled, and then crushed with a cutter mill. Thereafter the crushed product was finely pulverized by means of a fine grinding mill making use of a jet stream. Subsequently, the finely pulverized powder thus obtained was classified to obtain a black fine powder (a toner) with a volume average particle diameter of 8.31 μm.

To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a toner. The toner thus obtained and a fluorine-coated carrier (300/350 mesh) were blended to give a two-component developer.

The two-component developer thus obtained was applied to a commercially available copying machine NP-5060, manufactured by Canon Inc., and images were reproduced in an environment of room temperature and low humidity (23.5° C., 5% RH). Test results of the image reproduction are shown in Table 9. As is seen from Table 9, both the images at the initial stage and the images after running on 100,000 sheets showed a high image density, were sharp and had a high image quality, and neither faulty cleaning nor adhesion of toner to the drum occurred. Charges on the sleeve and the amount of toner coat on the sleeve were also stable both at the initial stage and after running on 100,000 sheets.

The charges of the toner layer on the sleeve, the fixing performance and the anti-offset properties were evaluated in the same manner as in Example 9.

EXAMPLE 18

A black fine powder (a toner) with a volume average particle diameter of 8.24 μm was obtained in the same manner as in Example 17 except that the modified polyester resin (19) used therein was replaced with the modified polyester resin (20). To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a toner. The toner thus obtained and a fluorine-coated carrier (300/350 mesh) were blended to give a two-component developer.

The two-component developer thus obtained was applied to a commercially available copying machine NP-5060, manufactured by Canon Inc., and evaluation was made in the same manner as in Example 17. As a result, as is seen from Table 9, both the images at the initial stage and the images after running on 100,000 sheets showed a high image density, were sharp and had a high image quality, and neither faulty cleaning nor adhesion of toner to the drum occurred. Charges on the sleeve and the amount of toner coat on the sleeve were also stable both at the initial stage and after running on 100,000 sheets.

EXAMPLE 19

| | |
|---|---|
| Modified polyester resin (21) | 100 parts |
| Carbon black #30 (available from Orient Chemical Industries Ltd.) | 5 parts |
| Negatively chargeable charge control agent | 2 parts |
| Low-molecular weight polyethylene | 3 parts |

Using the above materials, a black fine powder (a toner) with a volume average particle diameter of 8.34 μm was obtained in the same manner as in Example 17. To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a toner. The toner thus obtained and a fluorine-coated carrier (300/350 mesh) were blended to give a two-component developer.

The two-component developer thus obtained was applied to a commercially available copying machine NP-5060, manufactured by Canon Inc., and images were reproduced in an environment of room temperature and low humidity (23.5° C., 5% RH). Test results of the image reproduction are shown in Table 9. As is seen from Table 9, both the images at the initial stage and the images after running on 100,000 sheets showed a high image density, were sharp and had a high image quality, and neither faulty cleaning nor adhesion of toner to the drum occurred. Charges on the sleeve and the amount of toner coat on the sleeve were also stable both at the initial stage and after running on 100,000 sheets.

EXAMPLE 20

| | |
|---|---|
| Modified polyester resin (22) | 100 parts |
| Carbon black MOGUL-L (available from Cabot | 5 parts |

-continued

| | |
|---|---|
| Corp.) | |
| Negatively chargeable charge control agent | 2 parts |
| Low-molecular weight polyethylene | 3 parts |

Using the above materials, a black fine powder (a toner) with a volume average particle diameter of 8.15 μm was obtained in the same manner as in Example 17. To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a toner. The toner thus obtained and a fluorine-coated carrier (300/350 mesh) were blended to give a two-component developer.

The two-component developer thus obtained was applied to a commercially available copying machine NP-5060, manufactured by Canon Inc., and images were reproduced in an environment of room temperature and low humidity (23.5° C., 5% RH). Test results of the image reproduction are shown in Table 9. As is seen from Table 9, both the images at the initial stage and the images after running on 100,000 sheets showed a high image density, were sharp and had a high image quality, and neither faulty cleaning nor adhesion of toner to the drum occurred. Charges on the sleeve and the amount of toner coat on the sleeve were also stable both at the initial stage and after running on 100,000 sheets.

EXAMPLE 21

| | |
|---|---|
| Modified polyester resin (20) | 100 parts |
| Carbon black #30 (available from Orient Chemical Industries Ltd.) | 5 parts |
| Negatively chargeable charge control agent | 2 parts |

Using the above materials, a black fine powder (a toner) with a volume average particle diameter of 8.22 μm was obtained in the same manner as in Example 17. To 100 parts of the black fine powder thus obtained, 0.5 part of negatively chargeable hydrophobic dry-process colloidal silica (BET specific surface area: 300 $m^2/g$) was added followed by mixing using a Henschel mixer to give a toner. The toner thus obtained and a fluorine-coated carrier (300/350 mesh) were blended to give a two-component developer.

The two-component developer thus obtained was applied to a commercially available copying machine NP-5060, manufactured by Canon Inc., and images were reproduced in an environment of room temperature and low humidity (23.5° C., 5% RH). Test results of the image reproduction are shown in Table 9. As is seen from Table 9, both the images at the initial stage and the images after running on 100,000 sheets showed a high image density, were sharp and had a high image quality. Charges on the sleeve and the amount of toner coat on the sleeve were also stable both at the initial stage and after running on 100,000 sheets.

EXAMPLE 22

| | |
|---|---|
| Modified polyester resin (22) | 100 parts |
| Carbon black MOGUL-L (available from Cabot Corp.) | 5 parts |
| Negatively chargeable charge control agent | 2 parts |

Using the above materials, a black fine powder (a toner) with a volume average particle diameter of 8.37 μm was obtained in the same manner as in Example 17. To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a toner. The toner thus obtained and a fluorine-coated carrier (300/350 mesh) were blended to give a two-component developer.

The two-component developer thus obtained was applied to a commercially available copying machine NP-5060, manufactured by Canon Inc., and images were reproduced in an environment of room temperature and low humidity (23.5° C., 5% RH). Test results of the image reproduction are shown in Table 9. As is seen from Table 9, both the images at the initial stage and the images after running on 100,000 sheets showed a high image density, were sharp and had a high image quality. Charges on the sleeve and the amount of toner coat on the sleeve were also stable both at the initial stage and after running on 100,000 sheets.

EXAMPLE 23

A black fine powder (a toner) with a volume average particle diameter of 8.28 μm was obtained in the same manner as in Example 17 except that the modified polyester resin (19) used therein was replaced with the modified polyester resin (23). To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a toner. The toner thus obtained and a fluorine-coated carrier (300/350 mesh) were blended to give a two-component developer.

The two-component developer thus obtained was applied to a commercially available copying machine NP-5060, manufactured by Canon Inc., and evaluation was made in the same manner as in Example 17. As a result, as is seen from Table 9, both the images at the initial stage and the images after running on 100,000 sheets showed a high image density, were sharp and had a high image quality, and neither faulty cleaning nor adhesion of toner to the drum occurred. Charges on the sleeve and the amount of toner coat on the sleeve were also stable both at the initial stage and after running on 100,000 sheets.

EXAMPLE 24

A black fine powder (a toner) with a volume average particle diameter of 8.28 μm was obtained in the same manner as in Example 17 except that the modified polyester resin (19) used therein was replaced with the modified polyester resin (26). To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a toner. The toner thus obtained and a fluorine-coated carrier (300/350 mesh) were blended to give a two-component developer.

The two-component developer thus obtained was applied to a commercially available copying machine NP-5060, manufactured by Canon Inc., and evaluation was made in the same manner as in Example 17. As a result, as is seen from Table 9, the fixing performance, the number of sheets on which image stain began to occur and the anti-contamination of the cleaning web were slightly lowered, but were on the level not problematic in practical use.

COMPARATIVE EXAMPLE 8

A black fine powder (a toner) with a volume average particle diameter of 8.24 μm was obtained in the same manner as in Example 17 except that the modified polyester resin (19) used therein was replaced with the modified polyester resin (24). To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a toner. The toner thus obtained and a fluorine-coated carrier (300/350 mesh) were blended to give a two-component developer. Using this two-component developer, evaluation was made in the same manner as in Example 17.

Although good images were obtained at the initial stage, the image density began to decrease on around the 8,000th sheet and the following sheets during the running, and came to be 1.19 at the copying on the 10,000th sheet. The charges of the toner on the sleeve at the 10,000 sheet running were −20.5 μc/g. During the running, the faulty cleaning and the adhesion of toner to the drum occurred on around the 8,500th sheet and the following sheets.

Results of evaluation are shown in Table 9.

COMPARATIVE EXAMPLE 9

A black fine powder (a toner) with a volume average particle diameter of 8.29 μm was obtained in the same manner as in Example 17 except that the modified polyester resin (19) used therein was replaced with the modified polyester resin (25). To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a toner. The toner thus obtained and a fluorine-coated carrier (300/350 mesh) were blended to give a two-component developer. Using this two-component developer, evaluation was made in the same manner as in Example 17.

Although good images were obtained at the initial stage, the image density began to decrease on around the 6,500th sheet and the following sheets during the running, and came to be 1.17 at the copying on the 8,000th sheet. The charges of the toner on the sleeve at the 8,000 sheet running were −21.4 μc/g. During the running, the faulty cleaning and the adhesion of toner to the drum occurred on around the 7,000th sheet and the following sheets.

Results of evaluation are shown in Table 9.

COMPARATIVE EXAMPLE 10

A black fine powder (a toner) with a volume average particle diameter of 8.32 μm was obtained in the same manner as in Example 17 except that the modified polyester resin (19) used therein was replaced with the polyester resin (D). To 100 parts of the black fine powder thus obtained, 0.5 part of negatively chargeable hydrophobic dry-process colloidal silica (BET specific surface area: 300 $m^2/g$) was added, followed by mixing using a Henschel mixer to give a toner. The toner thus obtained and a fluorine-coated carrier (300/350 mesh) were blended to give a two-component developer. Using this two-component developer, evaluation was made in the same manner as in Example 17.

Although good images were obtained at the initial stage, the image density began to decrease on around the 4,000th sheet and the following sheets during the running, and came to be 1.15 at the copying on the 5,000th sheet. The charges of the toner on the sleeve at the 5,000 sheet running were −20.8 μc/g. During the running, the faulty cleaning and the adhesion of toner to the drum occurred on around the 4,000th sheet and the following sheets.

Results of evaluation are shown in Table 9.

TABLE 9

Test Results of Image Reproduction

| | Example | | | | | | | | Comparative Example | | |
|---|---|---|---|---|---|---|---|---|---|---|---|
| | 18 | 18 | 19 | 20 | 21 | 22 | 23 | 24 | 8 | 9 | 10 |
| Initial image density: | 1.31 | 1.32 | 1.30 | 1.32 | 1.30 | 1.31 | 1.30 | 1.27 | 1.30 | 1.31 | 1.29 |
| Image density after 100,000 sh. running: | 1.33 | 1.33 | 1.31 | 1.34 | 1.32 | 1.34 | 1.31 | 1.30 | 1.19*1 | 1.17*2 | 1.15*3 |
| Initial toner charges on sleeve (μc/g): | −14.1 | −15.4 | −15.1 | −14.7 | −15.1 | −13.9 | −14.7 | −13.7 | −15.1 | −15.7 | −14.8 |
| Toner charges on sleeve after 100,000 sh. running: | −15.2 | −16.1 | −15.7 | −15.1 | −15.3 | −15.1 | −16.3 | −14.8 | −20.5*1 | −21.4*2 | −20.8*3 |
| Melt-adhesion of toner to drum: | None | None | None | None | None | None | None | None | Occur | Occur | Occur |
| Faulty cleaning: | None | None | None | None | None | None | None | None | Occur | Occur | Occur |
| Fixing performance (%): | 9.4 | 10.1 | 8.8 | 11.4 | 10.4 | 9.8 | 10.8 | 15.0 | 23.5 | 27.6 | 35.1 |
| Anti-offset properties (1): | 48 | 47 | 48 | 41 | 44 | 46 | 47 | 32 | 8 | 5 | 4 |
| Anit-offset properties (2): | None | None | None | None | None | None | None | None | Occur | Occur | Occur |
| Anti-offset properties (3): | A | A | A | A | A | A | A | B | C | BC | C |

*1: Results at 10,000 sheet running (Running was stopped on 10,000th sheet)
*2: Results at 8,000 sheet running (Running was stopped on 8,000th sheet)
*3: Results at 5,000 sheet running (Running was stopped on 5,000th sheet)
(1): The number of sheet on which image stain began to occur
(2): Imgage stain due to contamination of cleaning web
(3): Contamination of cleaning web

| Preparation of modifying compound A | |
|---|---|
| $CH_3(CH_2)_{50}OH$ | 732 parts |
| Propylene oxide | 290 parts |

The above materials were reacted under conditions of a pressure of $1.72\times10^5$ Pa and a temperature of 140° C. in the presence of sodium ethoxide. After 20 minute's reaction time, the reaction product was taken out. This was designated as modifying compound A.

| Preparation of modifying compound B | |
|---|---|
| $CH_3(CH_2)_{55}OH$ | 802 parts |
| Ethylene oxide | 264 parts |

The above materials were reacted under conditions of a pressure of $1.38\times10^5$ Pa and a temperature of 170° C. in the presence of sodium ethoxide. After 40 minute's reaction time, the reaction product was taken out. This was designated as modifying compound B.

| Preparation of modifying compound C | |
|---|---|
| $CH_3(CH_2)_{35}OH$ | 522 parts |
| n-Butylglycidyl ether | 300 parts |

The above materials were reacted under conditions of a pressure of $2.41\times10^5$ Pa and a temperature of 160° C. in the presence of sodium hydroxide. After 60 minute's reaction time, the reaction product was taken out. This was designated as modifying compound C.

| Preparation of modifying compound D | |
|---|---|
| $CH_3(CH_2)_{70}OH$ | 1,012 parts |
| Phenylglycidyl ether | 450 parts |

The above materials were reacted under conditions of a pressure of $2.07\times10^5$ Pa and a temperature of 170° C. in the presence of sodium hydroxide. After 30 minute's reaction time, the reaction product was taken out. This was designated as modifying compound D.

| Preparation of modifying compound E | |
|---|---|
| $CH_3(CH_2)_{17}OH$ | 270 parts |
| n-Butylglycidyl ether | 195 parts |

The above materials were reacted under conditions of a pressure of 2.07×10 Pa and a temperature of 150° C. in the presence of sodium ethoxide. After 30 minute's reaction time, the reaction product was taken out. This was designated as modifying compound E.

| Preparation of modified polyester resin (27) | |
|---|---|
| Bisphenol-A ethylene oxide adduct | 632 parts |
| Bisphenol-A propylene oxide adduct | 1,032 parts |
| Terephthalic acid | 581 parts |
| Trimellitic acid | 315 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 4 hours.

Thereafter, 500 parts of the modifying compound A was added to further carry out reaction for 1.5 hours. After cooled to room temperature, the reaction product was taken out to obtain modified polyester resin (27).

The modified polyester resin (27) had an acid value of 16.8 mg KOH/g, a hydroxyl value of 16.1 mg KOH/g and a glass transition point (Tg) of 59.3° C.

In this modified polyester resin (27), the amount of modification with the modifying compound A was 15% by weight based on the weight of the modified polyester resin.

Preparation of Modified Polyester Resin (28)

Modified polyester resin (28) was prepared in the same manner as the preparation of modified polyester resin (27) except that the modifying compound A used in the preparation of the modified polyester resin (27) was replaced with 400 parts of the modifying compound B.

The modified polyester resin (28) obtained had an acid value of 17.4 mg KOH/g, a hydroxyl value of 15.3 mg KOH/g and a glass transition point (Tg) of 58.7° C.

In this modified polyester resin (28), the amount of modification with the modifying compound B was 12% by weight based on the weight of the modified polyester resin.

Preparation of Modified Polyester Resin (29)

Modified polyester resin (29) was prepared in the same manner as the preparation of modified polyester resin (27) except that the modifying compound A used in the preparation of the modified polyester resin (27) was replaced with 450 parts of the modifying compound C.

The modified polyester resin (29) obtained had an acid value of 18.4 mg KOH/g, a hydroxyl value of 16.3 mg KOH/g and a glass transition point (Tg) of 59.4° C.

In this modified polyester resin (29), the amount of modification with the modifying compound C was 14% by weight based on the weight of the modified polyester resin.

Preparation of Modified Polyester Resin (30)

Modified polyester resin (30) was prepared in the same manner as the preparation of modified polyester resin (27) except that the modifying compound A used in the preparation of the modified polyester resin (27) was replaced with 400 parts of the modifying compound D.

The modified polyester resin (30) obtained had an acid value of 15.7 mg KOH/g, a hydroxyl value of 14.3 mg KOH/g and a glass transition point (Tg) of 60.2° C.

In this modified polyester resin (30), the amount of modification with the modifying compound D was 12% by weight based on the weight of the modified polyester resin.

Preparation of Modified Polyester Resin (31)

Modified polyester resin (31) was prepared in the same manner as the preparation of modified polyester resin (27) except that the modifying compound A used in the preparation of the modified polyester resin (27) was replaced with 400 parts of the modifying compound E.

The modified polyester resin (31) obtained had an acid value of 17.1 mg KOH/g, a hydroxyl value of 15.8 mg KOH/g and a glass transition point (Tg) of 59.7° C.

In this modified polyester resin (31), the amount of modification with the modifying compound E was 12% by weight based on the weight of the modified polyester resin.

| Preparation of modified polyester resin (32) | |
|---|---|
| Bisphenol-A ethylene oxide adduct | 632 parts |
| Bisphenol-A propylene oxide adduct | 1,032 parts |
| Terephthalic acid | 581 parts |

-continued

| Preparation of modified polyester resin (32) | |
|---|---|
| Trimellitic acid | 315 parts |
| Modifying compound A | 350 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 5 hours. Thus, modified polyester resin (32) was obtained. The modified polyester resin (32) thus obtained had an acid value of 16.4 mg KOH/g, a hydroxyl value of 15.7 mg KOH/g and a glass transition point (Tg) of 59.7° C.

In this modified polyester resin (32), the amount of modification with the modifying compound A was 11% by weight based on the weight of the modified polyester resin.

| Preparation of polyester resin (E) | |
|---|---|
| Bisphenol-A ethylene oxide adduct | 632 parts |
| Bisphenol-A propylene oxide adduct | 1,032 parts |
| Terephthalic acid | 581 parts |
| Trimellitic acid | 315 parts |

The above materials were charged into a four-necked flask, to which a stirrer, a condenser, a thermometer and a gas feed pipe were provided, and were put in a mantle heater. After the inside of the reactor was substituted with nitrogen gas, the contents were heated to a temperature of 200° C. to carry out reaction for 4 hours. Thus, polyester resin (E) was obtained. The polyester resin (E) thus obtained had an acid value of 25.4 mg KOH/g, a hydroxyl value of 20.7 mg KOH/g and a glass transition point (Tg) of 61.5° C.

EXAMPLE 25

| | |
|---|---|
| Modified polyester resin (27) | 100 parts |
| Magnetic iron oxide | 90 parts |
| Negatively chargeable charge control agent | 2 parts |
| Low-molecular weight polypropylene | 3 parts |

The above materials were thoroughly mixed using a blender, and then melt-kneaded using a twin-screw extruder set at 110° C. The kneaded product thus obtained was cooled, and then crushed with a cutter mill. Thereafter the crushed product was finely pulverized by means of a fine grinding mill making use of a jet stream. Subsequently, the finely pulverized powder thus obtained was classified to obtain a black fine powder (a magnetic toner) with a volume average particle diameter of 8.17 μm.

To 100 parts of the black fine powder thus obtained, 0.6 part of negatively chargeable hydrophobic dry-process colloidal silica (BET specific surface area: 300 $m^2/g$) was added, followed by mixing using a Henschel mixer to give a magnetic toner, which was used as a one-component developer.

The one-component developer thus obtained was applied to a commercially available copying machine NP-6060, manufactured by Canon Inc., and images were reproduced in an environment of room temperature and low humidity (23.5° C., 5% RH). Test results of the image reproduction are shown in Table 10. As is seen from Table 10, both the images at the initial stage and the images after running on 30,000 sheets showed a high image density and were good image. Charges on the sleeve were also stable both at the initial stage and after running on 30,000 sheets, and neither faulty cleaning nor adhesion of toner to the drum occurred during the image reproduction running. Good results were also obtained on both the fixing performance and the anti-offset properties.

Charges (quantity of electricity) of the toner layer per unit area on the sleeve were determined by what is called the vacuum Faraday cage method. This vacuum Faraday cage method is a method in which an outer cylinder of a cage is pressed against the toner carrying member and all the toner in a given area on the toner carrying member is vacuumed up, where the charges accumulated in an inner cylinder electrically shielded from the outside are simultaneously measured to thereby determine the charges of the toner layer on the toner carrying member.

In the present invention, fixing performance and anti-offset properties were evaluated in the following way:

With regard to the fixing performance, the machine for evaluation was left to stand overnight in an environment of low temperature and low humidity (15° C., 10% RH) until the machine and its inside fixing assembly completely adapted themselves to the environment of low temperature and low humidity. Under this condition, image reproduction was started to continuously take copies on 200 sheets, and a copied image on the 200th sheet was used as a standard for the evaluation of fixing performance. To evaluate the fixing performance, images were rubbed 10 times using Silbon paper under a load of about 100 g to examine any separation of the images, which was evaluated as the rate (%) of decrease in reflection density.

Thus, the larger value the rate of decrease in reflection density (or the rate of decrease in image density) shows immediately after an image was rubbed, the more the percentage of separation of the image is, showing a poor fixing performance of the toner.

Anti-offset properties were evaluated on the basis of whether the toner once wiped off with a cleaning web was transferred to the upper roller to contaminate copied images when copies were continuously taken. As a method for the evaluation, copies were continuously taken on 200 sheets in an environment of low temperature and low humidity (15° C., 10% RH). Thereafter, copies were taken sheet by sheet for up to 3 minutes at intervals of 30 seconds to examine whether or not the images were stained. Here, an instance where no image was stained, the anti-offset properties of the toner was evaluated as good ("A").

The state of any contamination of the cleaning web of the fixing rollers was also evaluated.

EXAMPLE 26

A black fine powder (a magnetic toner) with a volume average particle diameter of 8.04 μm was obtained in the same manner as in Example 25 except that the modified polyester resin (27) used therein was replaced with the modified polyester resin (28). To 100 parts of the black fine powder thus obtained, 0.6 part of negatively chargeable hydrophobic dry-process colloidal silica (BET specific surface area: 300 $m^2/g$) was added, followed by mixing using a Henschel mixer to give a magnetic toner, which was used as a one-component developer.

The one-component developer thus obtained was applied to a commercially available copying machine NP-6060, manufactured by Canon Inc., and evaluation was made in the same manner as in Example 25. As a result, as is seen from Table 10, both the images at the initial stage and the images after running on 30,000 sheets showed a high image density and were good image. Charges on the sleeve were also stable both at the initial stage and after running on 30,000 sheets, and neither faulty cleaning nor adhesion of toner to the drum occurred during the image reproduction running. Good results were also obtained on both the fixing performance and the anti-offset properties.

EXAMPLE 27

A black fine powder (a magnetic toner) with a volume average particle diameter of 6.07 μm was obtained in the same manner as in Example 25 except that the modified polyester resin (27) used therein was replaced with the modified polyester resin (29). To 100 parts of the black fine powder thus obtained, 0.6 part of negatively chargeable hydrophobic dry-process colloidal silica (BET specific surface area: 300 $m^2/g$) was added, followed by mixing using a Henschel mixer to give a magnetic toner, which was used as a one-component developer.

The one-component developer thus obtained was applied to a commercially available copying machine NP-6060, manufactured by Canon Inc., and evaluation was made in the same manner as in Example 25. As a result, as is seen from Table 10, both the images at the initial stage and the images after running on 30,000 sheets showed a high image density and were good image. Charges on the sleeve were also stable both at the initial stage and after running on 30,000 sheets, and neither faulty cleaning nor adhesion of toner to the drum occurred during the image reproduction running. Good results were also obtained on both the fixing performance and the anti-offset properties.

EXAMPLE 28

A black fine powder (a magnetic toner) with a volume average particle diameter of 6.28 μm was obtained in the same manner as in Example 25 except that the modified polyester resin (27) used therein was replaced with the modified polyester resin (30). To 100 parts of the black fine powder thus obtained, 0.6 part of negatively chargeable hydrophobic dry-process colloidal silica (BET specific surface area: 300 $m^2/g$) was added, followed by mixing using a Henschel mixer to give a magnetic toner, which was used as a one-component developer.

The one-component developer thus obtained was applied to a commercially available copying machine NP-6060, manufactured by Canon Inc., and evaluation was made in the same manner as in Example 25. As a result, as is seen from Table 10, both the images at the initial stage and the images after running on 30,000 sheets showed a high image density and were good image. Charges on the sleeve were also stable both at the initial stage and after running on 30,000 sheets, and neither faulty cleaning nor adhesion of toner to the drum occurred during the image reproduction running. Good results were also obtained on both the fixing performance and the anti-offset properties.

EXAMPLE 29

| | |
|---|---|
| Modified polyester resin (32) | 100 parts |
| Magnetic iron oxide | 90 parts |
| Negatively chargeable charge control agent | 2 parts |
| Low-molecular weight polyethylene | 3 parts |

Using the above materials, a black fine powder (a magnetic toner) with a volume average particle diameter of 5.94 μm was obtained in the same manner as in Example 25. To 100 parts of the black fine powder thus obtained, 0.6 part of negatively chargeable hydrophobic dry-process colloidal silica (BET specific surface area: 300 $m^2/g$) was added, followed by mixing using a Henschel mixer to give a magnetic toner, which was used as a one-component developer.

Using the one-component developer thus obtained, evaluation was made in the same manner as in Example 25. As a result, as is seen from Table 10, both the images at the initial stage and the images after running on 30,000 sheets showed a high image density and were good image. Charges on the sleeve were also stable both at the initial stage and after running on 30,000 sheets, and neither faulty cleaning nor adhesion of toner to the drum occurred during the image reproduction running. Good results were also obtained on both the fixing performance and the anti-offset properties.

EXAMPLE 30

| | |
|---|---|
| Modified polyester resin (27) | 100 parts |
| Magnetic iron oxide | 90 parts |
| Negatively chargeable charge control agent | 2 parts |

Using the above materials, a black fine powder (a magnetic toner) with a volume average particle diameter of 6.21 μm was obtained in the same manner as in Example 25. To 100 parts of the black fine powder thus obtained, 0.6 part of negatively chargeable hydrophobic dry-process colloidal silica (BET specific surface area: 300 $m^2/g$) was added, followed by mixing using a Henschel mixer to give a magnetic toner, which was used as a one-component developer.

The one-component developer thus obtained was applied to a commercially available copying machine NP-6060, manufactured by Canon Inc., and evaluation was made in the same manner as in Example 25. As a result, as is seen from Table 10, both the images at the initial stage and the images after running on 30,000 sheets showed a high image density and were good image. Charges on the sleeve were also stable both at the initial stage and after running on 30,000 sheets, and neither faulty cleaning nor adhesion of toner to the drum occurred during the image reproduction running. Good results were also obtained on both the fixing performance and the anti-offset properties.

COMPARATIVE EXAMPLE 11

| | |
|---|---|
| Polyester resin (E) | 100 parts |
| Magnetic iron oxide | 90 parts |
| Negatively chargeable charge control agent | 2 parts |
| Low-molecular weight polypropylene | 3 parts |

Using the above materials, a black fine powder (a magnetic toner) with a volume average particle diameter of 8.04 μm was obtained in the same manner as in Example 25. To 100 parts of the black fine powder thus obtained, 0.6 part of negatively chargeable hydrophobic dry-process colloidal silica (BET specific surface area: 300 $m^2/g$) was added, followed by mixing using a Henschel mixer to give a magnetic toner, which was used as a one-component developer.

Using the one-component developer thus obtained, evaluation was made in the same manner as in Example 25. Although good images were obtained at the initial stage, the image density began to decrease as copies were continuously taken. Since it came to be 1.11 at the copying on the 7,500th sheet, running was stopped at the copying on the 7,500th sheet. During the running, the charges of the toner on the sleeve at the 7,500 sheet running were −21.4 μc/g. During the running of image reproduction, the faulty cleaning occurred on around the 7,300th sheet and the following sheets. With regard to the fixing performance, the image density decreased by 25.1%, which was a rate at a poor level. With regard to the anti-offset properties, image stain due to contamination of the web occurred.

Results of evaluation are shown in Table 10.

COMPARATIVE EXAMPLE 12

A black fine powder (a magnetic toner) with a volume average particle diameter of 6.34 μm was obtained using the same materials as those in Comparative Example 11 and in the same manner as in Comparative Example 11. To 100 parts of the black fine powder thus obtained, 0.6 part of negatively chargeable hydrophobic dry-process colloidal silica (BET specific surface area: 300 $m^2/g$) was added, followed by mixing using a Henschel mixer to give a magnetic toner, which was used as a one-component developer.

Using the one-component developer thus obtained, evaluation was made in the same manner as in Example 25. Although good images were obtained at the initial stage, the image density began to decrease as copies were continuously taken. Since it came to be 1.07 at the copying on the 4,500th sheet, running was stopped at the copying on the 4,500th sheet. During the running, the charges of the toner on the sleeve at the 4,500 sheet running were −20.7 μc/g. During the running of image reproduction, the faulty cleaning occurred on around the 4,100th sheet and the following sheets, and the adhesion of toner to the drum occurred on around the 4,300th sheet and the following sheets. With regard to the fixing performance, the image density decreased by 24.7%, which was a rate at a poor level. With regard to the anti-offset properties, image stain due to contamination of the web occurred.

Results of evaluation are shown in Table 10.

COMPARATIVE EXAMPLE 13

A black fine powder (a magnetic toner) with a volume average particle diameter of 8.17 μm was obtained in the same manner as in Comparative Example 11 except that the polyester resin (E) was replaced with the modified polyester resin (31). To 100 parts of the black fine powder thus obtained, 0.6 part of negatively chargeable hydrophobic dry-process colloidal silica (BET specific surface area: 300 $m^2/g$) was added, followed by mixing using a Henschel mixer to give a magnetic toner, which was used as a one-component developer.

Using the one-component developer thus obtained, evaluation was made in the same manner as in Comparative Example 11. Although good images were obtained at the initial stage, the image density began to decrease as copies were continuously taken. Since it came to be 1.09 at the copying on the 7,000th sheet, running was stopped at the copying on the 7,000th sheet. During the running, the charges of the toner on the sleeve at the 7,000 sheet running were −20.4 μc/g. During the running of image reproduction, the faulty cleaning occurred on around the 6,700th sheet and the following sheets. With regard to the fixing performance, the image density decreased by 23.7%, which was a rate at a poor level. With regard to the anti-offset properties, image stain due to contamination of the web occurred.

Results of evaluation are shown in Table 10.

COMPARATIVE EXAMPLE 14

A black fine powder (a magnetic toner) with a volume average particle diameter of 6.04 μm was obtained using the same materials as those in Comparative Example 13 and in the same manner as in Comparative Example 13. To 100 parts of the black fine powder thus obtained, 0.6 part of negatively chargeable hydrophobic dry-process colloidal silica (BET specific surface area: 300 $m^2/g$) was added, followed by mixing using a Henschel mixer. Thereafter, evaluation was made in the same manner as in Comparative Example 13. Although good images were obtained at the initial stage, the image density began to decrease as copies were continuously taken. Since it came to be 1.12 at the copying on the 4,000th sheet, running was stopped at the copying on the 4,000th sheet. During the running, the charges of the toner on the sleeve at the 4,000 sheet running were −20.3 μc/g. During the running, the faulty cleaning occurred on around the 3,700th sheet and the following sheets, and the adhesion of toner to the drum occurred on around the 3,900th sheet and the following sheets. With regard to the fixing performance, the image density decreased by 22.4%, which was a rate at a poor level. With regard to the anti-offset properties, image stain due to contamination of the web occurred.

Results of evaluation are shown in Table 10.

TABLE 10

| | Test Results of Image Reproduction | | | | | | | | | |
|---|---|---|---|---|---|---|---|---|---|---|
| | Example | | | | | | Comparative Example | | | |
| | 25 | 26 | 27 | 28 | 29 | 30 | 11 | 12 | 13 | 14 |
| Initial image density: | 1.28 | 1.25 | 1.27 | 1.28 | 1.26 | 1.28 | 1.28 | 1.27 | 1.28 | 1.29 |
| Image density after 30,000 sh. running: | 1.31 | 1.29 | 1.30 | 1.31 | 1.30 | 1.29 | 1.11*[1] | 1.07*[2] | 1.09*[3] | 1.12*[4] |
| Initial toner charges on sleeve (μc/g): | −14.2 | −12.8 | −13.2 | −14.7 | −13.8 | −12.9 | −16.7 | −16.3 | −15.8 | −15.4 |
| Toner charges on sleeve after 30,000 sh. running: | −15.3 | −14.6 | −14.4 | −15.2 | −15.2 | −14.6 | −21.4*[1] | −20.7*[2] | −20.4*[3] | −20.3*[4] |
| Melt-adhesion of toner to drum: | None | None | None | None | None | None | None | Occur 4,300* | None | Occur 3,900* |

TABLE 10-continued

| | Test Results of Image Reproduction | | | | | | | | | |
|---|---|---|---|---|---|---|---|---|---|---|
| | Example | | | | | | Comparative Example | | | |
| | 25 | 26 | 27 | 28 | 29 | 30 | 11 | 12 | 13 | 14 |
| Faulty cleaning: | None | None | None | None | None | None | Occur 7,300* | Occur 4,100* | Occur 6,700* | Occur 3,700* |
| Fixing performance (%):(1) | 6.2 | 5.1 | 8.7 | 7.2 | 8.9 | 8.3 | 25.1 | 24.7 | 23.7 | 22.4 |
| Anti-offset properties(2) | A | A | A | A | A | A | C | C | C | C |
| | None | None | None | None | None | None | Occur | Occur | Occur | Occur |

*1: Results at 7,500 sheet running
*2: Results at 4,500 sheet running
*3: Results at 7,000 sheet running
*4: Results at 4,000 sheet running
*The number of sheet on which it occurred.
(1): Rate of decrease in image density
(2): Image stain due to contamination of cleaning web

| Preparation of modified polyester resin (33) | |
|---|---|
| Bisphenol derivative represented by formula (I) (R is propylene) | 360 parts |
| Terephthalic acid | 100 parts |
| Adipic acid | 55 parts |
| Alky monocarboxylic acid represented by formula (5) (y = 48; Mw/Mn = 2.0) | 100 parts |
| Polyethylene | 20 parts |
| Stannous oxide | 0.5 part |

The above materials were charged into a 5 liter four-necked flask, to which a reflux condenser, a water separator, a nitrogen gas feed pipe, a thermometer and a stirrer were provided. While nitrogen was fed into the flask, condensation polymerization reaction was carried out at 220° C. to obtain modified polyester resin (33) with Mn of 6,000, Mw of 11,000 and Tg of 59° C.

In this modified polyester resin (33), the amount of modification with the alkyl monocarboxylic acid was 14% by weight based on the weight of the modified polyester resin.

Physical properties of the modified polyester resin (33) are shown in Table 11.

Preparation of Modified Polyester Resins (34) to (40)

Modified polyester resins (34) to (40) having physical properties as shown in Table 1 were obtained similarly but changing as shown in Table 11 the composition and molecular weight of the alkyl monocarboxylic acid used in the preparation of modified polyester resin (33) and those of the polyester resin.

| Preparation of modified polyester resin (41) | |
|---|---|
| Bisphenol derivative represented by formula (I) (R is propylene) | 360 parts |
| Terephthalic acid | 100 parts |
| Fumaric acid | 40 parts |
| Stannous oxide | 0.5 part |

Using the above materials, the reaction was carried out in the same manner as the preparation of modified polyester resin (33) to obtain polyester resin (F) with Mn of 5,000, Mw of 10,000, Tg of 65° C., an acid value of 20 and a hydroxyl value of 35.

| | |
|---|---|
| Polyester resin (F) | 100 parts |
| Alkyl monocarboxylic acid represented by formula (5) (y = 48; Mw/Mn = 2.0) | 30 parts |
| Stannous oxide | 0.5 part |

The above materials were charged into the apparatus as that used in the preparation of modified polyester resin (33). While nitrogen was fed into the flask, modification reaction was carried out at 200° C. to obtain modified polyester resin (41) with Mn of 6,000, Mw of 12,000 and Tg of 58° C.

In this modified polyester resin (41), the amount of modification with the alkyl monocarboxylic acid was 20% by weight based on the weight of the modified polyester resin.

Physical properties of this modified polyester resin (41) are shown in Table 11.

TABLE 11

| Alkyl Monocarboxylic Acid-modified Resin | | | | | | |
|---|---|---|---|---|---|---|
| Resin | Monocarboxylic acid | | Alkyl monocarboxylic acid-modified resin | | | |
| No. | y | Mw/Mn | Mn | Mw | Tg (°C.) | (*) |
| (33) | 48 | 2.0 | 6,000 | 11,000 | 59 | 14 |
| (34) | 25 | 1.1 | 5,000 | 10,000 | 52 | 14 |
| (35) | 95 | 4.5 | 7,500 | 16,000 | 68 | 14 |
| (36) | 50 | 3.0 | 5,500 | 14,000 | 60 | 14 |
| (37) | 30 | 1.3 | 4,000 | 9,000 | 35 | 14 |
| (38) | 45 | 1.5 | 5,000 | 9,500 | 45 | 14 |
| (39) | 18 | 1.2 | 4,000 | 10,000 | 50 | 14 |
| (40) | 120 | 4.0 | 7,000 | 15,000 | 70 | 14 |
| (41) | 48 | 2.0 | 6,000 | 12,000 | 58 | 20 |

(*): Amount of modification with alkyl monocarboxylic acid (wt. %)

| Preparation of polyester resin (G) | |
|---|---|
| Bisphenol derivatives represented by formula (I) | |
| (R is ethylene; x + y = 2.2) | 17 mol % |
| (R is propylene; x + y = 2.2) | 34 mol % |
| Terephthalic acid | 15 mol % |
| Fumaric acid | 22 mol % |
| Trimellitic acid | 12 mol % |

100 parts of the above materials and 0.1 part of stannous oxide were charged into a 5 liter four-necked flask, to which a reflux condenser, a nitrogen gas feed pipe, a thermometer and a stirrer were provided. While nitrogen was fed into the flask, condensation polymerization reaction was carried out at 220° C. to obtain polyester resin (G) with Mn of 3,800, Mw of 16,000, Tg of 62° C., an acid value of 9.0 and an OH value of 18.

EXAMPLE 31

| | |
|---|---|
| Modified polyester resin (33) | 100 parts |
| Magnetic iron oxide (average particle diameter: 0.15 μm; Hc: 115 oersted; σs: 80 emu/g; σr: 11 emu/g) | 80 parts |
| Monoazo complex (negative charge control agent) | 2 parts |

The above materials were thoroughly premixed using a Henschel mixer, and then melt-kneaded using a twin-screw extruder at 130° C. The kneaded product thus obtained was cooled, and then crushed with a cutter mill. Thereafter the crushed product was finely pulverized by means of a fine grinding mill making use of a jet stream. Subsequently, the finely pulverized powder thus obtained was classified using an air classifier to obtain a black fine powder (a magnetic toner) with a volume average particle diameter of 8.0 μm. To 100 parts of the black fine powder thus obtained, 0.6 part of hydrophobic silica (BET specific surface area: 150 $m^2/g$) was externally added using a Henschel mixer to give a magnetic toner, which was used as a one-component developer.

Using the one-component developer thus obtained, unfixed images were obtained using a copying machine NP-6060, manufactured by Canon Inc., and were then fixed using a fixing assembly having the same construction as that of NP-6060 to carry out a fixing test. As a result, the fixing was possible in a fixing temperature range of from 130° to 240° C.

Using also the one-component developer, images were reproduced using a modified machine of a laser copying machine NP-9330, manufactured by Canon Inc., to make evaluation, which was so modified as to have a system in which its photosensitive drum was changed to an OPC photosensitive drum, latent images were formed by a laser after it was electrostatically charged by means of a negative corona assembly, and reversal development was carried out. As a result, none of white-ground fog and blank areas caused by poor transfer occurred, and good density gradation was obtained even in copies of photographic images with lettering. In the relationship between development potential and image density, substantially satisfactory linearity was obtained.

A 20,000 sheet copying test was also carried out. As a result, copied images showed good image quality almost not different from the above initial images, and good results were also obtained on the fixing performance. Moreover, neither adhesion of toner to the photosensitive drum nor faulty cleaning occurred at all.

The copying test was also carried out in environments of low temperature and low humidity (5° C., 10% RH) and high temperature and high humidity (30° C., 80% RH). As a result, the same good results as those at the initial stage were obtained throughout the test. In the environment of high temperature and high humidity, the test was carried out after the developer was left to stand for a long term (left for a week), but no decrease in density occurred and good results were obtained.

The developer was also left to stand at 50° C. for a week to examine its storage stability to find that no blocking occurred to retain a good fluidity.

In the developing assembly of the above copying machine, its charge corona assembly was replaced with a contact charging roller to electrostatically charge the photosensitive drum and also its transfer corona assembly was replaced with a contact transfer roller to transfer the toner images to recording mediums, where any contamination of the contact transfer roller and blank areas caused by poor transfer were examined to make evaluation.

Results of evaluation are shown in Table 13.

EXAMPLES 32 TO 37, COMPARATIVE EXAMPLES 15 TO 17

One-component developers were prepared in the same manner as in Example 31 except that the magnetic toner was prepared according to the formulation changed as shown in Table 12. Images were reproduced and evaluation was made similarly.

Results of evaluation are shown in Table 13.

TABLE 12

| | Formulation of Magnetic Toner | | | | |
|---|---|---|---|---|---|
| | Binder resin | | | | |
| | Modified polyester resin (Amount) | Other polyester resin (Amount) | Magnetic material (Amount) | Charge control agent (Amount) | Release agent (Amount) |
| Example 31: | MPER-(33) (100 pbw) | — | MIO (80 pbw) | MAC (2 pbw) | — |
| Example 32: | MPER-(34) (100 pbw) | — | MIO (80 pbw) | MAC (2 pbw) | — (4 pbw) |
| Example 33: | MPER-(35) (50 pbw) | PER-(G) (50 pbw) | MIO (80 pbw) | MAC (2 pbw) | HC wax* (4 pbw) |
| Example 34: | MPER-(36) (100 pbw) | — | MIO (80 pbw) | MAC (2 pbw) | HC wax* (4 pbw) |
| Example 35: | MPER-(37) (30 pbw) | PER-(G) (70 pbw) | MIO (80 pbw) | MAC (2 pbw) | HC wax* (2 pbw) |
| Example 36: | MPER-(38) (50 pbw) | PER-(G) (50 pbw) | MIO (80 pbw) | MAC (2 pbw) | — |
| Example 37: | MPER-(41) (100 pbw) | — | MIO (80 pbw) | MAC (2 pbw) | — |
| Comparative Example 15: | — | PER-(A) | MIO | MAC | — |

TABLE 12-continued

| | Formulation of Magnetic Toner | | | | |
|---|---|---|---|---|---|
| | Binder resin | | | | |
| | Modified polyester resin (Amount) | Other polyester resin (Amount) | Magnetic material (Amount) | Charge control agent (Amount) | Release agent (Amount) |
| | | (100 pbw) | (80 pbw) | (2 pbw) | |
| Comparative Example 16: | MPER-(39) (100 pbw) | — | MIO (80 pbw) | MAC (2 pbw) | — |
| Comparative Example 17: | MPER-(40) (100 pbw) | — | MIO (80 pbw) | MAC (2 pbw) | — |

MPER: Modified polyester resin
MIO: Magnetic Metal iron oxide;
MAC: Monoazo complex
PER: Polyester resin;
HC wax: Hydrocarbon wax,
*Molecular weight peak value: 600

TABLE 13

| | Results of Evaluation on Developer | | | | | | | | | |
|---|---|---|---|---|---|---|---|---|---|---|
| | Example | | | | | | | Comparative Example | | |
| | 31 | 32 | 33 | 34 | 35 | 36 | 37 | 15 | 16 | 17 |
| Fixing temperature range: | 130–240° C. | 130–230° C. | 140–240° C. | 130–230° C. | 130–230° C. | 130–230° C. | 130–230° C. | 190–230° C. | 140–160° C. | 180–230° C. |
| Initial-stage image: | | | | | | | | | | |
| Fog: | AA | AA | AA | AA | AA | AA | AA | B | A | B |
| Density gradation: | AA | AA | A | AA | AA | AA | AA | B | A | C |
| Blank areas caused by poor transfer: | AA | A | AA | AA | AA | AA | AA | C | C | A |
| After 20,000 sheet running: | | | | | | | | | | |
| Fog: | AA | AA | AA | AA | AA | AA | AA | B | A | B |
| Density gradation: | AA | AA | A | AA | AA | AA | AA | B | A | C |
| Melt-adhesion of toner to drum: | AA | A | AA | AA | A | AA | AA | B | C | A |
| Cleaning performance: | AA | A | AA | AA | A | AA | AA | C | C | A |
| Blank areas caused by poor transfer: | AA | A | AA | AA | AA | AA | AA | C | C | A |
| Environment stability: | AA | AA | AA | AA | A | AA | AA | B | C | B |
| Evaluation after long-term leaving: | AA | AA | AA | A | A | A | AA | A | B | A |
| Storage stability: | AA | A | AA | A | A | A | AA | A | C | A |
| Contamination of contact charging roller: | AB | AB | A | A | A | AB | AB | C | AB | AB |
| Blank areas caused by poor transfer in use of contact transfer means: | AB | AB | A | A | A | AB | AB | C | AB | AB |

In Table 13, evaluation symbols denote as follows:

AA: No problem at all

A: No problem in practical use

B: A little problematic in practical use

C: Unsuitable for practical use

What is claimed is:

1. A toner for developing an electrostatic image, comprising a binder resin and a colorant, wherein said binder resin contains a polyester resin at least part of which has been modified with (i) a monohydroxylic compound which has a long-chain alkyl group having 22 to 102 carbon atoms and has a hydroxyl group at its terminal, or (ii) a monocarboxylic compound which has a long-chain alkyl group having 22 to 102 carbon atoms and has a carboxyl group at its terminal, wherein said modified polyester resin has an acid value from 1 to 60.

2. The toner according to claim 1, wherein said binder resin comprises a polyester resin at least part of which has been modified with an alkyl alcohol represented by the following formula (1):

$$CH_3(CH_2)_xCH_2OH \quad (1)$$

wherein x represents a number of from 20 to 100.

3. The toner according to claim 1, wherein said binder resin comprises a polyester resin at least part of which has been modified with an alkyl alcohol represented by the following formula (1):

$$CH_3(CH_2)_xCH_2OH \quad (1)$$

wherein x represents a number of from 23 to 100.

4. The toner according to claim 2, wherein said alkyl alcohol has a weight average molecular weight/number average molecular weight (Mw/Mn) of from 1.0 to 4.0 in its molecular weight distribution as measured by GPC.

5. The toner according to claim 2, wherein said alkyl alcohol has a weight average molecular weight/number average molecular weight (Mw/Mn) of from 1.0 to 3.0 in its molecular weight distribution as measured by GPC.

6. The toner according to claim 1, wherein said binder resin comprises a polyester resin at least part of which has been modified with a substance α obtained by reacting an alkyl alcohol of the following formula (2):

$$CH_3(CH_2)_nOH \quad (2)$$

wherein n is a number of from 21 to 101;

with a compound having one epoxy group in its molecule, of the following formula (3):

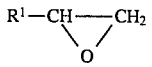

(3)

wherein R' is a hydrogen atom, a hydrocarbon group having 1 to 20 carbon atoms or $R_1$—$CH_2$—, wherein $R_1$ is an ether group or an ester group.

7. The toner according to claim 1, wherein said binder resin comprises a polyester resin at least part of which has been modified with a substance α obtained by reacting an alkyl alcohol of the following formula (2):

$$CH_3(CH_2)_nOH \quad (2)$$

wherein n is a number of from 23 to 101; with a compound having one epoxy group in its molecule, of the following formula (3):

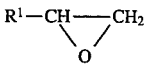

(3)

wherein R' is a hydrogen atom, a hydrocarbon group having 1 to 20 carbon atoms or $R_1$—$CH_2$—, wherein $R_1$ is an ether group or an ester group.

8. The toner according to claim 1, wherein said binder resin comprises a polyester resin at least part of which has been modified with an alkylmonocarboxylic acid represented by the following formula (5):

$$CH_3(CH_2)_yCH_2COOH \quad (5)$$

wherein y represents a number of from 20 to 100.

9. The toner according to claim 1, wherein said binder resin comprises a polyester resin at least part of which has been modified with an alkylmonocarboxylic acid represented by the following formula (5):

$$CH_3(CH_2)_yCH_2COOH \quad (5)$$

wherein y represents a number of from 25 to 80.

10. The toner according to claim 9, wherein said alkylmonocarboxylic acid has a weight average molecular weight/number average molecular weight (Mw/Mn) of from 1.0 to 5.0 in its molecular weight distribution as measured by GPC.

11. The toner according to claim 9, wherein said alkylmonocarboxylic acid has a weight average molecular weight/number average molecular weight (Mw/Mn) of from 1.0 to 3.0 in its molecular weight distribution as measured by GPC.

12. The toner according to claim 1, wherein said polyester resin comprises a linear polyester resin obtained by polycondensation carried out using a dihydric polyol and a dibasic polycarboxylic acid.

13. The toner according to claim 1, wherein said polyester resin comprises a non-linear polyester resin obtained by polycondensation carried out using at least one of trihydric or higher polyol and tribasic or higher polycarboxylic acid in addition to a dihydric polyol and a dibasic polycarboxylic acid.

14. The toner according to claim 2, wherein said binder resin comprises a modified polyester resin obtained by modifying a carboxyl group of a polyester resin having an acid value of from 2 to 100 and a hydroxyl value of 50 or less, with said alkyl alcohol represented by formula (1).

15. The toner according to claim 2, wherein said binder resin comprises a modified polyester resin obtained by modifying both a carboxyl group and a hydroxyl group of a polyester resin having an acid value of from 2 to 100 and a hydroxyl value of from 2 to 100, with said alkyl alcohol represented by formula (1).

16. The toner according to claim 2, wherein said binder resin comprises a modified polyester resin obtained by modifying a hydroxyl group of a polyester resin having a hydroxyl value of from 2 to 100 and an acid value of 50 or less, with said alkyl alcohol represented by formula (1).

17. The toner according to claim 6, wherein shid binder resin comprises a modified polyester resin obtained by modifying a carboxyl group of a polyester resin having an acid value of from 2 to 100 and a hydroxyl value of 50 or less, with said substance α.

18. The toner according to claim 6, wherein said binder resin comprises a modified polyester resin obtained by modifying both a carboxyl group and a hydroxyl group of a polyester resin having an acid value of from 2 to 100 and a hydroxyl value of from 2 to 100, with said substance α.

19. The toner according to claim 6, wherein said binder resin comprises a modified polyester resin obtained by modifying a hydroxyl group of a polyester resin having a hydroxyl value of from 2 to 100 and an acid value of 50 or less, with said substance α.

20. The toner according to claim 8, wherein said binder resin comprises a modified polyester resin obtained by modifying a hydroxyl group of a polyester resin having a hydroxyl value of from 2 to 100 and an acid value of 50 or less, with said alkylmonocarboxylic acid represented by formula (5).

21. The toner according to claim 1, wherein said binder resin comprises a polyester resin modified with a compound prepared by polycondensation and esterification carried out using (i) a polyol, (ii) a polycarboxylic acid and (iii) said monohydroxylic compound or said monocarboyxlic compound.

22. The toner according to claim 1, wherein said binder resin comprises a polyester resin modified with a compound prepared by subjecting (i) at least one of an unreacted carboxyl group and an unreacted hydroxyl group of a polyester resin and (ii) said monohydroxylic compound or said monocarboxylic compound, to esterification after the polyester resin has been synthesized.

23. The toner according to claim 1, wherein said binder resin comprises a polyester resin modified with a compound prepared by subjecting (i) only an unreacted hydroxyl group of a polyester resin and (ii) said monohydroxylic compound or said monocarboxylic compound with diisocyanate, to urethane reaction after the polyester resin has been synthesized.

24. The toner according to claim 1, wherein said polyester resin has been modified with said monohydroxylic compound or said monocarboxylic compound in an amount of modification of from 0.1% by weight to 100% by weight based on the weight of the modified polyester resin.

25. The toner according to claim 1, wherein said polyester resin has been modified with said monohydroxylic compound or said monocarboxylic compound in an amount of modification of from 5% by weight to 50% by weight based on the weight of the modified polyester resin.

26. The toner according to claim 1, wherein said polyester resin has been modified with said monohydroxylic compound or said monocarboxylic compound in an amount of modification of from 10% by weight to 30% by weight based on the weight of the modified polyester resin.

27. The toner according to claim 21, wherein said modified polyester resin is prepared using said monohydroxylic compound or said monocarboxylic compound in an amount of from 0.1 part by weight to 150 parts by weight based on 100 parts by weight of the total weight of said polyol and said polycarboxylic acid.

28. The toner according to claim 21, wherein said modified polyester resin is prepared using said monohydroxylic compound or said monocarboxylic compound in an amount of from 5 parts by weight to 100 parts by weight based on 100 parts by weight of the total weight of said polyol and said polycarboxylic acid.

29. The toner according to claim 21, wherein said modified polyester resin is prepared using said monohydroxylic compound or said monocarboxylic compound in an amount of from 10 parts by weight to 60 parts by weight based on 100 parts by weight of the total weight of said polyol and said polycarboxylic acid.

30. The toner according to claim 22, wherein said modified polyester resin is prepared using said monohydroxylic compound or said monocarboxylic compound in an amount of from 0.1 part by weight to 150 parts by weight based on 100 parts by weight of the polyester resin having not been modified.

31. The toner according to claim 22, wherein said modified polyester resin is prepared using said monohydroxylic compound or said monocarboxylic compound in an amount of from 5 parts by weight to 100 parts by weight based on 100 parts by weight of the polyester resin having not been modified.

32. The toner according to claim 22, wherein said modified polyester resin is prepared using said monohydroxylic compound or said monocarboxylic compound in an amount of from 10 parts by weight to 60 parts by weight based on 100 parts by weight of the polyester resin having not been modified.

33. The toner according to claim 23, wherein said modified polyester resin is prepared using said monohydroxylic compound or said monocarboxylic compound in an amount of from 0.1 part by weight to 150 parts by weight based on 100 parts by weight of the polyester resin having not been modified.

34. The toner according to claim 23, wherein said modified polyester resin is prepared using said monohydroxylic compound or said monocarboxylic compound in an amount of from 5 parts by weight to 100 parts by weight based on 100 parts by weight of the polyester resin having not been modified.

35. The toner according to claim 23, wherein said modified polyester resin is prepared using said monohydroxylic compound or said monocarboxylic compound in an amount of from 10 parts by weight to 60 parts by weight based on 100 parts by weight of the polyester resin having not been modified.

36. The toner according to claim 1, wherein said binder resin comprises a blend of (i) a polyester resin modified with said monohydroxylic compound or said monocarboxylic compound and ii) a polyester resin not modified with said monohydroxylic compound or said monocarboxylic compound; said monohydroxylic compound or said monocarboxylic compound being contained in said binder resin in an amount of from 0.1% by weight to 100% by weight based on the weight of said binder resin.

37. The toner according to claim 1, wherein said binder resin comprises a blend of i) a polyester resin modified with said monohydroxylic compound or said monocarboxylic compound and ii) a polyester resin not modified with said monohydroxylic compound or said monocarboxylic compound; said monohydroxylic compound or said monocarboxylic compound being contained in said binder resin in an amount of from 1% by weight to 50% by weight based on the weight of said binder resin.

38. The toner according to claim 1, wherein said binder resin comprises a blend of i) a polyester resin modified with said monohydroxylic compound or said monocarboxylic compound and ii) a polyester resin not modified with said monohydroxylic compound or said monocarboxylic compound; said monohydroxylic compound or said monocarboxylic compound being contained in said binder resin in an amount of 5% by weight to 30% by weight based on the weight of said binder resin.

39. The toner according to claim 1, wherein said binder resin comprises a blend of i) a polyester resin modified with said monohydroxylic compound or said monocarboxylic compound and ii) a polyester resin not modified with said monohydroxylic compound or said monocarboxylic compound; said monohydroxylic compound or said monocarboxylic compound being contained in said binder resin in an amount of from 10% by weight to 30% by weight based on the weight of said binder resin.

40. The toner according to claim 1, wherein said modified polyester resin has a glass transition point (Tg) of from 25° C. to 75° C.

41. The toner according to claim 1, wherein said modified polyester resin has a glass transition point (Tg) of from 30° C. to 70° C.

42. The toner according to claim 12, wherein said modified polyester resin has a number average molecular weight (Mn) of from 2,000 to 51,000 and a weight average molecular weight (Mw) of from 3,500 to 105,000.

43. The toner according to claim 12, wherein said modified polyester resin has a number average molecular weight (Mn) of from 2,500 to 25,000 and a weight average molecular weight (Mw) of from 4,000 to 90,000.

44. The toner according to claim 13, wherein said modified polyester resin has a number average molecular weight (Mn) of from 2,000 to 102,000 and a weight average molecular weight (Mw) of from 3,500 to 210,000.

45. The toner according to claim 13, wherein said modified polyester resin has a number average molecular weight (Mn) of from 2,500 to 50,000 and a weight average molecular weight (Mw) of from 4,000 to 180,000.

46. The toner according to claim 1, wherein said modified polyester resin has an acid value of from 1 to 60 and a hydroxyl value of from 1 to 60.

47. The toner according to claim 1, wherein said modified polyester resin has an acid value of from 5 to 45 and a hydroxyl value of from 11 to 40.

48. The toner according to claim 1, wherein said colorant comprises a magnetic material, and said toner comprises a magnetic toner.

49. The toner according to claim 1, wherein said colorant comprises a magnetic material, and said binder resin comprises a polyester resin comprising a non-linear polyester resin at least part of which has been modified with a long-chain alkyl alcohol having 25 or more of carbon atoms.

50. The toner according to claim 1, wherein said colorant comprises a dye or a pigment, and said toner comprises a non-magnetic toner.

51. The toner according to claim 1, wherein said toner contains a release agent.

52. The toner according to claim 51, wherein said toner contains an aliphatic hydrocarbon wax.

53. A one-component type developer comprising a toner, wherein said toner comprises a binder resin and a colorant, and said binder resin contains a polyester resin at least part of which has been modified with (i) a monohydroxylic compound which has a long-chain alkyl group having 22 to 102 carbon atoms and has a hydroxyl group at its terminal, or (ii) a monocarboxylic compound which has a long-chain alkyl group having 22 to 102 carbon atoms and has a carboxyl group at its terminal, wherein said modified polyester resin has an acid value from 1 to 60.

54. The one-component type developer according to claim 53, wherein said toner comprises a magnetic toner comprising a binder resin and a magnetic material, and said binder resin comprises a polyester resin comprising a non-linear polyester resin at least part of which has been modified with a long-chain alkyl alcohol having 25 or more of carbon atoms.

55. A two-component type developer comprising a toner and a carrier, wherein said toner comprises a binder resin and a colorant and said binder resin contains a polyester resin at least part of which has been modified with (i) a monohydroxylic compound which has a long-chain alkyl group having 22 to 102 carbon atoms and has a hydroxyl group at its terminal, or (ii) a monocarboxylic compound which has a long-chain alkyl group having 22 to 102 carbon atoms and has a carboxyl group at its terminal, wherein said modified polyester resin has an acid value from 1 to 60.

56. The two-component type developer according to claim 55, wherein said binder resin comprises a polyester resin comprising a non-linear polyester resin at least part of which has been modified with a long-chain alkyl alcohol having 25 or more of carbon atoms.

57. The toner according to claim 1, wherein said monohydroxylic compound has a long-chain alkyl group having 25 to 102 carbon atoms and has a hydroxyl group at its terminal.

58. The toner according to claim 1, wherein said monocarboxylic compound has a long-chain alkyl group having 25 to 102 carbon atoms and has a carboxyl group at its terminal.

59. The one-component type developer according to claim 53, wherein said monohydroxylic compound has a long-chain alkyl group having 25 to 102 carbon atoms and has a hydroxyl group at its terminal.

60. The one-component type developer according to claim 53, wherein said monocarboxylic compound has a long-chain alkyl group having 25 to 102 carbon atoms and has a carboxyl group at its terminal.

61. The two-component type developer according to claim 55, wherein said monohydroxylic compound has a long-chain alkyl group having 25 to 102 carbon atoms and has a hydroxyl group at its terminal.

62. The two-component type developer according to claim 55, wherein said monocarboxylic compound has a long-chain alkyl group having 25 to 102 carbon atoms and has a carboxyl group at its terminal.

63. The toner according to claim 1, wherein said modified polyester resin has an acid value of from 5 to 45.

64. The one-component type developer according to claim 53, wherein said binder resin comprises a polyester resin at least part of which has been modified with an alkyl alcohol represented by the following formula (1):

$$CH_3(CH_2)_xCH_2OH \quad (1)$$

wherein x represents a number of from 20 to 100.

65. The one-component type developer according to claim 53, wherein said binder resin comprises a polyester resin at least part of which has been modified with an alkyl alcohol represented by the following formula (1):

$$CH_3(CH_2)_xCH_2OH \quad (1)$$

wherein x represents a number of from 23 to 100.

66. The one-component type developer according to claim 64, wherein said alkyl alcohol has a weight average molecular weight/number average molecular weight (Mw/Mn) of from 1.0 to 4.0 in its molecular weight distribution as measured by GPC.

67. The one-component type developer according to claim 64, wherein said alkyl alcohol has a weight average molecular weight/number average molecular weight (Mw/Mn) of from 1.0 to 3.0 in its molecular weight distribution as measured by GPC.

68. The one-component type developer according to claim 53, wherein said binder resin comprises a polyester resin at least part of which has been modified with a substance α obtained by reacting an alkyl alcohol of the following formula (2):

$$CH_3(CH_2)_nOH \quad (2)$$

wherein n is a number of from 21 to 101, with a compound having one epoxy group in its molecule, of the following formula (3):

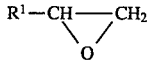

(3)

wherein R' is a hydrogen atom, a hydrogen group having 1 to 20 carbon atoms or $R_1$—$CH_2$—, wherein $R_1$ is an ether group or an ester group.

69. The one-component type developer according to claim 53, wherein said binder resin comprises a polyester resin at least part of which has been modified with a substance α obtained by reacting an alkyl alcohol of the following formula (2):

$$CH_3(CH_2)_nOH \quad (2)$$

wherein n is a number of from 23 to 101; with a compound having one epoxy group in its molecule, of the following formula (3):

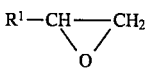

(3)

wherein R' is a hydrogen atom, a hydrocarbon group having 1 to 20 carbon atoms or $R_1$—$CH_2$—, wherein $R_1$ is an ether group or an ester group.

70. The one-component type developer according to claim 53, wherein said binder resin comprises a polyester resin at least part of which has been modified with an alkylmonocarboxylic acid represented by the following formula (5):

$$CH_3(CH_2)_yCH_2COOH \quad (5)$$

wherein y represents a number of from 20 to 100.

71. The one-component type developer according to claim 53, wherein said binder resin comprises a polyester resin at least part of which has been modified with an alkylmonocarboxylic acid represented by the following formula (5):

$$CH_3(CH_2)_yCH_2COOH \quad (5)$$

where y represents a number of from 25 to 80.

72. The one-component type developer according to claim 71, wherein said alkylmonocarboxylic acid has a weight average molecular weight/number average molecular weight (Mw/Mn) of from 1.0 to 5.0 in its molecular weight distribution as measured by GPC.

73. he one-component type developer according to claim 71, wherein said alkylmonocarboxylic acid has a weight average molecular weight/number average molecular weight (Mw/Mn) of from 1.0 to 3.0 in its molecular weight distribution as measured by GPC.

74. The one-component type developer according to claim 53, wherein said polyester resin comprises a linear polyester resin obtained by polycondensation carried out using a dihydric polyol and a dibasic polycarboxylic acid.

75. The one-component type developer according to claim 53, wherein said polyester resin comprises a non-linear polyester resin obtained by polycondensation carried out using at least one of trihydric or higher polyol and tribasic or higher polycarboxylic acid in addition to a dihydric polyol and a dibasic polycarboxylic acid.

76. The one-component type developer according to claim 64, wherein said binder resin comprises a modified polyester resin obtained by modifying a carboxyl group of a polyester resin having an acid value of from 2 to 100 and a hydroxyl value of 50 or less, with said alkyl alcohol represented by formula (1).

77. The one-component type developer according to claim 64, wherein said binder resin comprises a modified polyester resin obtained by modifying both a carboxyl group and a hydroxyl group of a polyester resin having an acid value of from 2 to 100 and a hydroxyl value of form 2 to 100, with said alkyl alcohol represented by formula (1).

78. The one-component type developer according to claim 64, wherein said binder resin comprises a modified polyester resin obtained by modifying a hydroxyl group of a polyester resin having a hydroxyl value of from 2 to 100 and an acid value of 50 or less, with said alkyl alcohol represented by formula (1).

79. The one-component type developer according to claim 68, wherein said binder resin comprises a modified polyester resin obtained by modifying a carboxyl group of a polyester resin having an acid value of from 2 to 100 and a hydroxyl value of 50 or less, with said substance α.

80. The one-component type developer according to claim 68, wherein said binder resin comprises a modified polyester resin obtained by modifying both a carboxyl group and a hydroxyl group of a polyester resin having an acid value of from 2 to 100 and a hydroxyl value of form 2 to 100 with said substance α.

81. The one-component type developer according to claim 68, wherein said binder resin comprises a modified polyester resin obtained by modifying a hydroxyl group of a polyester resin having a hydroxyl value of from 2 to 100 and an acid value of 50 or less, with said substance α.

82. The one-component type developer according to claim 70, wherein said binder resin comprises a modified polyester resin obtained by modifying a hydroxyl group of a polyester resin having a hydroxyl value of form 2 to 100 and an acid value of 50 or less, with said alkylmonocarboxylic acid represented by formula (5).

83. The one-component type developer according to claim 53, wherein said binder resin comprises a polyester resin modified with a compound prepared by polycondensation and esterification carried out using (i) a polyol, (ii) a polycarboxylic acid and (iii) said monohydroxylic compound or said monocarboxylic compound.

84. The one-component type developer according to claim 53, wherein said binder resin comprises a polyester resin modified with a compound prepared by subjecting (i) at least one of an unreacted carboxyl group and an unreacted hydroxyl group of a polyester resin and (ii) said monohydroxylic compound or said monocarboxylic compound, to esterification after the polyester resin has been synthesized.

85. The one-component type developer according to claim 53, wherein said binder resin comprises a copolyester resin modified with a compound prepared by subjecting (i) only an unreacted hydroxyl group of a polyester resin and (ii) said monohydroxylic compound or said monocarboxylic compound with diisocyanate, to urethane reaction after the polyester resin has been synthesized.

86. The one-component type developer according to claim 53, wherein said polyester resin has been modified with said monohydroxylic compound or said monocarboxylic compound in an amount of modification of from 0.1% by weight to 100% by weight based on the weight of the modified polyester resin.

87. The one-component type developer according to claim 53, wherein said polyester resin has been modified with said monohydroxylic compound or said monocarboxylic compound in an amount of modification of from 5% by weight to 50% by weight based on the weight of the modified polyester resin.

88. The one-component type developer according to claim 53, wherein said polyester resin has been modified with said monohydroxylic compound or said monocarboxylic compound in an amount of modification of from 10% by weight to 30% by weight based on the weight of the modified polyester resin.

89. The one-component type developer according to claim 83, wherein said modified polyester resin is prepared using said monohydroxylic compound or said monocarboxylic compound in an amount of from 0.1 part by weight to 150 parts by weight based on 100 parts by weight of the total weight of said polyol and said polycarboxylic acid.

90. The one-component type developer according to claim 83, wherein said modified polyester resin is prepared using said monohydroxylic compound or said monocarboxylic compound in an amount of from 5 parts by weight to 100 parts by weight based on 100 parts by weight of the total weight of said polyol and said polycarboxylic acid.

91. The one-component type developer according to claim 83, wherein said modified polyester resin is prepared using said monohydroxylic compound or said monocarboxylic compound in an amount of from 10 parts by weight to 60 parts by weight based on 100 parts by weight of the total weight of said polyol and said polycarboxylic acid.

92. The one-component type developer according to claim 84, wherein said modified polyester resin is prepared using said monohydroxylic compound or said monocarboxylic compound in an amount of from 0.1 part by weight to 150 parts by weight based on 100 parts by weight of the polyester resin having not been modified.

93. The one-component type developer according to claim 84, wherein said modified polyester resin is prepared using said monohydroxylic compound or said monocarboxylic compound in an amount of from 5 parts by weight to 100 parts by weight based on 100 parts by weight of the polyester resin having not been modified.

94. The one-component type developer according to claim 84, wherein said modified polyester resin is prepared using said monohydroxylic compound or said monocarboxylic compound in an amount of from 10 parts by weight to 60 parts by weight based on 100 parts by weight of the polyester resin having not been modified.

95. The one-component type developer according to claim 85, wherein said modified polyester resin is prepared using said monohydroxylic compound or said monocarboxylic compound in an amount of from 0.1 part by weight to 150 parts by weight based on 100 parts by weight of the polyester resin having not been modified.

96. The one-component type developer according to claim 85, wherein said modified polyester resin is prepared using said monohydroxylic compound or said monocarboxylic compound in an amount of from 5 parts by weight to 100 parts by weight based on 100 parts by weight of the polyester resin having not been modified.

97. The one-component type developer according to claim 85, wherein said modified polyester resin is prepared using said monohydroxylic compound or said monocarboxylic compound in an amount of from 10 parts by weight to 50 parts by weight based on 100 parts by weight of the polyester resin having not been modified.

98. The one-component type developer according to claim 53, wherein said binder resin comprises a blend of (i) a polyester resin modified with said monohydroxylic compound or said monocarboxylic compound and (ii) a polyester resin not modified with said monohydroxylic compound or said monocarboxylic compound; said monohydroxylic compound or said monocarboxylic compound being contained in said binder resin in an amount of from 0.1% by weight to 100% by weight based on the weight of said binder resin.

99. The one-component type developer according to claim 53, wherein said binder resin comprises a blend of (i) a polyester resin modified with said monohydroxylic compound or said monocarboxylic compound and (ii) a polyester resin not modified with said monohydroxylic compound or said monocarboxylic compound; said monohydroxylic compound or said monocarboxylic compound being contained in said binder resin in an amount of from 1% by weight to 50% by weight based on the weight of said binder resin.

100. The one-component type developer according to claim 53, wherein said binder resin comprises a blend of (i) a polyester resin modified with said monohydroxylic compound or said monocarboxylic compound and (ii) a polyester resin not modified with said monohydroxylic compound or said monocarboxylic compound; said monohydroxylic compound or said monocarboxylic compound being contained in said binder resin in an amount of from 5% by weight to 30% by weight based on the weight of said binder resin.

101. The one-component type developer according to claim 53, wherein said binder resin comprises a blend of (i) a polyester resin modified with said monohydroxylic compound or said monocarboxylic compound and (ii) a polyester resin not modified with said monohydroxylic compound or said monocarboxylic compound; said monohydroxylic compound or said monocarboxylic compound being contained is said binder resin in an amount of from 10% by weight to 30% by weight based on the weight of said binder resin.

102. The one-component type developer according to claim 53, wherein said modified polyester resin has a glass transition point (Tg) of from 25° C. to 75° C.

103. The one-component type developer according to claim 53, wherein said modified polyester resin has a glass transition point (Tg) of from 30° C. to 70° C.

104. The one-component type developer according to claim 53, wherein said modified polyester resin has a number average molecular weight (Mn) of from 2,000 to 51,000 and a weight average molecular weight (Mw) of from 3,500 to 105,000.

105. The one-component type developer according to claim 74, wherein said modified polyester resin has a number average molecular weight (Mn) of 2,500 to 25,000 and a weight average molecular weight (Mw) of from 4,000 to 90,000.

106. The one-component type developer according to claim 75, wherein said modified polyester resin has a number average molecular weight (Mn) of 2,000 to 102,000 and a weight average molecular weight (Mw) of from 3,500 to 210,000.

107. The one-component type developer according to claim 75, wherein said modified polyester resin has a number average molecular weight (Mn) of 2,500 to 50,000 and a weight average molecular weight (Mw) of from 4,000 to 180,000.

108. The one-component type developer according to claim 53, wherein said modified polyester resin has an acid value of from 1 to 60 and a hydroxyl value of from 1 to 60.

109. The one-component type developer according to claim 53, wherein said modified polyester resin has an acid value of from 5 to 45 and a hydroxyl value of from 11 to 40.

110. The one-component type developer according to claim 53, wherein said colorant comprises a magnetic material, and said toner comprises a magnetic toner.

111. The one-component type developer according to claim 53, wherein said colorant comprises a magnetic material, and said binder resin comprises a polyester resin comprising a non-linear polyester resin at least part of which has been modified with a long-chain alkyl alcohol having 25 or more of carbon atoms.

112. The one-component type developer according to claim 53, wherein said colorant comprises a dye or a pigment, and said toner comprises a non-magnetic toner.

113. The one-component type developer according to claim 53, wherein said toner contains a release agent.

114. The one-component type developer according to claim 113, wherein said toner contains an aliphatic hydrocarbon wax.

115. The one-component type developer according to claim 53, wherein said modified polyester resin has an acid value of from 5 to 45.

116. The two-component type developer according to claim 55, wherein said binder resin comprises a polyester resin at least part of which has been modified with an alkyl alcohol represented by the following formula (1):

$$CH_3(CH_2)_xCH_2OH \quad (1)$$

wherein x represents a number of from 20 to 100.

117. The two-component type developer according to claim 55, wherein said binder resin comprises a polyester resin at least part of which has been modified with an alkyl alcohol represented by the following formula (1):

$$CH_3(CH_2)_xCH_2OH \quad (1)$$

wherein x represents a number of from 23 to 100.

118. The two-component type developer according to claim 116, wherein said alkyl alcohol has a weight average molecular weight/number average molecular weight (Mw/Mn) of from 1.0 to 4.0 in its molecular weight distribution as measured by GPC.

119. The two-component type developer according to claim 116, wherein said alkyl alcohol has a weight average molecular weight/number average molecular weight (Mw/Mn) of from 1.0 to 3.0 in its molecular weight distribution as measured by GPC.

120. The two-component type developer according to claim 55, wherein said binder resin comprises a polyester resin at least part of which has been modified with a substance α obtained by reacting an alkyl alcohol of the following formula (2):

$$CH_3(CH_2)_nOH \quad (2)$$

wherein n is a number of from 21 to 101, with a compound having one epoxy group in its molecule, of the following formula (3):

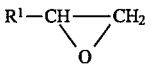

(3)

wherein R' is a hydrogen atom, a hydrogen group having 1 to 20 carbon atoms or $R_1$—$CH_2$—, wherein $R_1$ is an ether group or an ester group.

121. The two-component type developer according to claim 55, wherein said binder resin comprises a polyester resin at least part of which has been modified with a substance α obtained by reacting an alkyl alcohol of the following formula (2):

$$CH_3(CH_2)_nOH \quad (2)$$

wherein n is a number of from 23 to 101; with a compound having one epoxy group in its molecule, of the following formula (3):

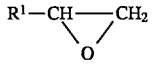

(3)

wherein R' is a hydrogen atom, a hydrocarbon group having 1 to 20 carbon atoms or $R_1$—$Ch_2$—, wherein $R_1$ is an ether group or an ester group.

122. The two-component type developer according to claim 55, wherein said binder resin comprises a polyester resin at least part of which has been modified with an alkylmonocarboxylic acid represented by the following formula (5):

$$CH_3(CH_2)_yCH_2COOH \quad (5)$$

wherein y represents a number of from 20 to 100.

123. The two-component type developer according to claim 55, wherein said binder resin comprises a polyester resin at least part of which has been modified with an alkylmonocarboxylic acid represented by the following formula (5):

$$CH_3(CH_2)_yCH_2COOH \quad (5)$$

where y represents a number of from 25 to 80.

124. The two-component type developer according to claim 123, wherein said alkylmonocarboxylic acid has a weight average molecular weight/number average molecular weight (Mw/Mn) of from 1.0 to 5.0 in its molecular weight distribution as measured by GPC.

125. The two-component type developer according to claim 123, wherein said alkylmonocarboxylic acid has a weight average molecular weight/number average molecular weight (Mw/Mn) of from 1.0 to 3.0 in its molecular weight distribution as measured by GPC.

126. The two-component type developer according to claim 55, wherein said polyester resin comprises a linear polyester resin obtained by polycondensation carried out using a dihydric polyol and a dibasic polycarboxylic acid.

127. The two-component type developer according to claim 55, wherein said polyester resin comprises a non-linear polyester resin obtained by polycondensation carried out using at least one of trihydric or higher polyol and tribasic or higher polycarboxylic acid in addition to a dihydric polyol and a dibasic polycarboxylic acid.

128. The two-component type developer according to claim 116, wherein said binder resin comprises a modified polyester resin obtained by modifying a carboxyl group of a polyester resin having an acid value of from 2 to 100 and a hydroxyl value of 50 or less, with said alkyl alcohol represented by formula (1).

129. The two-component type developer according to claim 116, wherein said binder resin comprises a modified polyester resin obtained by modifying both a carboxyl group and a hydroxyl group of a polyester rein having an acid value of from 2 to 100 and a hydroxyl value of form 2 to 100, with said alkyl alcohol represented by formula (1).

130. The two-component type developer according to claim 116, wherein said binder resin comprises a modified polyester resin obtained by modifying a hydroxyl group of a polyester resin having a hydroxyl value of from 2 to 100 and an acid value of 50 or less, with said alkyl alcohol represented by formula (1).

131. The two-component type developer according to claim 120, wherein said binder resin comprises a modified polyester resin obtained by modifying a carboxyl group of a polyester resin having an acid value of from 2 to 100 and a hydroxyl value of 50 or less, with said substance α.

132. The two-component type developer according to claim 120, wherein said binder resin comprises a modified polyester resin obtained by modifying both a carboxyl group and a hydroxyl group of a polyester resin having an acid value of from 2 to 100 and a hydroxyl value of form 2 to 100 with said substance α.

133. The two-component type developer according to claim 120, wherein said binder resin comprises a modified polyester resin obtained by modifying a hydroxyl group of a polyester resin having a hydroxyl value of from 2 to 100 and an acid value of 50 or less, with said substance α.

134. The two-component type developer according to claim 122, wherein said binder resin comprises a modified polyester resin obtained by modifying a hydroxyl group of a polyester resin having a hydroxyl value of form 2 to 100 and an acid value of 50 or less, with said alkylmonocarboxylic acid represented by formula (5).

135. The two-component type developer according to claim 55, wherein said binder resin comprises a polyester resin modified with a compound prepared by polycondensation and esterification carried out using (i) a polyol, (ii) a polycarboxylic acid and (iii) said monohydroxylic compound or said monocarboxylic compound.

136. The two-component type developer according to claim 55, wherein said binder resin comprises a polyester resin modified with a compound prepared by subjecting (i) at least one of an unreacted carboxyl group and an unreacted hydroxyl group of a polyester resin and (ii) said monohydroxylic compound or said monocarboxylic compound, to esterification after the polyester resin has been synthesized.

137. The two-component type developer according to claim 55, wherein said binder resin comprises a copolyester resin modified with a compound prepared by subjecting (i) only an unreacted hydroxyl group of a polyester resin and (ii) said monohydroxylic compound or said monocarboxylic compound with diisocyanate, to urethane reaction after the polyester resin has been synthesized.

138. The two-component type developer according to claim 55, wherein said polyester resin has been modified with said monohydroxylic compound or said monocarboxylic compound in an amount of modification of from 0.1% by weight to 100% by weight based on the weight of the modified polyester resin.

139. The two-component type developer according to claim 55, wherein said polyester resin has been modified with said monohydroxylic compound or said monocarboxylic compound in an amount of modification of from 5% by weight to 50% by weight based on the weight of the modified polyester resin.

140. The two-component type developer according to claim 55, wherein said polyester resin has been modified with said monohydroxylic compound or said monocarboxylic compound in an amount of modification of from 10% by weight to 30% by weight based on the weight of the modified polyester resin.

141. The two-component type developer according to claim 135, wherein said modified polyester resin is prepared using said monohydroxylic compound or said monocarboxylic compound in an amount of from 0.1 part by weight to 150 parts by weight based on 100 parts by weight of the total weight of said polyol and said polycarboxylic acid.

142. The two-component type developer according to claim 135, wherein said modified polyester resin is prepared using said monohydroxylic compound or said monocarboxylic compound in an amount of from 5 parts by weight to 100 parts by weight based on 100 parts by weight of the total weight of said polyol and said polycarboxylic acid.

143. The two-component type developer according to claim 135, wherein said modified polyester resin is prepared using said monohydroxylic compound or said monocarboxylic compound in an amount of from 10 parts by weight to 60 parts by weight based on 100 parts by weight of the total weight of said polyol and said polycarboxylic acid.

144. The two-component type developer according to claim 136, wherein said modified polyester resin is prepared using said monohydroxylic compound or said monocarboxylic compound in an amount of from 0.1 part by weight to 150 parts by weight based on 100 parts by weight of the polyester resin having not been modified.

145. The two-component type developer according to claim 136, wherein said modified polyester resin is prepared using said monohydroxylic compound or said monocarboxylic compound in an amount of from 5 parts by weight to 100 parts by weight based on 100 parts by weight of the polyester resin having not been modified.

146. The two-component type developer according to claim 136, wherein said modified polyester resin is prepared using said monohydroxylic compound or said monocarboxylic compound in an amount of from 10 parts by weight to 60 parts by weight based on 100 parts by weight of the polyester resin having not been modified.

147. The two-component type developer according to claim 137, wherein said modified polyester resin is prepared using said monohydroxylic compound or said monocarboxylic compound in an amount of from 0.1 part by weight to 150 parts by weight based on 100 parts by weight of the polyester resin having not been modified.

148. The two-component type developer according to claim 137, wherein said modified polyester resin is prepared using said monohydroxylic compound or said monocarboxylic compound in an amount of from 5 parts by weight to 100 parts by weight based on 100 parts by weight of the polyester resin having not been modified.

149. The two-component type developer according to claim 137, wherein said modified polyester resin is prepared using said monohydroxylic compound or said monocarboxylic compound in an amount of from 10 parts by weight to 50 parts by weight based on 100 parts by weight of the polyester resin having not been modified.

150. The two-component type developer according to claim 55, wherein said binder resin comprises a blend of (i) a polyester resin modified with said monohydroxylic compound or said monocarboxylic compound and (ii) a polyester resin not modified with said monohydroxylic compound or said monocarboxylic compound; said monohydroxylic compound or said monocarboxylic compound being contained in said binder resin in an amount of from 0.1% by weight to 100% by weight based on the weight of said binder resin.

151. The two-component type developer according to claim 55, wherein said binder resin comprises a blend of (i) a polyester resin modified with said monohydroxylic compound or said monocarboxylic compound and (ii) a polyester resin not modified with said monohydroxylic compound or said monocarboxylic compound; said monohydroxylic compound or said monocarboxylic compound being contained in said binder resin in an amount of from 1% by weight to 50% by weight based on the weight of said binder resin.

152. The two-component type developer according to claim 55, wherein said binder resin comprises a blend of (i) a polyester resin modified with said monohydroxylic compound or said monocarboxylic compound and (ii) a polyester resin not modified with said monohydroxylic compound or said monocarboxylic compound; said monohydroxylic compound or said monocarboxylic compound being contained in said binder resin in an amount of from 5% by weight to 30% by weight based on the weight of said binder resin.

153. The two-component type developer according to claim 55, wherein said binder resin comprises a blend of (i) a polyester resin modified with said monohydroxylic compound or said monocarboxylic compound and (ii) a polyester resin not modified with said monohydroxylic compound or said monocarboxylic compound; said monohydroxylic compound or said monocarboxylic compound being contained is said binder resin in an amount of from 10% by weight to 30% by weight based on the weight of said binder resin.

154. The two-component type developer according to claim 55, wherein said modified polyester resin has a glass transition point (Tg) of from 25° C. to 75° C.

155. The two-component type developer according to claim 55, wherein said modified polyester resin has a glass transition point (Tg) of from 30° C. to 70° C.

156. The two-component type developer according to claim 126, wherein said modified polyester resin has a number average molecular weight (Mn) of from 2,000 to 51,000 and a weight average molecular weight (Mw) of from 3,500 to 105,000.

157. The two-component type developer according to claim 126, wherein said modified polyester resin has a number average molecular weight (Mn) of 2,500 to 25,000 and a weight average molecular weight (Mw) of from 4,000 to 90,000.

158. The two-component type developer according to claim 127, wherein said modified polyester resin has a number average molecular weight (Mn) of 2,000 to 102,000 and a weight average molecular weight (Mw) of from 3,500 to 210,000.

159. The two-component type developer according to claim 127, wherein said modified polyester resin has a number average molecular weight (Mn) of 2,500 to 50,000 and a weight average molecular weight (Mw) of from 4,000 to 180,000.

160. The two-component type developer according to claim 55, wherein said modified polyester resin has an acid value of from 1 to 60 and a hydroxyl value of from 1 to 60.

161. The two-component type developer according to claim 55, wherein said modified polyester resin has an acid value of from 5 to 45 and a hydroxyl value of from 11 to 40.

162. The two-component type developer according to claim 55, wherein said colorant comprises a magnetic material, and said toner comprises a magnetic toner.

163. The two-component type developer according to claim 55, wherein said colorant comprises a magnetic material, and said binder resin comprises a polyester resin comprising a non-linear polyester resin at least part of which has been modified with a long-chain alkyl alcohol having 25 or more of carbon atoms.

164. The two-component type developer according to claim 55, wherein said colorant comprises a dye or a pigment, and said toner comprises a non-magnetic toner.

165. The two-component type developer according to claim 55, wherein said toner contains a release agent.

166. The two-component type developer according to claim 165, wherein said toner contains an aliphatic hydrocarbon wax.

167. The two-component type developer according to claim 55, wherein said modified polyester resin has an acid value of from 5 to 45.

* * * * *

UNITED STATES PATENT AND TRADEMARK OFFICE

CERTIFICATE OF CORRECTION

PATENT NO. : 5,578,409

DATED : November 26, 1996

INVENTOR(S) : TAKAAKI KOTAKI ET AL.

It is certified that error appears in the above-indentified patent and that said Letters Patent is hereby corrected as shown below:

On the title page, item [54], and column 1 in the title:

Lines 2-3, "ONE COMPONENT-TYPE" should read --ONE-COMPONENT TYPE--.

[57] ABSTRACT

Line 5, "22 to" should read --22 to 102--.

COLUMN 1

Line 2, "ONE" should read --ONE--.
Line 3, "COMPONENT-TYPE" should read --COMPONENT TYPE--
Line 57, "carried" should read --carrier--.

COLUMN 3

Line 33, "still" should be deleted.

UNITED STATES PATENT AND TRADEMARK OFFICE

CERTIFICATE OF CORRECTION

PATENT NO. : 5,578,409

DATED : November 26, 1996

INVENTOR(S) : TAKAAKI KOTAKI ET AL.

It is certified that error appears in the above-identified patent and that said Letters Patent is hereby corrected as shown below:

COLUMN 4

Line 7, "areas" should read --area--.

COLUMN 5

Line 11, "and" should be deleted.
Line 32, "may" should read --do not--.
Line 33, "no" should be deleted.
Line 34, "no" should be deleted.

COLUMN 6

Line 17, "still" should be deleted.

COLUMN 7

Line 51, "has" should read --have--.

UNITED STATES PATENT AND TRADEMARK OFFICE

CERTIFICATE OF CORRECTION

PATENT NO. : 5,578,409

DATED : November 26, 1996

INVENTOR(S) : TAKAAKI KOTAKI ET AL.

It is certified that error appears in the above-identified patent and that said Letters Patent is hereby corrected as shown below:

COLUMN 11

Line 55, "iraconic" should read --itaconic--.

COLUMN 12

Line 1, "form" should read --from--.
Line 15, "trimetlitic" should read --trimellitic--.
Line 31, "form" should read --from--.

COLUMN 13

Line 64, "Perking Elmer" should read --Perkin-Elmer--.

COLUMN 14

Line 2, "droping" should read --dropping--.

COLUMN 15

Line 6, "form" should read --from--.

COLUMN 16

Line 1, "oxide;" should read --oxides;--.
Line 65, "patinatic" should read --parinaric--.

UNITED STATES PATENT AND TRADEMARK OFFICE

CERTIFICATE OF CORRECTION

PATENT NO. : 5,578,409

DATED : November 26, 1996

INVENTOR(S) : TAKAAKI KOTAKI ET AL.

It is certified that error appears in the above-identified patent and that said Letters Patent is hereby corrected as shown below:

COLUMN 17

Line 46, "less" should read --fewer--.

COLUMN 18

Line 8, "silicas" (second occurrence) should read --silica--.
Line 27, "halide" should read --halides--.
Line 29, "oxide." should read --oxides.--
Line 67, "trimethylsilylmer" should be deleted.

COLUMN 19

Line 1, "captan," should be deleted.

COLUMN 21

Line 24, "are" should read --is--.

COLUMN 22

Line 54, "derivatives" should read --derivative--.

COLUMN 27

Table 5, Comparative Example 4, arrow should be extended into Column (8).

UNITED STATES PATENT AND TRADEMARK OFFICE

CERTIFICATE OF CORRECTION

PATENT NO. : 5,578,409

DATED : November 26, 1996

INVENTOR(S) : TAKAAKI KOTAKI ET AL.

It is certified that error appears in the above-identified patent and that said Letters Patent is hereby corrected as shown below:

COLUMN 29

Line 53, "After" should read --After it--.

COLUMNS 31-32

Table 6, "Dodecenyl succinic" should read --Dodecenylsuccinic--.

COLUMN 32

Line 14, "After" should read --After it--.

COLUMN 33

Line 29, "vacuum" should read --vacuumed--.
Line 46, "papas" should read --paper--.

COLUMN 36

Line 52, "sheet" should read --sheets--.

COLUMN 39

Line 67, "glycol" should read --acid--.

COLUMNS 41-42

Table 8, "Dodecenyl succinic" should read --Dodecenylsuccinic--.

UNITED STATES PATENT AND TRADEMARK OFFICE

CERTIFICATE OF CORRECTION

PATENT NO. : 5,578,409

DATED : November 26, 1996

INVENTOR(S) : TAKAAKI KOTAKI ET AL.

It is certified that error appears in the above-identified patent and that said Letters Patent is hereby corrected as shown below:

COLUMNS 47-48

Table 9, "18" should read --17-- (1st. occurrence).

COLUMN 48

Line 67, "minute's" should read --minutes'--.

COLUMN 49

Line 11, "minute's" should read --minutes'--.
Line 22, "minute's" should read --minutes'--.
Line 33, "minute's" should read --minutes'--.
Line 43, "2.07x10" should read --$2.07 \times 10^5$--.
Line 44, "minute's" should read --minutes'--.
Line 63, "cooled" should read --it cooled--.

COLUMN 52

Line 50, "was" should read --were--.

COLUMN 55

Line 8, "7,500" should read --7,500th--.
Line 36, "4,500" should read --4,500th--.

COLUMN 56

Line 15, "7,000" should read --7,000th--.
Line 41, "4,000" should read --4,000th--.

UNITED STATES PATENT AND TRADEMARK OFFICE

CERTIFICATE OF CORRECTION

PATENT NO. : 5,578,409

DATED : November 26, 1996

INVENTOR(S) : TAKAAKI KOTAKI ET AL.

It is certified that error appears in the above-identified patent and that said Letters Patent is hereby corrected as shown below:

COLUMNS 57-58

Table 10, "(1):" should read --(1):-- and "(2):" should read --(2):--.

COLUMN 58

Line 26, "the" (second occurrence) should read --the same--.

COLUMN 61

Table 12, "oxide;" should read --oxide--; "resin;" should read --resin--; and "wax," should read --wax--.

COLUMN 63

Line 12, "$R^1$" should read --R′--.
Line 29, "$R^1$" should read --R′--.

COLUMN 64

Line 20, "shid" should read --said--

COLUMN 65

Line 64, "(i)" should read --i)--.

UNITED STATES PATENT AND TRADEMARK OFFICE

CERTIFICATE OF CORRECTION

PATENT NO. : 5,578,409

DATED : November 26, 1996

INVENTOR(S) : TAKAAKI KOTAKI ET AL.

It is certified that error appears in the above-identified patent and that said Letters Patent is hereby corrected as shown below:

COLUMN 68

Line 39, "$R^1$" should read --R'--.
Line 57, "$R^1$" should read --R'--.

COLUMN 69

Line 19, "he" should read --The--.
Line 44, "form" should read --from--.
Line 61, "form" should read --from--.

COLUMN 70

Line 4, "form" should read --from--.

COLUMN 72

Line 1, "is" should read --in--.

COLUMN 73

Line 29, "$R^1$" should read --R'--.
Line 47, "$R^1$" should read --R'--.

COLUMN 74

Line 31, "rein" should read --resin--.
Line 32, "form" should read --from--.
Line 49, "form" should read --from--.
Line 59, "form" should read --from--.

UNITED STATES PATENT AND TRADEMARK OFFICE

CERTIFICATE OF CORRECTION

PATENT NO. : 5,578,409

DATED : November 26, 1996

INVENTOR(S) : TAKAAKI KOTAKI ET AL.

It is certified that error appears in the above-identified patent and that said Letters Patent is hereby corrected as shown below:

COLUMN 75

Line 9, "copolyester" should read --polyester--.

COLUMN 76

Line 56, "is" should read --in--.

Signed and Sealed this

Twenty-fourth Day of June, 1997

Bruce Lehman

*Attest:*

BRUCE LEHMAN

*Attesting Officer*

*Commissioner of Patents and Trademarks*